US007471924B2

(12) United States Patent
Shigezaki et al.

(10) Patent No.: US 7,471,924 B2
(45) Date of Patent: Dec. 30, 2008

(54) CLEANING UNIT AND IMAGE FORMING APPARATUS

(75) Inventors: Satoshi Shigezaki, Ebina (JP); Hiroe Okuyama, Ebina (JP); Makoto Sakanobe, Ebina (JP); Kanji Shintaku, Ebina (JP); Satoya Sugiura, Ebina (JP); Tatsuya Soga, Ebina (JP); Jin Iwasaki, Ebina (JP); Yoshitaka Kuroda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 330 days.

(21) Appl. No.: 11/351,097

(22) Filed: Feb. 10, 2006

(65) Prior Publication Data

US 2007/0020005 A1 Jan. 25, 2007

(30) Foreign Application Priority Data

Jul. 25, 2005 (JP) ..... 2005-214075
Aug. 24, 2005 (JP) ..... 2005-243223
Aug. 24, 2005 (JP) ..... 2005-243235

(51) Int. Cl.
*G03G 21/00* (2006.01)

(52) U.S. Cl. ..... 399/349; 399/350; 399/353; 399/354

(58) Field of Classification Search ..... 399/123, 399/343, 350, 353, 354, 349
See application file for complete search history.

(56) References Cited

U.S. PATENT DOCUMENTS

| | | | | |
|---|---|---|---|---|
| 5,729,815 | A * | 3/1998 | Lindblad et al. | 399/354 |
| 5,797,078 | A * | 8/1998 | Sass et al. | 399/357 |
| 6,219,505 | B1 * | 4/2001 | Sato et al. | 399/98 |
| 2005/0141919 | A1 | 6/2005 | Kitajima et al. | |

FOREIGN PATENT DOCUMENTS

| | | |
|---|---|---|
| JP | A 63-015278 | 1/1988 |
| JP | A 01-161279 | 6/1989 |
| JP | A 05-107993 | 4/1993 |
| JP | A 11-038656 | 2/1999 |
| JP | A 2001-003413 | 1/2001 |
| JP | A 2001-109351 | 4/2001 |
| JP | A 2002-244522 | 8/2002 |
| JP | A 2004-239999 | 8/2004 |

* cited by examiner

*Primary Examiner*—Hoan H Tran
(74) *Attorney, Agent, or Firm*—Oliff & Berridge, PLC

(57) ABSTRACT

This invention relates to a cleaning unit including a cleaning blade that keeps a front end of rubber material in contact with the surface with a pressure so as to scrape residual toner left on the surface of the photoreceptor and a fiber body having multiple fibers in contact with the surface of the photoreceptor in the upstream in the cyclic moving direction of the surface of the photoreceptor with respect to the cleaning blade, the cleaning blade satisfying $A \geqq -2.5 \times B + 102$ and $6.3 \leqq B \leqq 19.6$, where A designates a contact angle (°) with pure water under 23° C., 55% RH and B designates 100% modulus (MPa) at 23° C.

12 Claims, 18 Drawing Sheets

CLEANING UNIT AND IMAGE FORMING APPARATUS

BACKGROUND OF THE INVENTION

1. Field of the Invention

The present invention relates to a cleaning unit for removing residue such as left toner employed by electrophotographic systems including a copier, facsimile, printer and an image forming apparatus equipped with the same cleaning unit.

2. Description of the Related Art

According to a conventional electrophotographic system, in toner image forming cycle of charging the surface of a photoreceptor which executes cyclic move, for example, rotation in a predetermined direction about a center axis with a charger, forming a latent electrostatic image on the surface of the photoreceptor by irradiating the surface of the photoreceptor after charged with exposure light and then forming a toner image on the surface of the photoreceptor by developing that latent electrostatic image with a developer, the toner image formed on the surface of the photoreceptor is transferred to a predetermined transfer object surface (recording medium or intermediate transfer body) and finally fixed to the recording medium so that an image composed of the fixed toner image is formed on that recording medium.

Because plural kinds of foreign matters such as not-transferred toner, additive, paper particles and discharge product generated during discharge are left on the surface of the photoreceptor after the transfer to a predetermined transfer object surface is completed, these materials need to be removed with a cleaning means prior to a next toner image forming cycle.

Although various methods have been proposed as the cleaning method for removing the residue such as toner, blade system of bringing a front edge of a plate-like cleaning blade into a pressure contact with the surface of the photoreceptor has been often employed. Also as one of cleaning methods, brush system of using a roll-like brush extending in parallel to the axis of the photoreceptor with bias of opposite polarity to the charging polarity of toner applied to the brush has been proposed.

In the blade system, the surface of the photoreceptor is scraped with a cleaning blade so that the residue on the surface of the photoreceptor is removed from the surface. In such a method using the cleaning blade, rubbing occurs between the surface of the photoreceptor and the front edge of the cleaning blade. Toner particle having a small grain diameter and additive particle added to the toner particle pass through a gap between them thereby substituting for lubricant, so that the rubbing is kept preferable.

By the way, electric and mechanical external forces are applied directly to the surface of the photoreceptor by a charger, developer, transfer means and the like. Thus, the surface of the photoreceptor needs durability against wearing or damage and to secure this durability, a photoreceptor whose surface is hard (see, for example, JP No. 3264218) has been often used.

However, if the photoreceptor whose surface is hard is used, it is difficult to scrape with the cleaning blade. The discharge product generated during discharge adheres to the surface of the photoreceptor and particularly the discharge product becomes hard to remove from the surface of the photoreceptor. Because image flow is induced when the discharge product absorbs humidity, the discharge product needs to be removed completely.

Thus, conventionally, techniques of bringing a fiber body having plural fibers into a contact with the surface of the photoreceptor so as to remove the discharge product with the fiber body have been proposed (see JP-A Nos. 2002-244522, 1-161279 and 5-107993).

Because the blade system is a method of scraping the surface of the photoreceptor mechanically by pressing the front edge of the cleaning blade against the surface of the photoreceptor, if cleaning is executed for a long term, the front edge is worn or damaged or the surface of the photoreceptor suffers from flaws. Particularly, in recent years when toner particles having a small diameter and a shape approximate to a real sphere have been used to meet a demand for high quality picture, the toner particles pass the cleaning blade easily and a pressure of the front edge to the surface of the photoreceptor needs to be increased, thereby accelerating such a problem about the deterioration of the front edge and damage on the surface of the photoreceptor. In this blade system, the toner particles having a small diameter and additive added to the toner particles pass between the surface of the photoreceptor and the front edge of the cleaning blade, thereby substituting for lubricant. Particularly, when a large amount of prints are made and a non-image portion is kept for long hours in a high-speed machine, lubrication is hampered because no toner particle or additive is supplied to the front edge, deterioration of the front edge is accelerated remarkably thereby inducing a drop in cleaning performance.

On the other hand, the brush type has a weaker mechanical scraping performance to the photoreceptor surface than the blade type and consequently, suffers from a small deterioration in cleaning performance with a time passage. The brush type is more advantageous for particularly high-speed machine than the blade type. The brush type makes toner particles attracted by brush fibers (feathers) using electric field positively and further, the brush type is more advantageous in viewpoints of cleaning performance for toner particles having a small diameter and a shape similar to real sphere than the blade type which mechanically scrapes. Because residual toner particles having both polarities exist on the photoreceptor surface after transfer to a predetermined transfer object surface is completed, a technique using two brushes supplied with voltages having different polarities has been proposed. However, another technique has been also proposed which changes polarities of the residual toner particles having both polarities to any one polarity so as to attract the residual toner particles with a single brush supplied with a voltage having an opposite polarity, because the former technique induces enlargement of an apparatus (see, for example JP-A Nos. 63-15278, 2004-239999, 2001-109351 and 2001-3413).

By the way, discharge product generated by charge adheres to the photoreceptor surface and if the discharge product adhering to the photoreceptor surface absorbs moisture, image flow is induced. Thus, the discharge product needs to be removed sufficiently. However, the discharge product cannot be attracted by the brush fibers using electric field different from the toner particles and further, because the brush type provides the weaker mechanical scraping performance as described above, the discharge product cannot be removed sufficiently.

Accordingly, conventionally, a technique has been proposed in which a fiber body having multiple fibers is brought into contact with the photoreceptor surface so as to remove the discharge product by the fiber body (see JP-A No. 2002-244522).

The above mentioned Japanese Patent Application Laid-Open (JP-A) No. 2002-244522 describes a structure which brings the fiber body into contact with the photoreceptor surface in the upstream in the cyclic moving direction of the photoreceptor surface with respect to the cleaning blade by using the cleaning blade and fiber body at the same time. By utilizing the technique disclosed in JP-A No. 2002-244522, it is conceivable to remove the discharge product from the photoreceptor surface by rubbing between the fibers holding the toner particles and the photoreceptor surface while the residual toner particles and additive particles are captured and held by the fibers. However, the residual toner particles and additive particles easy to catch by the fibers have a so small a diameter that the particles having such a small diameter which can substitute for lubricant between the photoreceptor surface and the front edge portion of the cleaning blade are captured by the fibers and consequently, can be short between the photoreceptor surface and front edge portion. If the particles having the small diameter which can substitute for lubricant are short, abrasion and chipping are likely to occur in the blade, so that a favorable cleaning in long periods by the cleaning blade is disabled.

The present invention has been made in view of the above circumstances and provides a cleaning unit in which generation of abrasion and chipping in the cleaning blade is suppressed while adhering substance such as discharge product is removed sufficiently and an image forming apparatus including the cleaning unit.

The techniques disclosed in JP-A Nos. 2002-244522, 1-161279, and 5-107993 have proposed a method of scraping fine residues from the photoreceptor by means of the fiber body and any technique has a such a problem that the scraping performance of the fiber body becomes uneven in the extension direction of the center axis of the photoreceptor. If the fiber body is pressed against the photoreceptor strongly in order to raise the scraping performance by the fiber body, mechanical stress to the photoreceptor is raised and even the photoreceptor having a hard surface suffers from excessive abrasion and flaws thereby accelerating deterioration of the fiber body. Particularly, the techniques disclosed in the JP-A Nos. 2002-244522 and 1-161279 are techniques in which the fiber body is disposed in the downstream in the cyclic moving direction of the photoreceptor surface with respect to the cleaning means and include a fear that the scraping performance by the fiber body is insufficient. Thus, a necessity of pressing the fiber body against the photoreceptor strongly occurs so that the photoreceptor surface is likely to be worn or damaged excessively or the fiber body itself is deteriorated easily. Even if the fine residues are scraped by pressing the fiber body against the photoreceptor surface strongly, the fibers are likely to be saturated with the scraped substances and it is difficult to maintain an excellent scraping performance in long periods.

The present invention has been made in view of the above circumstances and provides a cleaning unit capable of removing fine residues such as discharge product and additives from the photoreceptor surface uniformly and sufficiently in the extension direction of the center axis of the photoreceptor and an image forming apparatus including the cleaning unit.

The technique described in JP-A No. 2002-244522 relates to an technique aiming at scraping the discharge product with the fiber body by rubbing the photoreceptor surface with the fiber body in the upstream in the rotation direction of the photoreceptor with respect to the brush and the residual toner particles adjusted to one polarity by the techniques described in JP-A Nos. 63-15278, 2004-239999, 2001-109351, and 2001-3413 change into a charging condition having an opposite polarity by frictional electrification when they pass the fiber body, so that there is a fear that cleaning of the residual toner particles by the brush may fail.

Accordingly, the present invention has been made in view of the above circumstances and provides a cleaning unit capable of maintaining the cleaning performance for the residual toner particles at a high level while the discharge product is removed sufficiently and an image forming apparatus including the cleaning unit.

SUMMARY OF THE INVENTION

According to a first aspect of the present invention, there is provided a cleaning unit that removes residues left on the surface of an photoreceptor after a toner image is transferred to an image transferring object surface, the photoreceptor carrying the toner image to a predetermined transfer area by moving the surface of the photoreceptor cyclically while carrying the toner image intended to be transferred to the image transferring object surface in the predetermined transfer area, including: a cleaning blade that keeps a front end thereof made of rubber material in contact with the surface with a pressure so as to scrape residual toner left on the surface after the toner image is transferred to the image transferring object surface, of the photoreceptor; and fiber body having multiple fibers in contact with the surface after the toner image is transferred to the image transferring object surface of the photoreceptor in the upstream in the cyclic moving direction of the surface of the photoreceptor with respect to the cleaning blade, wherein the cleaning blade satisfies $A \geqq -2.5 \times B + 102$: formula (1) $6.3 \leqq B \leqq 19.6$: formula (2) where in the above formula (1), A designates a contact angle (°) with pure water under 23° C., 55% RH and B designates 100% modulus (MPa) at 23° C.

The photoreceptor mentioned here may be a photoreceptor in which an electrostatic latent image is formed by receiving exposure light after charged equally or an intermediate transfer body in which the toner image is transferred from the photoreceptor as a primary transfer and discharge by peeling occurs at the time of secondary transfer to the recording medium. That is, the cleaning unit of the present invention may be used as a cleaning unit for the photoreceptor surface or a cleaning unit for the intermediate transfer body surface.

In the cleaning unit according to the first aspect of the present invention, residual toner and additive particles (hereinafter referred to as residual toner component) are captured by fibers of the fiber body and held by the fibers. Adhering substance such as discharge product adhering to the photoreceptor surface is scraped from the photoreceptor surface by the residual toner component held by the fibers of the fiber body. The scraped residue in this way adheres to the residual toner component captured by the fibers. Here, the residual toner component captured by the fibers is replaced with residual toner component which is newly carried to the fiber body, existing on the surface of the photoreceptor and returned to the surface of the photoreceptor. The residual toner component returned to the photoreceptor surface is moved to the cleaning blade located in the down stream because the photoreceptor surface moves cyclically and is removed from the photoreceptor surface by the cleaning blade. Although in the cleaning unit of the present invention, the residual toner component is supplied to the cleaning blade also, particles having a small diameter which function as lubricant by passing between the front end of the blade and the surface of the image carrying because the residual toner component is captured by fibers of the fiber body are likely to be short. By making a contact angle with water at the front end of the cleaning blade larger than conventionally, adhesion force between the photoreceptor and the cleaning blade drops so that friction decreases thereby preventing abrasion and chipping from occurring in the cleaning blade. In the meantime, the contact angle with water at the front end of the cleaning blade is considered to be a factor which is related to adhesion force between the photoreceptor and the cleaning blade and actually by increasing the contact angle with water, friction resistance between the photoreceptor and the cleaning blade is reduced. Further, by increasing the 100% modulus, deformation of the blade front end is suppressed so that the change of the contact area with the photoreceptor is reduced thereby suppressing rise of friction resistance. Consequently, generation of abrasion and chipping in the cleaning blade is suppressed from this point of view also.

Therefore, damage of the blade is extremely small and abrasion of the edge is uniform because adhering substance such as discharge product is removed and no excessive stress is applied to the blade. Further even if spherical toner difficult to clean is used, the cleaning performance can be improved by suppressing deformation of the blade front end. Even if the spherical toner is used, the contact pressure of the cleaning blade can be set low thereby suppressing damage of the photoreceptor and blade preferably to lead to achievement of longer service life.

The reason why the reduction effect of the friction resistance in the cleaning blade cannot be explained with only the rubber hardness and expressing it with the 100% modulus meets an actual purpose can be estimated as follows. The rubber material of the blade generally used in electronic picture indicates a complicated relation of "stress-distortion" if considering up to high deformation range. The amount of deformation of the blade front end portion during running is estimated to be several hundreds μm to several mm from measurement of distortion condition of the blade front end portion with a distortion gauge and observation of nipping. However, the measurement of hardness cannot meet an actual condition because it indicates a behavior in a fine deformation area. Contrary to this, the 100% modulus meets the behavior in intermediate to large deformation area and indicates an excellent correlation with a measurement value of a deformation amount of the blade front end in actual running.

In the cleaning unit of the present invention, preferably, the fibers each have a size of 10 μm or less.

Consequently, a surface in contact with the photoreceptor of the fiber body is in porous state so that the photoreceptor surface is rubbed by this porous face. As a result, residual toner component is held stably by multiple fibers each having a size of 10 μm or less and discharge product is removed from the photoreceptor surface uniformly and sufficiently in the extension direction of the center axis of the photoreceptor in long periods. Additionally, the fiber body is preferred to have a width of 1.5 mm or more in the cyclic moving direction of the photoreceptor surface.

According to the first aspect of the present invention, there is provided also an image forming apparatus that forms an electrostatic latent image on the photoreceptor surface by charging the surface of the photoreceptor moving cyclically in a predetermined direction around the center axis and irradiating the surface of the photoreceptor after charged with exposure light so as to obtain a toner image on the surface of the photoreceptor by developing the electrostatic latent image with toner and forms an image composed of fixed toner image on a recording medium by fixing the toner image to a predetermined image transferring object surface and finally fixing to the recording medium, including: a cleaning blade that keeps a front end thereof made of rubber material in contact with the surface with a pressure so as to scrape the residual toner left on the surface after the toner image is transferred to the image transferring object surface, of the photoreceptor;

a fiber body having multiple fibers in contact with the surface after the toner image is transferred to the image transferring object surface of the photoreceptor in the upstream in the cyclic moving direction of the surface of the photoreceptor with respect to the cleaning blade, wherein the cleaning blade satisfies $A \geqq -2.5 \times B + 102$: formula (1) $6.3 \leqq B \leqq 19.6$: formula (2) where in the above formula (1), A designates a contact angle (°) with pure water under 23° C., 55% RH and B designates 100% modulus (MPa) at 23° C.

The image transferring object surface mentioned here may be a surface in contact with the photoreceptor surface of the intermediate transfer body or a recording surface of a recording medium.

Because the image forming apparatus of the first aspect includes a cleaning unit of the present invention, abrasion and chipping of the cleaning blade disposed in the downstream of the fiber body are suppressed.

In the image forming apparatus of the first aspect of the invention, preferably, the fiber body is so constructed freely rotatably that the peripheral surface of a roll-like elastic body having a rotation axis extending in parallel to the center axis is covered with multiple fibers and a portion in contact with the photoreceptor surface moves with a difference in speed with respect to the photoreceptor surface in the same direction as the cyclic moving direction of the photoreceptor surface.

In this way, the roll-like fine fiber fabric is used as the fiber body and discharge product is removed by rotating it with a difference in speed in the same direction as and with respect to the photoreceptor and appropriate residual toner component can be carried to the cleaning blade.

Further in the image forming apparatus of the first aspect of the invention, preferably, the fiber body includes multiple fibers subjected to conductivity treatment and a bias applying unit that applies multiple biases different in voltage level is provided between the photoreceptor and the multiple fibers.

Consequently, supply of the residual toner component to the cleaning blade can be controlled by holding and discharging the residual toner component with the fiber body.

According to a second aspect of the present invention, there is provided a cleaning unit that removes residues left on the surface of an photoreceptor after a toner image is transferred to an image transferring object surface, the photoreceptor carrying the toner image to a predetermined transfer area by moving the surface of the photoreceptor around a center axis while carrying the toner image intended to be transferred to the image transferring object surface in the predetermined transfer area, including: a cleaning section that removes residual toner left on the surface after a toner image is transferred to the image transferring object surface from the surface, of the photoreceptor; a fiber body having multiple fibers in contact with the surface after the toner image is transferred to the image transferring object surface of the photoreceptor in the upstream in the cyclic moving direction of the photoreceptor surface with respect to the cleaning section; and a reciprocating mechanism that reciprocates the fiber body and the photoreceptor surface relatively in an extension direction of the center axis.

The photoreceptor mentioned here may be a photoreceptor in which an electrostatic latent image is formed by receiving exposure light after charged equally or an intermediate transfer body in which the toner image is transferred from the photoreceptor as a primary transfer and discharge by peeling occurs at the time of secondary transfer to the recording medium. That is, the cleaning unit of the present invention may be used as a cleaning unit for the photoreceptor surface or a cleaning unit for the intermediate transfer body surface.

Because in the cleaning unit of the second aspect of the invention, the fiber body is disposed in the upstream of the cleaning means for removing the residual toner, the residual toner and additive particles if the additive is added to the toner are carried to the fiber body when the photoreceptor surface moves cyclically. Residual toner and additive particles (hereinafter referred to as residual toner component) are captured by fibers of the fiber body and held by the fibers. Adhering substance such as discharge product adhering to the photoreceptor surface is scraped from the photoreceptor surface by the residual toner component held by the fibers of the fiber body. The scraped residue in this way adheres to the residual toner component captured by the fibers. Here, the residual toner component captured by the fibers is replaced with residual toner component which is newly carried to the fiber body, existing on the surface of the photoreceptor and returned to the surface of the photoreceptor. The residual toner component returned to the photoreceptor surface is moved to the cleaning means located in the downstream because the photoreceptor surface moves cyclically and is removed from the photoreceptor surface by the cleaning means. That is, the residual toner component captured by the fiber body and having adhering residues is removed from the photoreceptor surface by the cleaning means finally. Because the cleaning unit of the present invention replaces the residual toner component captured by the fibers of the fiber body, saturation of the scraped substance in the fibers is suppressed. Further, due to provision of the reciprocating mechanism, the scraping performance of the fiber body is raised without pressing the fiber body against the photoreceptor surface by a relative reciprocation between the fiber body and the photoreceptor surface, thereby removing fine residues sufficiently. Further, the scraping performance of the fiber body is prevented from being unequal in the extension direction of the center axis of the photoreceptor. Therefore, the cleaning unit of the present invention is capable of removing the fine residues from the photoreceptor surface uniformly and sufficiently in the extension direction of the center axis of the photoreceptor in long periods.

According to the second aspect of the present invention, there is provided also an image forming apparatus that forms an electrostatic latent image on the photoreceptor surface by charging the surface of the photoreceptor moving cyclically in a predetermined direction around the center axis with a charger and irradiating the surface of the photoreceptor after charged with exposure light so as to obtain an electrostatic latent image on the surface of the photoreceptor and forms an image composed of fixed toner image on a recording medium by transferring the toner image formed on the surface of the photoreceptor based on toner image formation cycle of forming the toner image on the surface of the photoreceptor by developing the electrostatic latent image with toner and finally fixing to the recording medium, including: a cleaning unit that removes residual toner left on the surface after a toner image is transferred to the image transferring object surface from the surface, of the photoreceptor; a fiber body having multiple fibers in contact with the surface after the toner image is transferred to the image transferring object surface of the photoreceptor in the upstream in the cyclic moving direction of the photoreceptor surface with respect to the cleaning unit; and a reciprocating mechanism that reciprocates the fiber body and the photoreceptor surface relatively in an extension direction of the center axis.

The image transferring object surface mentioned here may be a surface in contact with the photoreceptor surface of the intermediate transfer body or a recording surface of a recording medium.

Because the image forming apparatus of the second aspect of the invention includes the cleaning unit of the invention, fine residues such as discharge product and additives can be removed from the photoreceptor surface uniformly and sufficiently in the extension direction of the center axis of the photoreceptor.

In the image forming apparatus of the second aspect of the invention, preferably, the fiber body has multiple fibers each having a size of 10 μm or less and a width of 1.5 mm or more in the cyclic moving direction of the photoreceptor surface.

Consequently, a surface in contact with the photoreceptor surface of the fiber body is in porous state so that the photoreceptor surface is rubbed by this porous surface during a reciprocation. As a result, residual toner component is held stably by multiple fibers each having a size of 10 μm or less and discharge product is removed from the photoreceptor surface uniformly and sufficiently in the extension direction of the center axis of the photoreceptor in long periods.

In the image forming apparatus of the present invention, preferably, the reciprocating mechanism reciprocates the fiber body and the photoreceptor surface relatively while avoiding an interval in which the toner image formation cycle is executed.

Consequently, an influence upon toner image formation of the relative reciprocation between the fiber body and the photoreceptor surface is suppressed.

Further, preferably, the image forming apparatus of the second aspect of the invention includes a control portion which controls the speed of the relative reciprocation between the fiber body and the photoreceptor surface by the reciprocating mechanism and the control portion which controls the amplitude of the relative reciprocation between the fiber body and the photoreceptor surface by the reciprocating mechanism.

Provision of any of the control portions described above adjusts the scraping performance of the fiber body and suppresses excessive abrasion and flaws which may be generated in the photoreceptor surface due to excessive scraping and deterioration of the fiber body itself. That is, because the control portion reduces the speed of the reciprocation and the amplitude of the reciprocation, the excessive scraping is suppressed. On the contrary, if a high scraping performance is required, the control portion raises the speed of the reciprocation or the amplitude of the reciprocation.

Preferably, the image forming apparatus of the second aspect of the invention includes a control portion which stops charging action of the charger when the relative reciprocation between the fiber body and the photoreceptor surface is carried out by the reciprocating mechanism.

Because the charger is a generation source of the discharge product, this embodiment allows the residual percentage of the discharge product on the surface after passing the cleaning unit drops further.

Preferably, the image forming apparatus of the second aspect of the invention includes: an environment detection sensor that detects humidity or temperature in the image forming apparatus or humidity and temperature therein.; and a control portion that determines whether any of absolute water quantity in the image forming apparatus calculated by using a detection result of the environment detection sensor, a temperature based on the detection result of the environment detection sensor and humidity based on the detection result of the environment detection sensor is over a predetermined value and if it is over that value, raises the speed of a relative reciprocation between the fiber body and photoreceptor by the reciprocating mechanism, or increases the amplitude or increases the speed and amplitude.

Image flow originating from the discharge product is likely to occur under a high humidity condition and a high scraping performance is needed under the high humidity condition. Electrostatic adhesion force contributes to holding of the residual toner by the fibers of the fiber body and the scraping performance of the fiber body is inclined to drop because the electrostatic adhesion force drops under the high temperature/high humidity condition. Thus, the control portion detects that the scraping performance of the fiber body needs to be raised and takes a corresponding measure by using the absolute water quantity, a temperature based on a detection result or a humidity based on the detection result as a parameter.

On the other hand, the electrostatic adhesion force increases under the low temperature/low humidity and if the multiple fibers are held by the elastic body, its elastic modulus rises so that the scraping performance of the fiber body becomes excessive. Thus, it is permissible to make the control portion detect that the scraping performance of the fiber body needs to be reduced by using any parameter described above and take a corresponding measure.

Consequently, even if the image forming apparatus of the second aspect of the invention is used under any environment, it can maintain a high image quality in long periods and secure a long service life of the photoreceptor and fiber body.

In the meantime, the control portion may have a table for both the temperature and humidity and control the speed and amplitude based on a predetermined combination of the conditions.

In the image forming apparatus of the second aspect of the invention, preferably, the photoreceptor includes protective layer that includes resin containing a structure unit having charge transportation capacity and cross-link structure.

Because the photoreceptor includes the protective layer, the photoreceptor surface is protected from abrasion or flaw by the rubbing by the reciprocation of the fiber body and a long service life of the photoreceptor is secured.

According to a third aspect of the present invention, there is provided a cleaning unit that removes residues left on the surface of an photoreceptor after a toner image is transferred to an image transferring object surface, the photoreceptor carrying the toner image to a transfer area for transferring the toner image to the image transferring object surface by moving the surface of the photoreceptor cyclically while carrying the toner image composed of toner having a predetermined charging polarity, including: a cleaning brush that has feathers extending radiantly from a rotation axis parallel to the center axis and supplied with a voltage having an opposite polarity to the charging polarity of the toner and rubs the surface after the toner image is transferred to the image transferring object surface of the photoreceptor with the feathers when it rotates around the rotation axis; fiber body having multiple fibers having a size of 10 μm or less in contact with the surface after the toner image is transferred to the image transferring object surface, of the photoreceptor, located in the upstream in the cyclic moving direction of the photoreceptor surface with respect to the cleaning brush; and a voltage applying section that applies a voltage having the same polarity as the charging polarity of the toner to the multiple fibers.

The photoreceptor mentioned here may be a photoreceptor in which an electrostatic latent image is formed by receiving exposure light after charged equally or an intermediate transfer body in which the toner image is transferred from the photoreceptor as a primary transfer and discharge by peeling occurs at the time of secondary transfer to the recording medium. That is, the cleaning unit of the present invention may be used as a cleaning unit for the photoreceptor surface or a cleaning unit for the intermediate transfer body surface.

In the cleaning unit of the third aspect of the invention, the residual toner particles are captured by the fibers of the fiber body and maintained by the fibers. Because the size of the fiber of the fiber body is 10 μm or less, the surface in contact with the photoreceptor surface of the fiber body is in porous state and the photoreceptor surface is rubbed by this porous surface. As a result, the residual toner particles are held stably by the multiple fibers each having a size of 10 μm or less and the discharge product adhering to the photoreceptor surface is scraped sufficiently by the residual toner particles held by the fibers of the fiber body. The scraped residues adhere to the residual toner particles captured by the fibers.

Because the fibers of the fiber body are supplied with a voltage having the same polarity as the charging polarity of the toner by the voltage applying section, the residual toner particles captured by the fibers are supplied with charge. The residual toner particles captured by the fibers are replaced with residual toner particles which are newly carried to the fiber body and exist on the surface of the photoreceptor and returned to the photoreceptor surface. Thus, the residual toner particles after returned to the photoreceptor surface are in a state easy to attract electrostatically by the feathers. Some residual toner particles pass the fiber body without being captured by the fibers of the fiber body and the residual toner particles passing the fiber body are also supplied with charge so that the residual toner particles passing the fiber body are in a state easy to attract electrostatically by the feathers.

Considering that the cleaning brush suffers from a small deterioration of cleaning performance with a time passage, the cleaning unit of the third aspect of the invention is capable of maintaining the cleaning performance of the residual toner particles at a high level in long periods while removing the discharge product sufficiently.

In the cleaning unit of the third aspect of the invention, preferably, the fiber body has multiple conductive fibers.

In the cleaning unit of the third aspect of the invention, preferably, the fiber body is a fabric composed of multiple fibers which is pressed against the photoreceptor surface with a predetermined pressure by a pressing member having elasticity.

Consequently, the discharge product can be scraped sufficiently from the photoreceptor surface.

The fiber body may be a fixed brush composed of multiple fibers each having a size of 10 μm or less bound together or a fixed brush composed of multiple fibers each having a size of less than 8.5 μm (about 1 denier) bound together.

According to the third aspect of the present invention, there is provided also an image forming apparatus that forms an electrostatic latent image on the photoreceptor surface by charging the surface of the photoreceptor rotating in a predetermined direction around the center axis and irradiating the surface of the photoreceptor after charged with exposure light so as to obtain a toner image on the surface of the photoreceptor by developing the electrostatic latent image with toner having a predetermined charging polarity and forms an image composed of fixed toner image on a recording medium by transferring the toner image to a predetermined image transferring object surface and finally fixing to the recording medium, including: a cleaning brush that has feathers extending radiantly from a rotation axis parallel to the center axis and supplied with a voltage having an opposite polarity to the charging polarity of the toner and rubs the surface after the toner image is transferred to the image transferring object surface of the photoreceptor with the feathers when it rotates around the rotation axis; fiber body having multiple fibers having a size of 10 μm or less in contact with the surface after the toner image is transferred to the image transferring object surface, of the photoreceptor, located in the upstream in the rotation direction of the photoreceptor with respect to the cleaning brush; and a voltage applying section that applies a voltage having the same polarity as the charging polarity of the toner to the multiple fibers.

The image transferring object surface mentioned here may be a surface in contact with the photoreceptor surface of the intermediate transfer body or a recording surface of a recording medium.

Because the image forming apparatus of the third aspect of the invention includes a cleaning unit of the third aspect of the invention, the cleaning performance of the residual toner particles is maintained at a high level while the discharge product is removed sufficiently.

In the image forming apparatus of the third aspect of the invention, preferably, the photoreceptor includes protective layer that includes resin containing a structure unit having charge transportation capacity and cross-link structure. As resin which contains a structure unit having the charge transportation capacity and cross-link structure, for example, phenol base resin or siloxane base resin containing a structure unit having charge transportation capacity composed of at least one selected from hydroxyl group, carboxyl group, alkoxysilyl group, epoxy group, thiol group and amino group can be mentioned.

Because the photoreceptor includes the protective layer, the photoreceptor surface is protected from abrasion or flaw by the fiber body or from a streak-like flaw by rubbing with the cleaning brush and a long service life of the photoreceptor is secured.

The first aspect of the present invention provides the cleaning unit in which the cleaning blade disposed in the downstream of the fiber body is blocked from abrasion and chipping and the image forming apparatus including the cleaning unit.

The second aspect of the present invention provides the cleaning unit capable of removing fine residues such as discharge product and additives uniformly and sufficiently in the extension direction of the center axis of the photoreceptor from the photoreceptor surface and the image forming apparatus including the cleaning unit.

The third aspect of the present invention provides the cleaning unit capable of maintaining the cleaning performance of the residual toner particles at a high level in long periods while removing discharge product sufficiently and the image forming apparatus including the cleaning unit.

BRIEF DESCRIPTION OF THE DRAWINGS

Preferred embodiments of the present invention will be described in detail based on the following figures, wherein.

DETAILED DESCRIPTION OF THE INVENTION

Hereinafter embodiments of the present invention will be described with reference to the accompanying drawings.

First, a cleaning unit and an image forming apparatus of a first embodiment of the present invention will be described.

Figure 1:
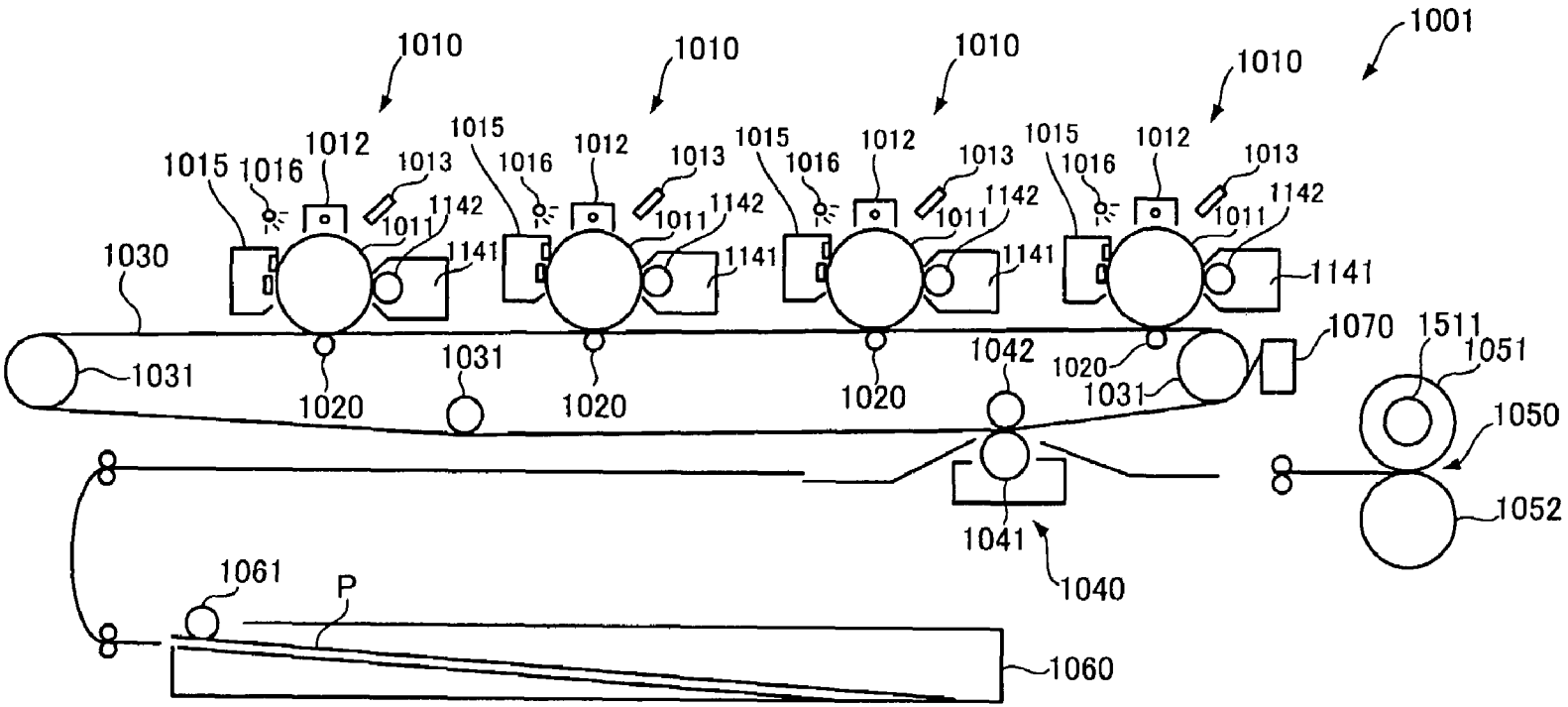
FIG. 1 is a diagram showing the schematic structure of an image forming apparatus according to a first embodiment of the present invention.

FIG. 1 is a diagram showing the schematic structure of an image forming apparatus according to the first embodiment of the present invention.

The image forming apparatus 1001 shown in FIG. 1 is an image forming apparatus employing full-color tandem system, in which toner images of respective colors are formed in each toner image forming unit synchronously with feeding of an intermediate transfer belt using four toner image forming units corresponding to four toners, yellow, magenta, cyan and black, those toner images are transferred to an intermediate transfer belt as an intermediate medium (primary transfer)

and then, the toner images on the intermediate transfer belt are transferred to a paper as a recording medium (secondary transfer) and fixed thereto.

The image forming apparatus 1001 shown in FIG. 1 includes four toner image forming units 1010, four primary transfer rolls 1020, a semi-conductive intermediate transfer belt 1030 which moves cyclically in a counterclockwise direction supported by three supporting rolls 1031, a batch transfer unit 1040 which executes secondary transfer and a fixing unit 1050 which fixes not-fixed toner image to a paper.

The four toner image forming units 1010 are arranged in the circulation direction of the intermediate transfer belt 1030 and each toner image forming unit 1010 includes a photoreceptor drum 1011 which rotates in clockwise direction. Each photoreceptor drum 1011 is formed by laying foundation layer, charge generating layer, charge transportation layer and protective layer on a cylindrical conductive supporting body. The surface of the protective layer corresponds to the surface of this photoreceptor drum 1011. The protective layer is a layer which contains compound having cross-linked structure and the photoreceptor drum 1011 shown in FIG. 1 has a very high anti-abrasion property. The surface of the photoreceptor drum 1011 is in contact with the intermediate transfer belt 1030. A primary transfer roll 1020 is disposed to sandwich the intermediate transfer belt 1030 with the photoreceptor drum 1011 in a range in which the intermediate transfer belt 1030 makes contact with the photoreceptor drum 1011 and this range is primary transfer region.

The image forming apparatus of this embodiment will be described with reference to FIGS. 1, 2.

Figure 2:
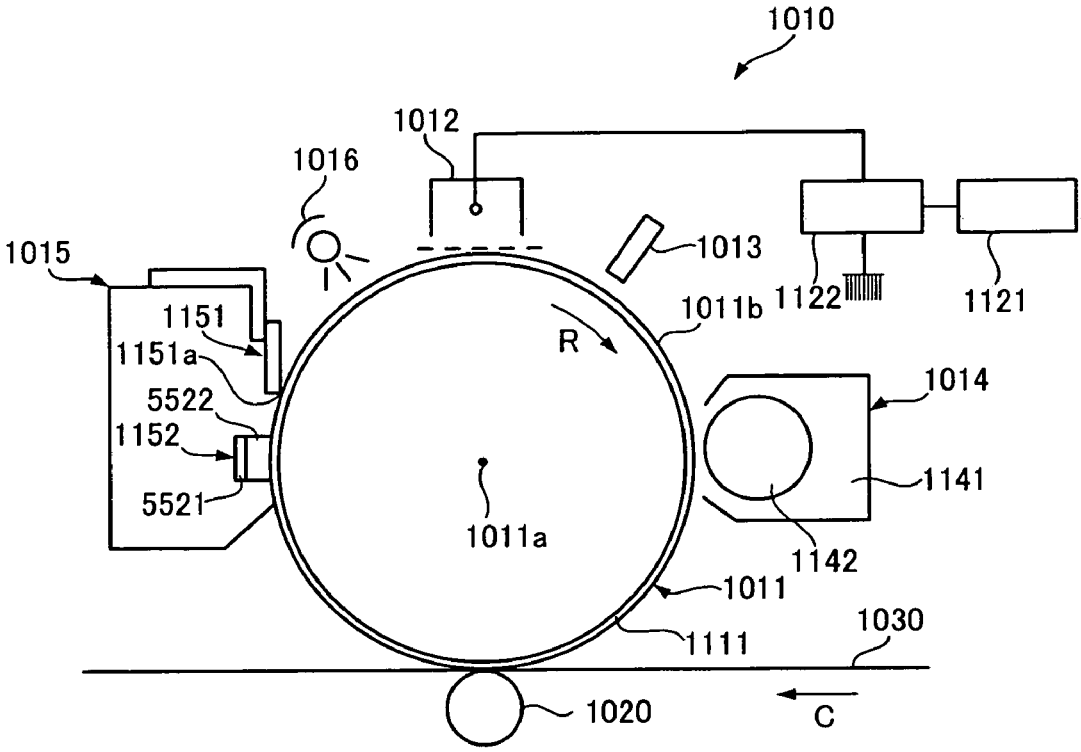
FIG. 2 is a diagram showing the schematic structure of a toner forming unit which is one of four toner image forming unit shown in FIG. 1.

FIG. 2 is a diagram showing the schematic structure of a toner image forming unit which is one of four toner image forming units shown in FIG. 1.

The toner image forming unit 1010 shown in FIG. 2 includes a charger 1012, an exposure device 1013, a developer 1014, a cleaning unit 1015 and neutralization unit 1016 as well as the photoreceptor drum 1011. FIG. 2 shows schematically the protective layer 1111 of the photoreceptor drum 1011. When the photoreceptor drum 1011 shown in FIG. 2 rotates about a rotation axis 1011*a*, the protective layer (photoreceptor surface 1011*b*) moves cyclically about the rotation axis 1011*a*. Here, description of the photoreceptor drum 1011 is omitted and the detail will be described later.

The charger 1012 is a non-contact charging type corotron charger. This charger 1012 is applied with charging bias from a charger high-voltage power supply 1122 under a control of a charger control portion 1121. As the charger, it is permissible to adopt a well known charging method such as a contact type charging roll. The exposure device 1013 irradiates laser beam based on image information to the photoreceptor surface 1011*b*. The developer 1014 includes a developing powder accommodating body 1141 accommodating developing agent containing toner particle and abrasive particle and lubricating particle which are finer than the toner particle and a developing roll 1142 which rotates opposing the surface of the photoreceptor drum 1011 with toner particles carried in the developing powder accommodating body 1141. The detail of the developing powder accommodated in the developing powder accommodating body 1141 will be described later. The toner particle is charged with a predetermined polarity within the developer 1014 and is moved electrostatically to the photoreceptor surface 1011*b*.

Here, toner image forming cycle executed in the toner image forming unit 1010 shown in FIG. 2 will be described briefly.

When the toner image forming cycle is executed by the toner image forming unit 1010 shown in FIG. 2, the photoreceptor surface 1011*b* which rotates in a direction of an arrow R is charged equally by the charger 1012. Next, laser beam is irradiated based on image information by the exposure unit 1013 so as to form electrostatic latent image on the photoreceptor surface 1011*b*. The electrostatic latent image is developed by the developer 1014 so as to form toner image on the photoreceptor surface 1011*b*. The toner image formed in this way is transferred from the photoreceptor surface 1011*b* to the surface of the intermediate transfer belt 1030 moving in the direction of an arrow C in the primary transfer region. The surface 1011*b* of the photoreceptor drum 1011 after passing the primary transfer region is neutralized by the neutralization unit 1016 after it passes a region in which the cleaning unit 1015 described later is disposed thereby terminating a sequence of the toner image forming cycle. Toner images formed by each toner image forming unit 1010 turn to a toner image by overlapping each other on the intermediate transfer belt 1030.

The batch transfer unit 1040 shown in FIG. 1 includes a secondary transfer roll 1041 disposed under a pressure on a toner image carrying face side of the intermediate transfer belt 1030 and a backup roll 1042 disposed on the rear side of the intermediate transfer belt 1030. The intermediate transfer belt 1030 is sandwiched by these two rolls 1041, 1042. These two rolls 1041, 1042 serve as secondary transfer region.

Further, the image forming apparatus 1001 shown in FIG. 1 includes a paper tray 1060 and a paper P accommodated in the paper tray 1060 is sent out from the paper tray 1060 by a feed roll 1061 and carried into the secondary transfer region at a predetermined timing. Toner images overlapping on the intermediate transfer belt 1030 are transferred to the paper P sent to the secondary transfer region. The fixing unit 1050 includes a fixing roll 1051 having a heating mechanism 1511 and a pressure roll 1052 provided opposing the fixing roll 1051. The paper P passing the secondary transfer position is carried between the fixing roll 1051 and pressure roll 1052 opposing each other. Toner constituting the toner images on the paper P is melted by the heating mechanism 1511 of the fixing roll 1051 and fixed to the paper P.

A belt cleaner 1070 is provided in the downstream of the batch transfer unit 1040 and toner left on the intermediate transfer belt 1030 is removed from the intermediate transfer belt 1030 by this belt cleaner 1070.

On the other hand, plural kinds of foreign matters such as residual toner not transferred to the surface of the intermediate transfer belt 1030 in the primary transfer region, abrasive particle and lubricating particle adhering to the residual toner and discharge product generated by charge are left on the surface 1011*b* passing the primary transfer region of the photoreceptor drum 1011 shown in FIG. 2. The cleaning unit 1015 shown in FIGS. 1, 2 is a unit for removing these plural kinds of foreign matters and disposed in the downstream of the primary transfer region in a rotation direction of the photoreceptor drum and in the upstream of the charging region in the rotation direction of the photoreceptor drum. This cleaning unit 1015 corresponds to an embodiment of the cleaning unit of the present invention and has a cleaning blade 1151 which is a plate-like rubber elastic body. The cleaning blade 1151 shown in FIG. 2 extends in the extension direction of the rotation axis 1011*a* of the photoreceptor drum 1011 with its front edge 1151*a* kept in contact with the photoreceptor surface 1011*b*. This cleaning blade 1151 scrapes residual toner particles left on the photoreceptor surface 1011*b* mechanically by rotating the photoreceptor drum 1011.

This cleaning blade 1151 satisfies following both equations:

$$A \geqq -2.5 \times B + 102 \text{equation} \quad (1)$$

$$6.3 \leqq B \leqq 19.6 \text{ equation} \quad (2)$$

where A designates contact angle (°) with pure water under 23° C. and 55% RH and B designates 100% modulus (MPa) under 23° C.

A contact angle A can be measured with a goniometer or the like. Here, pure water is dropped to the front edge 1151*a* of the cleaning blade 1151 under an environment of 23° and 55% RH and a contact angle after it is left for 10 seconds is measured with a contact angle measuring unit CA-X roll type (manufactured by Kyowa Interface Science Co., LTD.). An average of values measured five times repeatedly by changing a measurement place is defined as contact angle A.

100% modulus B indicates a stress when it is elongated 100%. Here, a value (MPa) obtained under an environment of 23° according to measurement method based on JIS K 6301 (vulcanized rubber physical test method) is defined as the 100% modulus B.

Adhesion force between the photoreceptor drum 1011 and the cleaning blade 1151 is decreased by increasing the contact angle A with water at the front edge 1151*a* of the cleaning blade 1151 thereby reducing friction and suppressing generation of wearing and chipping of the cleaning blade 1151. The contact angle of water at the front edge 1151*a* of the cleaning blade 1151 is considered to be a factor relating to the adhesion force between the photoreceptor drum 1011 and the cleaning blade 1151 and actually, friction resistance between the photoreceptor drum 1011 and the cleaning blade 1151 is decreased by intensifying the contact angle with water.

Further, by increasing the 100% modulus B, deformation of the front edge 1151*a* is suppressed so that change in contact area of the cleaning blade 1151 with the photoreceptor surface 1011*b* decreases, whereby suppressing a rise in friction resistance and consequently, generation of wearing and chipping in the cleaning blade 1151 is prevented from this point of view also.

Thus, damage of the blade is extremely small and the wearing of the front edge 1151*a* is uniform because adhering substance such as discharge product is removed and no excessive stress is applied to the cleaning blade 1151. Further, if spherical toner difficult to clean is used, its cleaning performance can be improved by suppressing deformation of the front edge 1151*a* and even if the spherical toner is used, damages of the photoreceptor drum 1011 and the cleaning blade 1151 can be suppressed preferably because the contact pressure of the cleaning blade 1151 can be set low, whereby achieving long term service life.

The reduction effect of friction resistance in the cleaning blade 1151 cannot be explained based on only rubber hardness and a reason why expression with the 100% modulus suits an actual situation is estimated as follows. Rubber material of the cleaning blade generally used for electrophotography shows a complicated relation of "stress to distortion" if considering up to its high deformation area. The amount of deformation of the blade front edge due to running is estimated to be in a range of several hundreds μm to several mm as a result of measurement of distortion condition of the blade front edge with a distortion gauge and observation of nipping. However, measurement of hardness may not coincide with actual state because it indicates a behavior in a fine deformation range. Contrary to this, the 100% modulus coincides with the behavior in an intermediate to large deformation range, indicating an excellent correlation with a measurement value of the amount of deformation of the blade front edge during running and therefore, it is estimated that the 100% modulus indicates a relation with blade abrasion in a long term.

Here, this will be described with reference to FIG. 3.

Figure 3:
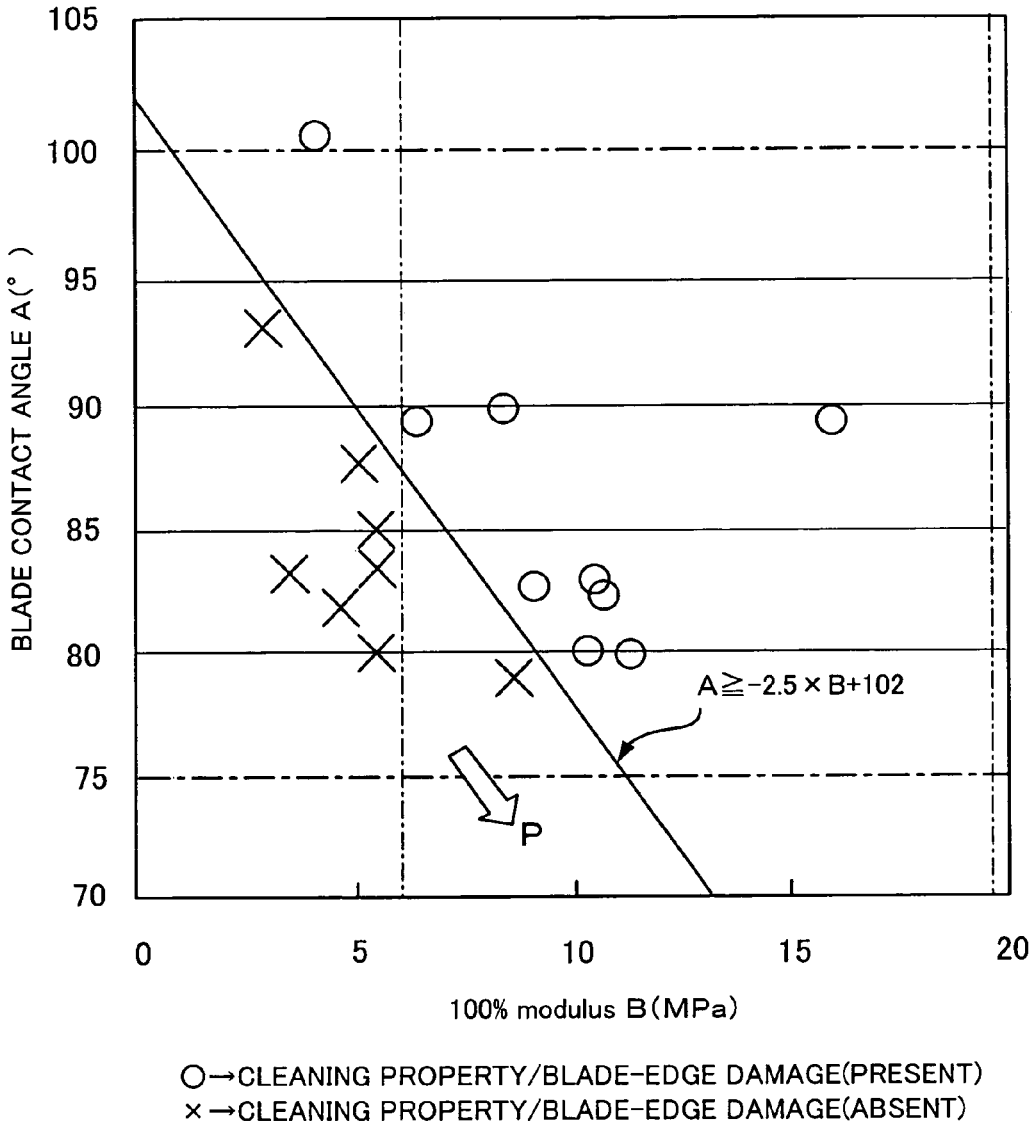
FIG. 3 is a diagram showing a relation among maintenability of cleaning performance using FUJI XEROX Co., Ltd. document center color 400, contact angle A of the cleaning blade to water and 100% modulus B.

FIG. 3 is a diagram showing a relation among maintenability of cleaning performance using document center color 400 of FUJI XEROX Co., Ltd., contact angle A of the cleaning blade with water and 100% modulus B.

In an experiment conducted here, AC voltage output value applied to a contact type charger was set higher than a setting value of original document center color 400 and an image having a low image density was carried under high temperature/high humidity condition, so that stress was accelerated beyond ordinary running. Evaluation of cleaning maintenability was conducted based on a damage of the front edge of the cleaning blade after running, observed with a microscope (laser microscope VK8500 manufactured by KIENSU Co., Ltd. and cleaning failure generated when solid images were fed continuously. A circle in FIG. 3 indicates a case where damage of the front edge of the blade and cleaning performance are preferable and a cross indicates a case where a failure occurs.

From FIG. 3, it is evident that damage of the front edge of the cleaning blade is suppressed by using a blade whose contact angle A between the 100% modulus B and water is in a specified range, whereby cleaning performance being improved.

As the kind of rubber elastic body used for the cleaning blade 1151, a well know material may be used and for example, it is permissible to use urethane rubber, silicone rubber, fluororubber, chloroprene rubber, butadiene rubber and the like. Of them, it is preferable to use polyurethane elastic body because its abrasion resistance is excellent.

Generally, by using polyurethane synthesized through additional reaction among isocynate, polyol and a variety of hydrogen contained compound as the polyurethane elastic body, polyether base polyol such as polypropylene glycol, polytetramethylene glycol and polyester base polyol such as adipate base polyol, polycaprolactone base polyol, polycarbonte base polyol as the polyol component, then, aliphatic polyisocynate such as tolylenediisocyanate, 4, 4' diphenylmethane diisocyanate, polymethylene polyphenyl polyisocynate, hexamethylene diisocynate, isophorone diisocynate, xylylenediisocynate, dicyclohexyl methanediisocynate as the polyisocynate component, urethaneprepolymer is prepared and curing agent is added to this. Then, it is poured into a specified mold and left to harden by cross link and after that, left to age under a normal temperature. As the aforementioned curing agent, usually, 1, bivalent alcohol such as 4-butanediol and multivalent alcohol higher than trivalent alcohol such as trimethylolpropane, pentaerythritol are used together.

To obtain polyurethane elastic body which satisfies both a condition indicated by the equation (1) and a condition indicated by the equation (2), polyol material, molecular weight of polyol and materials and mixture of isocyanate and cross-linker may be adjusted.

Generally although if the molecular weight of polyol is decreased, the length of molecular chain between cross-linking points decreases so that micro-Brownian motion drops thereby leading to higher modulus, the polar character is intensified so that the contact angle with water drops. Further, although higher modulus can be achieved by intensifying cross-linking density by increasing the amount of cross-linker, it is likely that the contact angle with water drops.

If explaining with reference to FIG. 3 again, a cleaning blade used at a symbol cross in FIG. 3 is equipped with a well known rubber elastic body. Because generally the molecular weight is inclined to drop if the 100% modulus is just increased by using the same material, the contact angle of water decreases. As a result, the physical property of the rubber elastic body of the cleaning blade used at the symbol cross moves in a direction of an arrow P in FIG. 3 so that it becomes different from a rubber elastic body (indicated with the symbol circle in FIG. 3) which satisfies the condition indicated in the equation (1).

Although it is difficult to adjust the modulus and contact angle into a range which satisfies the condition indicated with the above equation (1) and the condition indicated with the equation (2) by changing only the molecular weight of polyol or only adjusting the cross-linking density, the cleaning blade can be manufactured by combining the polyol material, molecular weight of polyol and material and mixture of isocyanate and cross-linker with a balance with the physical property.

The 100% modulus of the elastic body at 23° C. is in a range of 6.3 Mpa or 19.6 Mpa or less (65-200 kgf/cm$^2$) and preferably in a range of 6.3 Mpa or 14.7 MPa (65-100 kgf/cm$^2$) or less. If the 100% modulus at 23° C. is lower than 6.3 Mpa (65 kgf/cm$^2$), deformation of the front edge 1051*a* under such a stress condition of continuous running of images having a low image density at a high speed likely may not be suppressed. On the other hand, if 19.6 Mpa (200 kgf/cm$^2$) is exceeded, when a scratch flaw is generated in the photoreceptor surface 1011*b*, follow-up performance to unevenness of rubber becomes insufficient and particularly if the spherical toner is used, cleaning failure is likely to occur.

Further, the contact angle with water under 23° C. and 55% RH is preferred to be 80° to 100° while the condition indicated by the equation (1) is satisfied and more preferably, 85 to 95°. If the contact angel is lower than 80°, when the photoreceptor surface 1011*b* turns to have an extremely high abrasion due to adhesion of discharge product generated by the contact charging method, a rise in friction between the front edge 1151*a* of the cleaning blade 1151 and the photoreceptor surface 1011*b* cannot be suppressed depending on a case. Further, if the contact angle is higher than 100°, abrasion is likely to be accelerated by a drop in adhesion force among molecules of rubber.

The cleaning unit 1015 shown in FIG. 2 has a cleaning assistant member 1152. This cleaning assistant member 1152 is disposed in the upstream of the cleaning blade 1151 in a rotation direction of a photoreceptor drum. This cleaning assistant member 1152 has a holding member 5521 which extends in the extension direction of the rotation axis 1011*a* of the photoreceptor drum 1011 with plural fine fibers 5522 and corresponds to an example of fiber body according to the present invention. The plurality of the fine fibers 5522 have a thickness of 10 μm or less and make contact with the photoreceptor surface 1011*b*. A surface of the cleaning assistant member 1152 making contact with the photoreceptor surface 1110 is in a porous state due to the plural fine fibers 5522. The width of the cleaning assistant member 1152 (length in the rotation direction of the photoreceptor) is 1.5 mm or more and the fine fibers 5522 make contact in a contact width of 1.5 mm or more in the rotation direction of the photoreceptor. Because the cleaning assistant member 1152 is disposed in the upstream of the cleaning blade 1151 which removes residual toner, when the photoreceptor drum 1011 rotates, residual toner and abrasive particle and lubricating particle (hereinafter referred to as residual toner component) are carried to the cleaning assistant member 1152. The residual toner component is captured and held by the fine fibers 5522 of the cleaning assistant member 1152. Adhering substance such as discharge product adhering to the photoreceptor surface 1011*b* and deteriorated surface layer of the photoreceptor drum 1011 accompanied by discharge are scraped from the photoreceptor surface 1011*b* with residual toner component held by the fine fibers 5522. The scraped discharge product and the like adhere to the residual toner component captured by the fine fibers 5522. Although in the cleaning blade 1151, the residual toner component is likely to be removed from a contact portion (front edge 1151*a*) because the contact with the photoreceptor surface 1011*b* is linear so that polishing effect is not improved, this cleaning assistant member 1152 makes contact with the photoreceptor surface 1011*b* over a range of 1.5 mm or more in the rotation direction of the photoreceptor and further, a face making contact with the photoreceptor surface 1011*b* is formed into a porous state by the plural fiber fibers 5522 and consequently, the captured toner component is held on that surface stably thereby exerting a sufficient polishing effect. Although the residual toner component is held stably by the cleaning assistant member 1152, when new residual toner component is carried to the cleaning assistant member 1152, the residual toner component held by the cleaning assistant member 1152 is replaced with residual toner component carried newly and existing on the photoreceptor surface 1011*b*, so that part of the residual toner component held by the cleaning assistant member 1152 is returned to the photoreceptor surface 1011*b*. When the photoreceptor drum 1011 rotates, the residual toner component returned to the photoreceptor surface 1011*b* is carried to the cleaning blade 1151 in the downstream and removed from the photoreceptor surface 1011*b* by the cleaning blade 1151. Although in the cleaning unit 1015 shown in FIG. 2, residual toner component is supplied to the cleaning blade 1151, particles having a fine grain diameter which function as lubricant by passing between the front edge 1151*a* of the blade and the photoreceptor surface 1011*b* are likely to become short because the residual toner component is captured temporarily by the fine fibers 5522. However, generation of wearing and chipping in the front edge 1151*a* of the blade is suppressed because the cleaning blade 1151 satisfies both the condition indicated with the equation (1) and the condition indicated with the equation (2).

Although not shown in FIG. 2, the cleaning unit 1015 of this embodiment includes a reciprocating mechanism 1153, a control portion 1154 and an environment detection sensor 1155.

Figure 4:
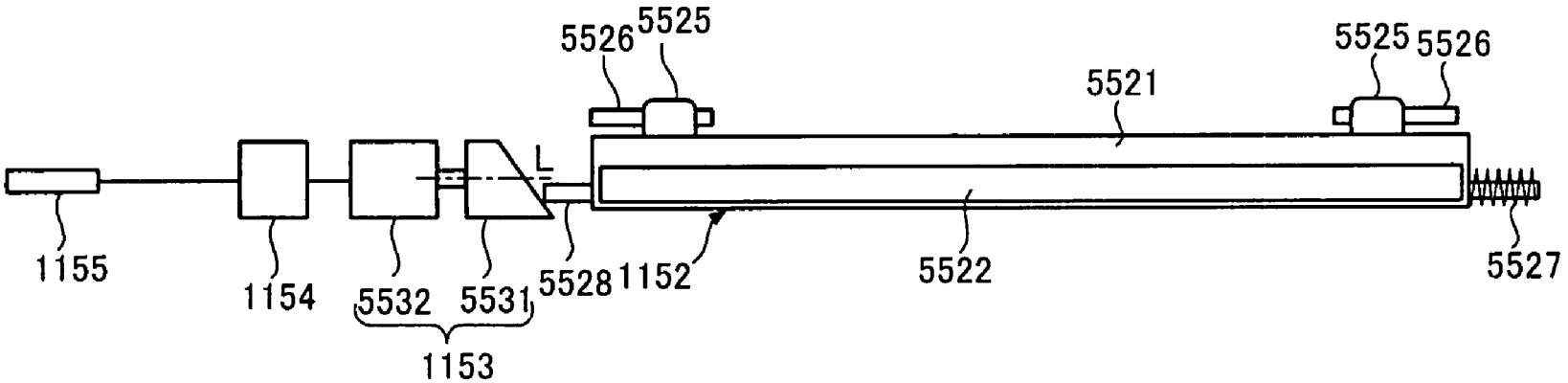
FIG. 4 is a diagram showing a reciprocating mechanism and control portion possessed by the cleaning unit of the embodiment.

FIG. 4 is a diagram showing the reciprocating mechanism and control portion of the cleaning unit of this embodiment.

FIG. 4 shows the cleaning assistant member 1152 whose extension direction is in the right and left direction in the same Figure. Both ends in the length direction (right/left direction in FIG. 4) of the holding member 5521 of the cleaning assistant member 1152 shown in FIG. 4 are fixed on guides 5525 and a guide pin 5526 is inserted into each of the guides 5525. The cleaning assistant member 1152 is capable of reciprocating freely in the length direction of the cleaning assistant member 1152, that is, in the extension direction of the rotation axis 1011*a* of the photoreceptor drum 1011 (not shown) under a guide by the guide pins 5526. Although the length in the length direction of the cleaning assistant member 1152 shown in FIG. 4 is smaller than the length of an image forming maximum range (length in the extension direction of the rotation axis 1011*a* of the photoreceptor drum) of the photoreceptor surface 1011*b*, that image forming maximum range is entirely covered in the extension direction of the rotation axis 1011*a* of the photoreceptor drum by reciprocating the cleaning assistant member 1152. In the meantime, the length in the length direction of the cleaning assistant member 1152 may be equalized with the length of the image forming maximum range of the photoreceptor surface 1011*b*. A compression spring 5527 is disposed at an end (right end in FIG. 4) of the holding member 5521 so as to urge the holding 5521 to the other end (left end in FIG. 4). A projection pin 5528 is provided at the other end of the holding member 5521.

The reciprocating mechanism 1153 is shown on the left side of FIG. 4. This reciprocating mechanism 1153 reciprocates the cleaning assistant member 1152 and includes an inclined cam 5531 and a drive motor 5532 for rotating that inclined cam 5531. The projecting end of the projection pin 5528 provided on the holding member 5521 makes contact with a position eccentric from the rotation axis L of the inclined cam 5531 on a cam face of the inclined cam 5531 by an urging force of the compression spring 5527. Thus, when the inclined cam 5531 is rotated by the drive motor 5532, the cleaning assistant member 1152 is reciprocated in the right and left direction of FIG. 4. FIG. 4 shows a cleaning assistant member 1152 in a condition in which it is moved rightmost by the cam face of the inclined cam 5531 and when the inclined cam 5531 is rotated from this condition, the cleaning assistant member 1152 is moved leftward and after that, it returns to the condition shown in FIG. 4. As a result of such a reciprocation motion, the cleaning assistant member 1152 and the photoreceptor surface 1011*b* reciprocates relatively in the extension direction of the rotation axis 1011*a* of the photoreceptor drum 1011 so that the photoreceptor surface 1011*b* is rubbed swingingly by the cleaning assistant member 1152. This rubbing with swinging intensifies the scraping performance of the cleaning assistant member without pressing the cleaning assistant member 1152 against the photoreceptor surface 1011*b* strongly, so that fine residues are removed sufficiently. Further, the scraping performance by the cleaning assistant member 1152 is prevented from being unequal in the extension direction of the rotation axis 1011*a* of the photoreceptor drum 1011. Therefore, according to this embodiment, the fine residues are removed from the photoreceptor surface 1011*b* equally and sufficiently in the extension direction of the rotation axis 1011*a* of the photoreceptor drum 1011 for a long term.

A move distance (amplitude of reciprocation) of the cleaning assistant member 1152 by the reciprocating mechanism 1153 may be in a range of 2 mm-10 mm. If the move distance is less than 2 mm, no effect is found and if it is over 10 mm, the effect remains the same and an increase of the size of the cleaning unit 10 is induced. The speed of reciprocation of the cleaning assistant member 1152 by the reciprocating mechanism 1153 may be in a range of 0.5 reciprocation to 20 reciprocations and more preferably, in a range of 1 reciprocation to 10 reciprocations. If the speed is smaller than 0.5 reciprocation, no sufficient effect is found and if it exceeds 20 reciprocations, even the cleaning assistant member 1152 which holds residual toner component stably in the fine fibers 5522 becomes incapable of holding the residual toner component due to vibration from the rubbing motion or deterioration of the fine fibers is induced. Further, if it is non-integer times in a range of 0.5 reciprocation to 20 reciprocations with respect to a single rotation of the photoreceptor drum 1011, uniformity of polishing of the photoreceptor drum 1011 can be improved. It is permissible to use a direct actuating motor instead of a combination of the inclined cam 5531 and the drive motor 5532. Although the cleaning assistant member 1152 is reciprocated by the reciprocating mechanism 1153 because of ease of control, it is permissible to reciprocate the photoreceptor drum 1011 in the extension direction of the rotation axis 1011*a* with the cleaning assistant member 1152 kept at a predetermined position or reciprocate both the cleaning assistant member 1152 and the photoreceptor drum 1011 in the extension direction with a deflection in their timings.

If the cleaning assistant member 1152 executes its reciprocation, transmission of vibration to the photoreceptor 1010 is unavoidable and if the reciprocation is executed during an execution of the toner image forming cycle, there is a fear that when laser beam is irradiated by the exposure unit 1030, the position of a spot of laser beam is deflected by vibration by the reciprocation so that distortion may occur in electrostatic latent image. Thus, the reciprocating mechanism 1153 shown in FIG. 4 executes this reciprocation while the toner image forming cycle is not executed. The period in which the toner image forming cycle is not executed includes a rise-up time after the image forming apparatus is powered on, a last cycle time of image forming job, inter-image between formation of images, following cycle time after image forming job, stop of rotation of the photoreceptor drum 1011 and a lapse of a predetermined time after the power is turned off. The reciprocation may be executed at the rise-up time after the image forming apparatus is powered on, the last cycle time of image forming job or when the rotation of the photoreceptor is stopped after the last cycle because an influence of the image forming speed is small.

The environment detecting sensor 1155 shown in FIG. 4 detects humidity and temperature within the image forming apparatus. The control portion 1154 shown in FIG. 4 stops the charging action of the charger 1012 shown in FIG. 2 while the cleaning assistant member 1152 is reciprocating. Because the charger 1012 is a generation source of the discharge product, residual percentage of discharge product on the surface 1011*b* passing the cleaning blade 1151 of the photoreceptor drum 1011 is dropped further when the control portion stops the charging action of the charger 1012. Further, the control portion 1154 controls the speed and amplitude of the reciprocation of the cleaning assistant member 1152 based on a detection result of the environment detection sensor 1155. That is, the control portion 1154 controls the rotation speed, direction and angle of the drive motor 1155. The scratch performance of the cleaning assistant member 1152 is adjusted by this control portion 1154 so that wearing and flaw which may be generated in the photoreceptor surface 1011*b* by excessive scratch and deterioration of fine fibers of the cleaning assistant member 1152 are suppressed. That is, an excessive scratch is prevented when the control portion 1154 reduces the reciprocation speed or amplitude of the reciprocation. On the contrary, when a high scratch performance is needed, the control portion 1154 raises the reciprocation speed or increases the amplitude of the reciprocation. Image flow originated from discharge product is likely to be generated under high humidity condition and a high scratch performance under a high humidity condition is needed most. Electrostatic adhesion contributes to holding of the residual toner component by the fine fibers 5522 and because the electrostatic adhesion drops under high temperature/high humidity condition, the scratch performance of the cleaning assistant member 1152 is inclined to drop. A first predetermined value which indicates that the image forming apparatus 1001 is under the high temperature/high humidity condition is set in the control portion 1154 and the control portion 1154 determines whether or not a detection result of the environment detection sensor 1155 exceeds this first predetermined value. If the detection result exceeds the first predetermined value, the rotation speed is raised by continuing a normal rotation of the drive motor 5532. Consequently, the speed of the reciprocation of the cleaning assistant member 1152 is intensified so that its amplitude reaches its maximum.

On the other hand the electrostatic adhesion increases under low temperature/low humidity and further the elasticity of the holding member 5521 rises so that the scratch performance of the cleaning assistant member 1152 is excessively intensified. A second predetermined value is set in the control portion 1154 to indicate that the inside of the image forming apparatus 1001 is under the low temperature/low humidity and the control portion 1154 determines whether or not a detection result of the environment detection sensor 1155 is below this second predetermined value. If the detection result is below the second predetermined value, the rotation of the rotation axis is inverted before the rotation axis of the drive motor 5532 rotates by a single turn to reduce the rotation speed. That is, by rotating the drive motor 5532 in the normal/reverse directions with the rotation angle of the rotation axis thereof suppressed to less than 360°, only part of the cam face of the inclined cam 5531 is used thereby reducing the amplitude of the reciprocation of the cleaning assistant member 1152. Further, by reducing the rotation speed of the drive motor 5532, the speed of the reciprocation of the cleaning assistant member 1152 is retarded.

By executing the above-described control with the control portion 1154, a high image quality can be maintained for a long term and the service lives of both the photoreceptor drum 1011 and the cleaning assistant member 1152 can be extended even if the image forming apparatus 1001 of this embodiment is used under any environment.

Although here the environment detection sensor 1155 detects both the humidity and temperature within the image forming apparatus and the control portion 1154 executes control based on both the humidity and temperature which are detection results of the environment detection sensor 1155, the environment detection sensor 1155 may detect only any one of the humidity and temperature within the image forming apparatus and the control portion 1154 may execute control based on any one parameter detected by that environment detection sensor 1155. The control portion 1154 may calculate an absolute amount of water in the image forming apparatus using a detection result of the environment detection sensor 1155 and execute the control based on that absolute amount of water. Further, the control portion 1154 may have tables for both temperature and humidity and control the speed and amplitude of reciprocation by combining preliminarily determined conditions.

The size of fiber constituting the fine fiber 5522 of the cleaning assistant member 1152 may be 1 μm or 10 μm or less and more preferably, 2 μm or 8 μm or less. If the size of the fiber exceeds 10 μm, uniform holding performance of the residual toner component drops and separation from the fine fibers or burying into the fibers of the residual toner components are likely to occur at the time of rubbing with swing, thereby reducing refresh performance of the photoreceptor due to the rubbing with swing. On the contrary, if it is 1 μm or less, the fibers are likely to be damaged due to stress by rubbing with swing. Further, if the contact width of the cleaning assistant member 1152 with the photoreceptor surface 1011*b* increases too much, the residual toner component becomes likely to be removed from the fine fibers because of mechanical stimulus at the time of the rubbing with swing. Thus, the contact width is preferred to be 10 mm or less from viewpoints of increased size of the image forming apparatus although there is no any special limitation in the upper limit of the contact width. As material of the fine fiber 5522, for example, polyester base fiber, nylon base fiber, polyamide base fiber, polyolefin base fiber, acrylic base fiber or composite fiber using resin of each synthetic fiber, semi-synthetic fiber such as acetate base fiber, regenerated fiber such as rayon and the like may be used. As a method for processing these fine fibers into a sheet-like form, a method of constituting secondary material by knitting the fibers and a method of creating cloth directly from fibers are available and in the latter method, fibers are bonded to each other or entangled with each other mechanically into the sheet-like form and this is called unwoven cloth. Although any method may be used, the unwoven cloth is more preferable in the viewpoint that the strength of the sheet and density of the fine fibers are high thereby providing an excellent flexibility and toner can be held excellently between the fibers.

The holding member 5521 may be used as a backup material for the fine fibers 5522 and the fine fibers 5522 may be bonded to the surface of the holding member 5521 such that the surface is pressed to the photoreceptor surface 1011*b* at a predetermined pressure. As the holding member 5521, foamed urethane, urethane rubber, silicone rubber and other elastic body may be used. The pressure by which the holding member 5521 presses the fine fibers 5522 to the photoreceptor surface 1011*b* may be in a range of 4.9 to 58.8 mN/mm. A more preferable range is 9.8 to 39.2 mN/mm. If the pressing pressure is lower than 4.9 mN/mm, no sufficient rubbing function can be exerted and if it is higher than 58.8 mN/mm, the fine fibers 5522 and the photoreceptor drum 1011 are deteriorated because the rubbing with the photoreceptor drum 1011 is too strong, and further, filming or the like is induced.

Subsequently, the photoreceptor which can be used for the photoreceptor drum shown in FIG. 2 will be described in detail.

Figure 5:
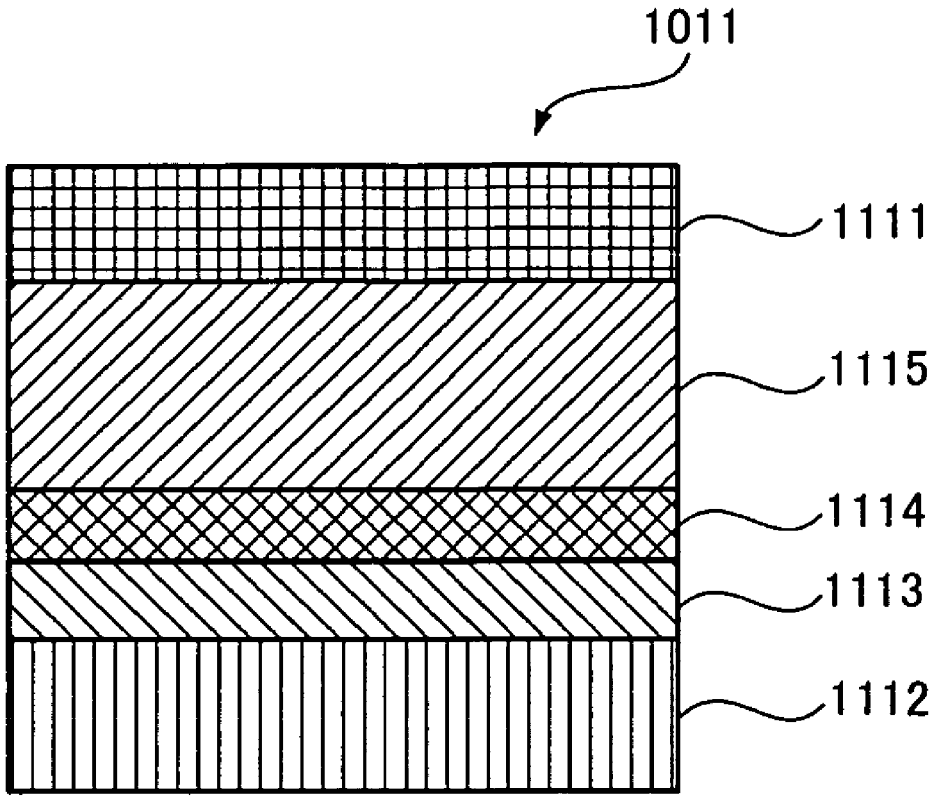
FIG. 5 is a schematic diagram showing the sectional structure of a photoreceptor drum shown in FIG. 2.

FIG. 5 is a schematic diagram showing the sectional view of the photoreceptor drum shown in FIG. 2.

FIG. 5 shows foundation layer 1113 formed on the surface of conductive supporting body 1112, charge generating layer 1114 formed on the surface of the foundation layer 1113, charge transportation layer 1115 formed on the surface of the charge generating layer 1114 and protective layer 1111.

Although as the photoreceptor of this embodiment, a variety of well known photoreceptors such as organic photoreceptor and inorganic photoreceptor, for example, amorphous silicone photoreceptor, selenium base photoreceptor may be used, organic photoreceptor having excellent advantage in cost, manufacturing property and disposability is used preferably. Further, the photoreceptor may be provided with high strength surface protective layer to secure a durability against flaws or the like in the photoreceptor surface by rubbing with swing and material for constituting the protective layer may contain resin having a structure unit having charge transportation capacity and cross-link structure.

Hereinafter, the protective layer will be described. As material which constitutes the protective layer, at least resin having the cross-link structure is used to secure a sufficient hardness for improving the abrasion resistance. Unless such material is used, flaw may be generated or abrasion is likely to make progress because the hardness of the surface is low and no sufficient abrasion resistance can be secured and if it is used under a high speed or formation of images is continued for a very long term, no high quality image can be obtained.

The protective layer may contain binder resin having no cross-link structure, conductive fine particle and lubricating fine particle composed of fluororesin or acrylic resin and upon formation of the protective layer, hard coating agent such as silicone and acrylic can be used.

Although the formation method of the protective layer will be described in detail later, uppermost surface forming solution which contains at least precursor constituting resin having the cross-link structure is used to form the protective layer. Although as the resin having the cross-link structure, a variety of materials may be used from viewpoints of securing hardness of the protective layer, it is possible to pick up phenol base resin, urethane base resin, siloxane base resin, epoxy resin and the like from viewpoints of property. Of them, the phenol base resin and siloxane base resin may be used from the viewpoint of durability. It is more preferable to use at least one selected from phenol base resin in which phenol derivative having methylol group is cross-linked and siloxane base resin having the cross-link structure.

The resin having the cross-link structure may have charge transportation property (including a structure unit having charge transportation capacity) from the viewpoint of electric property and image quality characteristic. In this case, in the photoreceptor of lamination structure type, the protective layer can function as part of the charge transportation layer. As the structure unit having the charge transportation capacity, charge transportation material having at least one selected from hydroxyl group, carboxyl group, alkoxylsilyl group, epoxy group, thiol group and amino group.

As the charge transportation material having at least one selected from hydroxyl group, carboxyl group, alkoxylsilyl group, epoxy group, thiol group and amino group, compound expressed with general formulas (I)-(V) or derivative thereof may be used because the strength and stability are excellent.

$$F\text{-}[D\text{-}Si(R^1)_{(3-a)}Q_a]_b \quad (I)$$

In the general formula (I) shown above, F designates organic group induced from compound having electron hole, D designates bivalent group having flexibility, $R^1$ designates hydrogen atom, substituted or not-substituted alkyl group (the quantity of carbons may be 1-15 and more preferably, 1-10) or substituted or not-substituted aryl group (the quantity of carbons may be 6-20 and more preferably 6-15), Q designates hydrolytic group, a designates an integer of 1-3, and b designates an integer of 1-4. The bivalent group D having the flexibility is, more specifically, a bivalent group which takes a role of connecting a portion of F for applying photoelectric characteristic with substituted silicone group contributing to construction of three-dimensional inorganic glass quality network. D designates organic group structure which supplies a portion of inorganic glass quality network which is hard but brittle with an appropriate flexibility and takes a role of improving mechanical strength as film. As a specific example of the D, bivalent hydrogen carbide expressed by —CαH2α-, —CβH2β-2-, —CγH2γ-4-(here, α indicates an integer of 1-15, β indicates an integer of 2-15, γ indicates an integer of 3-15), —COO—, —S—, —O—, —$CH_2$—, —$C_6H_4$—, —N═CH—, —($C_6H_4$)—($C_6H_4$)—, characteristic group having a structure in which these characteristic groups are combined and a group in which the composition atoms of these characteristic group are substituted by other substituted group can be mentioned. As the hydrolytic group Q, alkoxy group may be used and alkoxy group having a carbon number of 1-15 is more preferable.

$$F\text{-}[(X^1)_{n1}R^2\text{-}ZH]_{n2} \quad (II)$$

In the general formula (II) above, F designates organic group induced from a compound having electron hole transportation capacity, $X^1$ designates oxygen atom or sulfur atom, $R^2$ designates alkylene group (the quantity of carbons may be 1-15 and more preferably, 1-10), n1 designates 0 or 1, n2 designates an integer of 1-4, ZH designates hydroxyl group, thiol group, amino group or carboxyl group.

$$F—[(X^2)_{n3}—(R^3)_{n4}\text{-}(Z)_{n5}G]n6 \quad (III)$$

In the general formula (III) above, F designates organic group induced from a compound having electron hole transportation capacity, $X^2$ designates oxygen atom or sulfur atom, $R^3$ designates alkylene group (the quantity of carbons may be 1-15 and more preferably, 1-10), Z designates oxygen atom, sulfur atom, NH or COO, G designates epoxy group, n3, n4 and n5 designate 0 or 1 independently and n6 designates an integer of 1-4.

(IV)

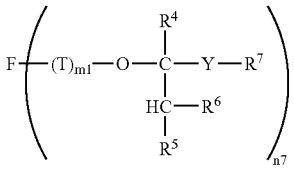

[chemical 1]

In the general formula (IV) above, F designates organic group induced from a compound having electron hole transportation capacity, Y designates oxygen atom or sulfur atom, T designates a bivalent group, $R^4$, $R^5$ and $R^6$ designate hydrogen atom or uni-valent organic group independently, $R^7$ designates a uni-valent organic group, m1 designates 0 or 1, and n7 designates an integer of 1-4. $R^6$ and $R^7$ may form heterocycle in which Y is hetero atom by combining with each other. As a specific example of T, alkylene group having a carbon number of 1 can be mentioned.

(V)

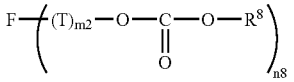

[chemical 2]

In the general formula (V) above, F designates organic group induced from a compound having electron hole transportation capacity, T designates a bivalent group, $R^8$ designates a uni-valent organic group, m2 designates 0 or 1, and n8 designates an integer of 1-4. As a specific example of T, alkylene group having a carbon number of 1 can be mentioned.

As the organic group F induced from a compound having electron hole transportation capacity in the compounds expressed by the general formulas (I)-(V), a compound expressed by the general formula (VI) below may be used.

(VI)

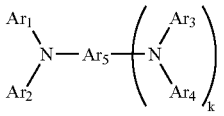

[chemical 3]

In the general formula (VI), $Ar_1$, $Ar_2$, $Ar_3$ and $Ar_4$ designate substituted or not-substituted aryl group or arylene group, and one to four of the $Ar_1$-$Ar_5$ have a coupler with a portion indicated by -D-Si $(R^1)_{(3-a)}$Qa, —$(X^1)_{n1}R^2$-ZH, —$(X^2)_{n3}$—$(R^3)_{n4}$-$(Z)_{N5}$G, -(T)m1-O—$CR^4(CHR^5R^6)$(Y—$R^7$), -$(T)_{m2}$-OCOO $R^8$ in the compound expressed by the formulas (I)-(V). k designates 0 or 1.

The protective layer may contain charge transportation material having at least one selected from phenol derivative having methylol group, hydroxyl group, carboxyl group, alkoxylsilyl group, epoxy group, thiol group and amino group.

As the phenol derivative having the methylol group, monomer of monomethylol phenols, dimethylol phenols, or trimethylol phenols or a mixture thereof, oligomerized substance, or a mixture of the monomer and oligomer can be mentioned. The phenol derivatives having methylol group can be obtained by reacting compound having phenol structure including substituted phenols containing a hydroxyl groups such as resorcin, bisphenol, phenol, cresol, xylenol, paraalkyl phenol, paraphenyl, substituted phenols containing two hydroxyl groups such as catechol, resorcinol, droquinone, bisphenols such as bisphenol A, bisphenol Z, biphenols, with formaldehyde, paraformaldehyde or the like under acid catalyst or alkali catalyst and matters marketed as phenol resin may be used. In the meantime, a relatively large molecule in which repetition of structure units of molecule is 2 to 20 is called oligomer and a molecule in which that is below that value is called monomer.

As the acid catalyst, sulfuric acid, p-toluenesulfonic acid, phosphoric acid or the like may be used. As the alkali catalyst, hydroxide of alkali metal such as NaOH, KOH, $Ca(OH)_2$ and $Ba(OH)_2$, alkali earth metal and amine base catalyst are used. Although as the amine base catalyst, ammonia, hexamethylenetetramine, trimethylamine, triethylamine, triethanolamine and the like can be picked up, it is not restricted to these compounds. If basic catalyst is used, carrier is trapped remarkably by residual catalyst thereby possibly worsening electrophotographic characteristic. For the reason, it may be neutralized with acid or inactivated by bringing into contact with absorbent like silica gel or ion-exchange resin or removed. Further, as phenol derivative having methylol group, phenol resin may be used and resol type phenol resin may be used.

Conductive particles may be added to the protective layer in order to drop residual potential. As the conductive particle, metal, metal acid, carbon black and the like can be mentioned. Of these, metal or metal acid may be used preferably. As the metal, aluminum, zinc, copper, chrome, nickel, silver, stainless, and one of these metals deposited on the surface of plastic particle can be mentioned. As the metal acid, zinc oxide, titan oxide, tin oxide, antimony oxide, indium oxide, bismuth oxide, indium oxide doped with tin, tin oxide doped with antimony or tantalum, zirconium oxide doped with antimony and the like can be mentioned. These may be used independently or in combination of two or more. If two or more are used in combination, they maybe just mixed or converted to solid solution or fusion state. The volume average particle diameter of the conductive particle may be 0.3 μm or less from the viewpoints of transparency of the protective layer and is more preferred to be 0.1 μm or less.

Further, compounds expressed by a following general formula maybe added to the protective layer to control a variety of physical properties such as strength of the protective layer and film resistance.

$$Si(R^{30})_{(4-c)}Q_c \qquad \text{(VII-1)}$$

In the above general formula (VII-1), $R^{30}$ designates hydrogen atom, alkyl group or substituted or not-substituted aryl group and Q designates hydrolytic group and c designates an integer of 1-4.

As specific examples of compound indicated by the above general formula (VII-1), following silane coupling agents can be mentioned. As the silane coupling agent, tetrafunctional alkoxysilane (c=4) such as tetramethoxysilane, tetraethoxysilane; trifunctional alkoxysilane (c=3) such as methyltrimethoxysilane, methyltriethoxysilane, ethyltrimethoxysilane, methyltrimethoxysilane, vinyltrimethoxysilane, vinyltriethoxysilane, phenyltrimethoxysilane, γ-glycydoxyprophylmethylethoxysilane, γ-glycydoxyprophyltrimethoxysilane, γ-aminoproplyltriethoxysilane, γ-aminoprophyltrimethoxysilane, γ-aminoprophylmethyldimethoxysilane, N-β(amino ethyl), γ-aminoprophyltriethoxysilane, (tridecafluoro -1,1,2,2-tetrahydrooctyl) triethoxysilane, (3,3,3-trifluoroprophyl) trimethoxysilane, 3-(heptafluoroisopropoxy) prophyltriethoxysilane, 1H, 1H, 2H, 2H-perfluoro alkylethoxysilane, 1H, 1H, 2H, 2H-perfluoro decyl triethoxysilane, 1H, 1H, 2H, 2H-perfluorooctyltriethoxysilane, difunctionalalkoxysilane (c=2) such as dimethylmethoxysilane, diphenyldimethoxysilane, methylphenydimethoxysilane, and monofunctional alkoxysilane (c=1) such as trimethylmethoxysilane can be mentioned. Trifunctional and tetrafunctional alkoxysilane may be used to improve the strength of film and monofunctional and difunctional alkoxysilane may be used to improve flexibility and film forming property.

Further, silicone base hard coating agent manufactured from mainly these coupling agents may be used. As a marketed hard coating agent, it is permissible to use KP-85, X-40-9740, X-40-2239 (above products manufactured by SHINETSU SILICONE CORP.) and AY42-440, AY42-441, AY49-208 (above products manufactured by TORAY DOW COANING Co., Ltd.) and the like.

As the protective layer, a compound having two or more silicone atoms expressed by the general formula (VII-2) may be used to intensify its strength.

$$B—(Si(R^{31})_{(3-d)}Q_d)_2 \qquad \text{(VII-2)}$$

In the above general formula (VII-2), B designates bivalent organic group, $R^{31}$ designates hydrogen atom, alkyl group or substituted or not-substituted aryl group, Q designates hydrolytic group and d designates an integer of 1-3.

The protective layer may contain ring compound having a repetitive structure unit expressed by a following general formula (VII-3) or derivative from that compound in order to extend the pot life, control the film characteristic and improve the equality of the coating film surface.

(VII-3)

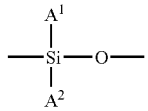

[Chemical 4]

In the above general formula (VII-3), $A^1$ and $A^2$ designate monovalent organic group independently.

As a ring compound having the repetitive structure unit expressed by the general formula (VII-3), a marketed cyclic siloxane can be mentioned. More specifically, cyclic siloxanes including ring dimethylcyclosioxane such as hexamethylcyclotrisiloxane, octamethylcyclotetrasiloxane, decamethylcyclopentasiloxane, dodecamethylcyclohexasiloxane, cyclic methylphenylcyclosiloxanes such as 1,3,5-trimethyl-1,3,5-triphenylcyclotrisiloxane, 1,3,5, 7-tetramethyl-1,3,5,7-tetraphenylcyclotetrasiloxane, 1,3,5,7,9-pentamethyl-1,3,5,7,9-pentaphenylcyclotrisiloxane, cyclic phenylcyclosiloxane such as hexaphenylcyclotrisiloxane, fluorine atom contained cyclosiloxanes such as 3-(3,3,3-trifluoropropyl) methylcyclotrisioxane, hydrosilyl group contained cyclosiloxanes such as methylhydrosiloxane mixture, pentamethylcyclopentasiloxane, phenylhydrocyclosiloxane, vinyl group contained cyclosiloxanes such as pentavinylpentamethylcycopentasiloxane can be mentioned. Although these cyclic siloxane compounds may be used singularly independently, they may be used by mixing two or more kinds.

Further, it is permissible to add a variety of fine particles to control adhesion resistance of stain of the photoreceptor surface, lubrication property, hardness and the like. Although they may be used independently, they may be used by mixing two or more kinds.

As an example of the fine particle, silicone atom containing fine particle can be picked up. The silicone atom containing fine particle refers to fine particle in which silicone is contained in composition element thereof and more specifically, colloidal silica and silicone fine particle and the like can be mentioned. The colloidal silica used as the silicone atom containing fine particle may have a volume average particle diameter of 1-100 nm, more preferably 10-30 nm and is generally selected from acidic or alkali aqueous dispersion or dispersion in organic solvent such as alcohol, ketone, ester and a generally marketed product may be used. Although the amount of solid content of colloidal silica in the protective layer is not especially limited, it may be used in a range of 0.1-50 mass %, and more preferably, in a range of 0.1-30 mass % with reference to the total amount of solid content of the protective layer from viewpoints of the film forming characteristic, electric property, and strength. The silicone fine particle used as the silicone atom containing fine particle is spherical and its volume average particle diameter is preferred to be 1-500 nm and more preferred to be 10-100 nm. A generally marketed product may be used by selecting from silicone resin particle, silicone rubber particle and silicone surface treatment silica particle.

The silicone fine particle is a small diameter particle which is chemically inactive and highly dispersible to resin and further because its content necessary for obtaining a sufficient characteristic is low, it can improve the surface characteristic of the photoreceptor without hampering the cross-link reaction. That is, it can improve lubrication property and water repellency of the photoreceptor surface in conditions in which it is fetched equally into a strong cross link structure whereby maintaining excellent abrasion resistance and adhesion resistance of stain for a long term. The content of silicone fine particle in the protective layer may be in a range of 0.1-30 mass % on a basis of the total amount of solid content of the protective layer.

As other fine particles, fluorine base fine particles such as tetrafluoroethylene, trifluoroethylene, hexafluoropropylene, vinyl fluoride, vinylidene fluoride, fine particle composed of resin in which fluorine resin and monomer having hydroxyl group as indicated in "Bulletin for the 8$^{th}$ polymer material forum seminar", and semiconductive metal oxides including $ZnO—Al_2O_3$, $SnO_2—Sb_2O_3$, $In_2O_3—SnO_2$, $ZnO—TiO_2$, $ZnO—TiO_2$, $MgO—Al_2O_3$, $FeO—TiO_2$, $TiO_2$, $SnO_2$, $In_2O_3$, ZnO, MgO can be mentioned. Further, oil such as silicone oil may be added for the same purpose.

As silicone oil, for example, silicone oil such as dimethylpolysiloxane, diphenylpolysiloxane, phenylmethylsiloxane, reactive silicone oils such as amino modified polysiloxane, epoxy modified polysiloxane, carboxyl modified polysiloxane, carbinol modified polysiloxane, metacryl modified polysiloxane, mercapto modified polysiloxane, phenol modified polysiloxane can be mentioned. These may be added preliminarily to protective layer formation coating solution or after a photoreceptor is produced, it may be impregnated under a reduced pressure or an intensified pressure. Further, it is permissible to use additives such as plasticizer, surface reforming agent, antioxidant, photo-aging resistant. The plasticizer includes biphenyl, chlorinated biphenyl, tarphenyl, dibutylphtalate, diethyleneglycolphtalate, dioctylphtalate, triphenyl phosphate, methylnaphthalane, benzophenone, chlorinatedparaffin, polypropylene, polystyrene, a variety of fluoro hydrogen carbides can be mentioned. Hindart phenol, hindart amine, thioether or antioxidant having phosphate partial structure may be added to the protective layer, thereby contributing effectively to potential stability and improvement of picture quality at the time of environment change.

Following compounds can be picked up as antioxidant. For example, as the Hindart phenol series, Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM, Sumilizer GS, which are manufactured by SUMITOMO KAGAKU, IRGANOX1010, IRGANOX1035, IRGANOX1076, IRGANOX1098, IRGANOX1135, IRGANOX1141, IRGANOX1222, IRGANOX1330, IRGANOX1425WL, IRGANOX1520L, IRGANOX245, IRGANOX259, IRGANOX3114, IRGANOX3790, IRGANOX5057, IRGANOX565, which are manufactured by CHIBA SPECIALITY CHEMICALS, ADEKASUTABAO-20, ADEKASUTABAO-30, ADEKASUTABAO-40, ADEKASUTABAO-50, ADEKASUTABAO-50, ADEKASUTABAO-60, ADEKASUTABAO-80, ADEKASUTAB-330, which are manufactured by ASAHI DANNKA can be mentioned. As the hindart amine series, SANOL LS2626, SANOL LS765, SANOLLS770, SANOLLS744, which are manufactured by SANKYO LIFETECH, CHINUBIN144, CHINUBIN622LD, MARKLA57, MARKLA67, MARK LA62, MARK LA68, MARK LA63, Sumilizer TPS can be mentioned. As the thioether series, Sumilizer TP-D can be mentoned. As the phosphate series, MARK 2112, MARK PEP8, MARK PEP24G, MARK PEP36, MARK 329K, MARK HP10 and the like can be mentioned. Particularly hindart phenol and hindart amine base antioxidant may be used. Further, these may be modified with material for forming cross-linking film and substituted group which can indicate cross-link reaction such as alkoxysilyl.

The protective layer may contain polyvinylbutyral resin, polyarylate (copolymer of bisphenol A and phthalic acid and the like), polycarbonate resin, polyester resin, phenoxy resin, vinyl chloride-vinyl acetate copolymer, polyamide resin, acrylic resin, polyacrylicamide resin, polyvinylpyridine resin, cellulose resin, urethane resin, epoxy resin, casein, polyvinyl alcohol resin, polyvinylpyrrolidone and the like. In this case, insulating resin may be added by a desired rate and consequently, coating film defects originating from adhesion with the charge transportation layer, thermal shrinkage or repellency can be suppressed.

The protective layer is formed by applying protective layer forming coating solution containing the above-mentioned composition material to the charge transportation layer and hardening it. It is preferable to add catalyst to the protective layer forming coating solution or use catalyst when producing the protective layer forming coating solution. As catalyst for use, inorganicacids such as hydrochloric acid, acetic acid, sulfuric acid, organic acid such as formic acid, propionic acid, oxalic acid, paratoluene sulfonic acid, benzoic acid, phthalic acid, maleic acid, alkaline catalyst such as potassium hydrate, sodium hydrate, calcium hydrate, ammonia, triethyleamine and the like, and solid catalyst insoluble in system may be used.

To remove catalyst used for synthesis from phenol derivative having methylol group, phenol derivative may be dissolved in an appropriate solvent such as methanol, ethanol, toluene, ethyl acetate for treatment, for example, reprecipitation using water washing, poor solvent.

For example, as the ion exchange resin, cation exchange resin such as AMBERLITE 15, AMBERLITE 200C, AMBERLIST 15E (manufactured by ROMU AND HASU Corp.), DOWX MWC-1-H, DOW X 88, DOW X HCR-W2 (manufactured by Dow Chemical Corp.), LEVERCHIT SPC-108, LEVERCHIT SPC-118 (manufactured by Biel Corp.), TIREION RCP-150H (manufactured by MITSUBISHI KASEI CORP.), SUMIKAION KC-470, DUOLITE C26-C, DUOLITE C-433, DUOLITE-464 (manufactured by SUMITOMO KAGAKU KOGYO CORP.), NAFION-H (manufactured by Dupont Corp.) and anion exchange resin such as AMBERLITE IRA-400, AMBERLITE IRA-45 (manufactured by ROMU AND HASU CORP.) can be mentioned.

As inorganic solid, inorganic solid in which a group containing proton acid group such as $Zr(O_3PCH_2CH_2SO_3H)_2$, $Th(O_3PCH_2CH_2COOH)_2$ is coupled with the surface; polyorganosiloxane containing proton acid group such as polyorganosiloxane having sulfonic acid group; heteropoly acid such as cobalt tangusten acid, phosphomolybdic acid; isopoly acid such as niobic acid, tantalum acid, molybdenum acid; single system metal acids such as silica gel, alumina, chromia, zirconia, CaO, MgO; composite system metal acids such as silica-alumina, silica-magnesia, silica-zirconia, zeolite; clay mineral such as acid clay, activated earth, montmorillonite, kalionite; metal sulfuric acid such as $LiSO_4$, $MgSO_4$; metal phosphate acid such as zirnonia phosphate, lanthanum phosphate; metal sulfuric acid such as $LiNO_3$, $Mn(NO^3)_2$; inorganic solid in which a group containing amino group such solid obtained by reacting aminoprophyltriethoxysilane on silica gel is coupled with the surface; polyorganosiloxane containing amino group such amino modified silicone resin can be mentioned.

As the protective layer forming coating solution, a variety of solvents, for example, alcohols such as methanol, ethanol, propanol, butanol, ketones such as acetone, methyl ethyl ketone, tetrahydrofuran, ethers such as diethyl ether, dioxane may be used. In the meantime, to apply dip coating method generally used for production of the photoreceptor, it is preferable to use alcohol base solvent, ketone base solvent or solvent by mixing those. The boiling point of the solvent for use is preferred to be 50-150° C. and it is permissible to mix those solvents arbitrarily.

Because alcohol base solvent, ketone base solvent or solvent by mixing those are preferable as the solvent, any charge transportation material for use in formation of the protective layer may be soluble to those solvents.

Although the quantity of solvent may be set freely, preferably, it is 0.5-30 mass portion and more preferably it is 1-20 mass portion with respect to a single mass portion in total of the solid content contained in the protective layer forming coating solution because the composition material is deposited easily if it is too small.

As a coating method for forming the protective layer using the protective layer forming coating solution, a general method such as blade coating method, wire bar coating method, spray coating method, impregnation coating method, bead coating method, air knife coating method, curtain coating method and the like may be used. However, if a necessary film thickness cannot be obtained by a single coating, the necessary film thickness may be obtained by coating over plural times. In the meantime, if it is intended to coat over plural times, heat treatment may be carried out each time when the coating is executed or after coating over plural times.

Hardening is carried out after the protective layer forming coating solution is applied onto the charge transportation layer. Usually, upon hardening, it is more preferable if hardening temperature is higher and hardening time is longer in order to accelerate cross-link reaction of phenol derivative and raise the mechanical strength of the protective layer.

As the hardening temperature upon hardening, 100-190° C. is preferable, 110-170° C. is more preferable and 130-160° C. is further preferable. As the hardening time, 30 minutes-2 hours is preferable and 30 minutes-1 hour is more preferable. As an environment in which the hardening processing (cross-link reaction) is executed, gas environment inactive to so-called oxidation, such as nitrogen, helium, argon is preferable. If the cross-link reaction is executed under the inactive gas environment, the hardening temperature can be set higher than under air environment (oxygen contained environment) and the hardening time can be set to 100-160° C. (preferably, 110-150° C.). Further, the hardening time can be set to 30 minutes to two hours (preferably, 30 minutes to an hour). Further, because in a compound expressed by the above general formula (II), a portion indicated by $(—(X^1)_{n1}R^2—RH)$ is inclined to be largely affected by electric characteristic depending on the hardening temperature and sensitive to oxidation and thus, the hardening is preferred to be executed with in the above-mentioned preferable temperature range.

Further, upon the hardening, hardening catalyst may be used. As the hardening catalyst, photo acid generating agents including bissulfonyldiazomethanes such as (isopropylsulfonyl) diazomethane, bissulfonylmethanes such as methylsulfonyl p-tuluenesulfonylmethane, sulfonylcarbonyldiazomethane such as cyclohexylsulfonylcyclohexylcarbonyldiazomethane, sulfonyl carbonylalkanes such as 2-methyl-2-(4-methylphenylsulfonyl) propiophenone, nitrobenzinsulfonates such as 2-nitrobenzin p-toluenesulfonate, benzoinsulfonates such as benzointosylate, N-sulfonyloxyimides such as N-(trifluoromethylsulfonyloxy) phthalimide, pyridones such as (4-fluorobenzenesulfonyloxy)-3, 4, 6-trimethyl-2-(3-vinyphenyl)-ethyl-4-chlorobenzenesulfonate, onium salts such as triphenylsulfoniummethane sulfonate, diphenyliodoniumtrifluoromethanesulfonate, compound obtained by neutralizing proton acid or Lewis salt acid with Lewis base, mixture of Lewis acid with trialkylphosphate, sulfonic acid esters, phosphoric acid esters, onium compounds, anhydrous carboxylic acid compounds and the like can be picked up.

As compounds produced by neutralizing proton acid or Lewis acid with Lewis base, compound produced by neutralizing halogen carboxylic acids, sulfonic acids, sulfuric acid monoester, phosphoric acid mono and diesters, polyphosphoric acid esters, boracic acid mono and diesters with a variety of amines such as ammonia, monoethylamine, triethylamine, pyridine, piperidine, aniline, morpholine, cyclohexylamine, n-butylamine, monoethanolamine, diethanolamime, triethanolamine, trialkyl phosphine, triarylphosphine, trialkylphosphate, triarylphosphate, NEICURE 2500X, 4167, X-47-110, 3525, 5225 (product name, manufactured by KING INDUSTRY) marketed as acid-base blocking catalyst and the like can be mentioned. As compounds produced by neutralizing Lewis acid with Lewis salt base, for example, compounds produced by neutralizing Lewis acids such as BF3, $FeCl_3$, $SnCL_4$, $AlCl_3$, $ZnCl_2$ with the aforementioned Lewis salt base can be mentioned. As the onium compounds, triphenylsulfoniummethanesulfonate, diphenyliodoniumtrifluoromethanesulfonate and the like can be mentioned.

As the anhydrous carboxylic acid compounds, acetic acid anhydride, propionic acid anhydride, butyric anhydride, isobutyric acid anhydride, isobutyric acid anhydride, oleic acid anhydride, stearic acid anhydride, n-caproic acid anhydride, n-caprylic acid anhydride, n-capric acid anhydride, palmitate acid anhydride, myristate acid anhydride, trichloroacetic acid anhydride, dichloroacetic acid anhydride, monochloroacetate anhydride, trifluoroacetate anhydride, heptafluoroacetate anhydride and the like can be mentioned. As specific examples of Lewis acid, for example, metal halogen compounds such as boron trifluoride, aluminum trichloride, stannous chloride, stannic chloride, stannous boromide, stannic boromide, organic metal compounds such as trialkyl boron, aluminum trialkyl, aluminum halide dialkyl, aluminum halide monoalkyl, tin tetraalkyl, metal chelates such as diisopropoxyethylacetacetate aluminum, tris (ethylacetoacetonato) aluminum, tris (acetylacetacetate) aluminum, diisopropoxy-bis (ethylacetoacetate) titanium, diisopropoxy-bis (acetylacetonato) titanium, tetrakis (n-propylacetoacetate) zirnonium, tetrakis (acetylacetonato) zirnonium, tetrakis (ethylacetoacetate) ziroconium, dibutyl-bis (acetylacetonato) tin, tris(acetylacetonato) iron, tris (acetylacetonato) rhodium, bis (acetylacetonato) zinc, tris (acetylacetonato) cobalt, and metal soap such as dibutyltin laurate, dioctyltin ester maleate, magnesium naphatenate, calcium naphtenate, manganese naphtenate, iron naphtenate, cobalt naphtanate, copper naphtanate, zinc naphtanate, zirconium naphtanate, lead naphtanate, calcium octylate, manganese octylate, cobalt octylate, zinc octylate, zirconium ocylate, tin ocylate, lead ocylate, zinc laurate, magnesium stearate, aluminum stearate, calcium stearate, cobalt stearate, zinc stearate, lead stearate and the like can be mentioned. These may be used singularly independently or by combining tow or more kinds.

Although the quantity for use of these hardening catalysts is not limited to any particular value, it is preferred to be 0.1-20 mass portion, and particularly preferred to be 0.3-10 mass portion with respect to 100 mass portions in total of the solid content contained in the protective layer forming coating solution.

If organic metal compound is used as catalyst upon formation of the protective layer, multidentate ligand may be added from viewpoints of pot life and hardening efficiency. Although as such a multidentate ligand, followings and compounds induced from those can be mentioned, it is not restricted to them. More specifically, β-diketones such as acetylacetone, trifluoroacetylacetone, hexafluoroacetylacetone; ester acetoacetates such as methyl acetoacetate, ethyl acetoacetate; dipivaloyl methylacetone and its derivatives; glycine and its derivatives; ethylene amine and its derivatives; 8-oxyquinoline and its derivates; salcylate aldehyde and its derivatives; catechol and its derivaties; 2-oxy azo compound and bidentate ligand; diethyl triamine and its derivates; tridentate ligand such as nitrate tri-acetic acid and its derivatives; hexadentate ligand such as ethylene diamine tetra-acetic acid (EDTA) and its derivates and the like can be mentioned. Further, in addition to the aforementioned organic ligands, inorganic ligands such as pyprophoric acid, tri-phosphoric acid and the like can be mentioned. As the multidentate ligand, particularly, bidentate ligand is preferable and as a specific example, bidentate ligand expressed by a following general formula (VII-4) can be mentioned.

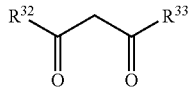

(VII-4)

[chemical 5]

In the above general formula (VII-4), $R^{32}$ and $R^{33}$ designate alkyl group having a carbon number of 1-10 independently, alkyl fluoride group or alkoxy group having a carbon number of 1-10.

As the multidentate ligand, of the above-described compounds, the bidentate ligand expressed by the general formula (VII-4) is more preferable and a compound in which $R^{32}$ and $R^{33}$ are identical in the general formula (VII-4) is particularly preferable. By equalizing $R^{32}$ with $R^{33}$, the coordination force of ligand near room temperature is intensified so as to stabilize the protective layer forming coating solution further.

Although the blending quantity of the multidetate ligand can be set arbitrarily, it may be 0.01 mol or more with respect to a quantity consumed of 1 mol of organic metal compound and more preferably, 0.1 mol or more and further preferably, 1 mol or more.

The oxygen transmission coefficient of the protective layer at 25° C. is preferred to be $4\times10^{12}$ fm/s·Pa or less, more preferred to be $3.5\times10^{12}$ fm/s·Pa or less and more preferred to be $3\times10^{12}$ fm/s·Pa or less. Although the oxygen transmission coefficient is a scale which indicates the degree of easiness of oxygen gas transmission through a layer, if changing the viewpoint, it can be regarded as a substitutive characteristic of physical gap rate of the layer. In the meantime, although an absolute value of the transmission rate changes when the kind of gas is changed, the relation of size is hardly inverted in a gap in a specimen material. Therefore, the oxygen transmission rate may be interpreted as a scale which expresses the degree of easiness of general gas transmission. That is, if the oxygen transmission coefficient of the protective layer at 25° C. satisfies the above-described condition, gas is unlikely to permeate into the protective layer. Therefore, permeation of discharge product generated by the toner image forming process is suppressed to hamper deterioration of compound contained in the protective layer thereby maintaining the electric characteristic at a high level, contributing to intensified image quality and service life.

The thickness of the protective layer may be 0.1 to 6 μm and more preferably 1 to 5 μm.

Next, the developing powder accommodating body 1141 will be described in detail. As described above, the developing powder accommodating body 1141 accommodates developing powder containing toner particles and abrasive particle and lubricating particle which are finer than the toner particle. The toner particle is not restricted by any particular manufacturing method but it may be obtained by agitation grinding method of agitating, grinding and classifying, for example, coupling resin, coloring agent, abrasive powder, lubricant and charge control agent as required; a method of changing the shape of particle obtained by the agitation grinding method with mechanical impact force or thermal energy; emulsion polymerization aggregation method of obtaining toner particle by emulsifying and polymerizing polymerized monomer of coupling resin, mixing formed dispersion liquid, coloring agent, abrasive powder, lubricant, and dispersion liquid such as charge control agent as required so as to condense, and heat to induce fusion; suspension polymerization method of suspending polymerized monomer for obtaining coupling resin, coloring agent, abrasive powder, lubricant and a solution of charge control agent as required in aqueous solvent for polymerization; dissolution suspension method of suspending coupling resin, coloring agent, abrasive powder, lubricant and a solution of charge control agent as required for granulation.

Although a well known method may be used, for example, a manufacturing method of providing with core shell structure by forming coating layer with the toner obtained in the above method as a core, suspension polymerization method, emulsion polymerization aggregation method and dissolution suspension method may be used from viewpoints of shape control and particle size distribution control and emulsion polymerization aggregation method is particularly preferable.

Subsequently, an image forming apparatus according to a second embodiment of the present invention will be described. Hereinafter, components having the same designation as that of component of the image forming apparatus shown in FIG. 1 will be described with the same reference numerals as used before and duplicated description is omitted. Although the image forming apparatus of the second embodiment is an image forming apparatus which employs full-color tandem type and having four toner image forming units, the cleaning assistant member in the cleaning unit disposed in each toner image forming unit is different from the cleaning assistant member shown in FIG. 2.

Figure 6:
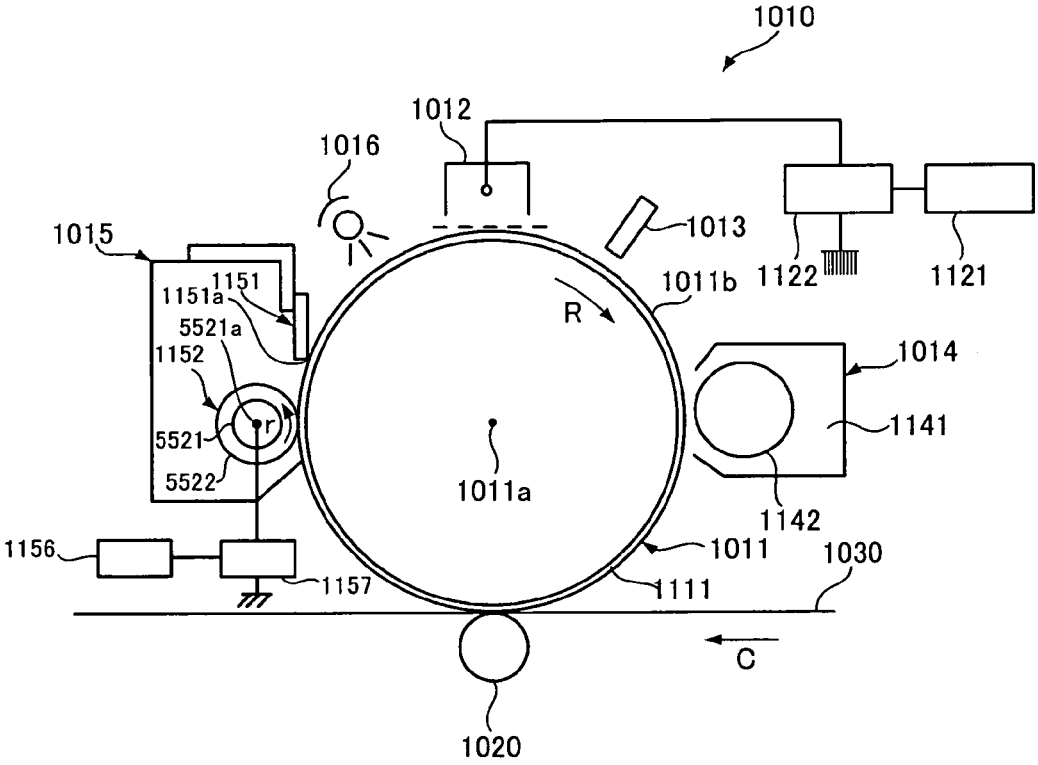
FIG. 6 is a diagram showing the schematic structure of a toner image forming unit which is one of four toner image forming units disposed in an image forming apparatus according to a second embodiment.

FIG. 6 is a diagram showing the schematic structure of a toner image forming unit which is one of four toner image forming units disposed in the image forming apparatus of the second embodiment.

The cleaning assistant member 1152 shown in FIG. 6 is disposed in the upstream of the cleaning blade 1151 in the rotation direction of the photoreceptor drum. This cleaning assistant member 1152 has plural fine fibers 5522 in the peripheral surface of a roll-like holding member 5521 having a rotation axis 5521*a* extending in parallel to the rotation axis 1011*a* of the photoreceptor drum 1011. Although the holding member of the cleaning assistant member shown in FIG. 2 is in the form of a pad, the roll-like shape as shown in FIG. 6 does not induce enlargement of the size. The roll-like holding member 5521 is made of elastic material and fine fiber cloth formed on the peripheral surface of the holding member 5521 is used as the cleaning assistant member 1152 shown in FIG. 6.

The cleaning assistant member 1152 shown in FIG. 6 rotates around the rotation axis 5521*a* in conditions in which it keeps contact with the photoreceptor surface 1011*b* and a portion which keeps contact with the photoreceptor surface 1011*b* rotates with a difference in speed with respect to the photoreceptor surface 1011*b* in the same direction as the rotation direction (see an arrow R) of the photoreceptor drum 1011. This removes fine adhering substances such as discharge product and allows toner to pass from the cleaning assistant member 1152 to the cleaning blade 1151 so as to control lubrication of the blade.

The fine fiber 5522 of the cleaning assistant member 1152 shown in FIG. 6 is fine fiber having conductivity. As a method for providing the fine fibers with conductivity, there are a method of dispersing conductive fine particles such as carbon black on synthetic fibers, a method of mixing conductive fine particles at the time of producing unwoven fabric from fibers, and a method of impregnating fibers with conductive polymer so as to coat equally to provide with conductivity. As a conductive processing agent, acetylene, benzene, aniline, phenylacetylene, pyrrole, furan, chiophene, indole, and polymer of derivative of these monomers are available. Further, the fine conductive fiber and fine insulating fiber may be blended.

The holding member 5521 shown in FIG. 6 is conductive also and cleaning bias is applied to the fine fibers 5522 through the holding member 5521 from the power supply 1157 under a control of an applied bias control protion 1156. The cleaning bias may be applied in a range of −450 V to +450 V which is a non-discharge voltage as a difference of potential with respect to the photoreceptor drum 1011. The applied bias control portion 1156 applies a voltage of polarity opposite to toner charging polarity constantly to improve the scraping performance for discharge product while holding toner and applies a voltage of an identical polarity at an arbitrary timing so as to supply held toner to the cleaning blade 1151 by spouting. Further, constantly, it may apply a voltage of an identical polarity to the toner charging polarity so as to hold toner converted to have an opposite polarity through a transfer process and toner component developed on a background portion thereby improving the scraping performance of discharge product and then apply a voltage of opposite polarity at an arbitrary timing so as to supply the held toner to the cleaning blade 1151 by spouting. The spouting timing is not restricted to any particular one. If a low image density likely to make lubricating component short at the front edge of the blade is collected continuously or under high temperature/high humidity under which friction between the photoreceptor drum 1011 and the cleaning blade 1151 rises, the spouting timing may be controlled.

Subsequently, a modification of the cleaning blade 1151 possessed by the cleaning unit 1015 will be described. The same reference numerals as described before are used for a following description.

Figure 7:
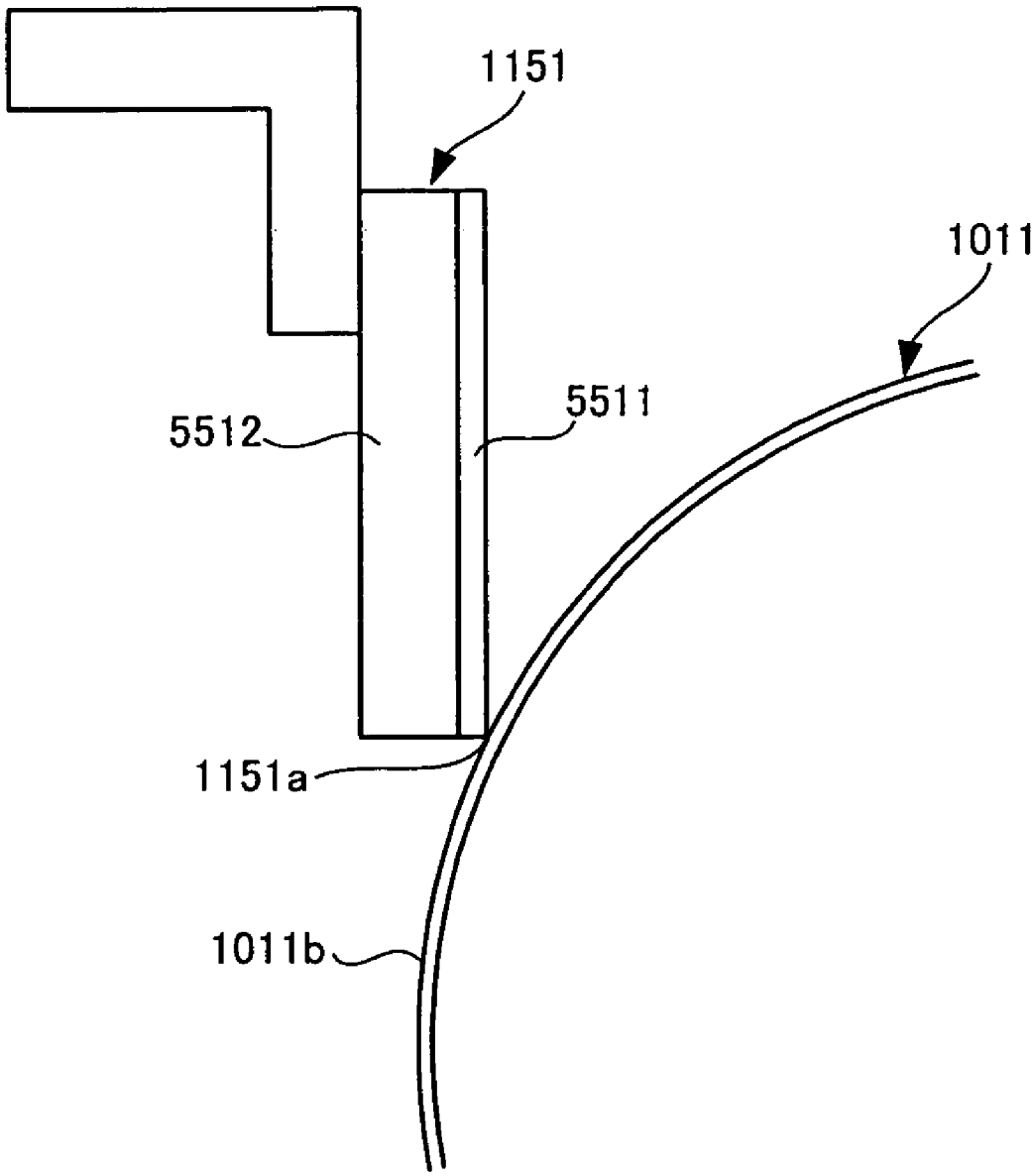
FIG. 7 is a diagram showing a cleaning blade.

FIG. 7 is a diagram showing a cleaning blade having a lamination structure.

In the cleaning blade 1151 shown in FIG. 7, a first layer 5511 and a second layer 5512 are laid in the thickness direction. That is, the first layer 5511 on the side of the photoreceptor drum 1011 is an elastic substance layer which makes a pressure contact with the photoreceptor surface 1011*b* thereby constructing the front edge portion 1151*a*, and satisfies both the condition indicated by the formula (1) and the condition indicated by the formula (2). On the other hand, the second layer 5512 on an opposite side is a layer constructed of elastic material having a lower 100% modulus than the first layer 5511, capable of absorbing a vibration of the front edge portion 1151*a* while capable of adjusting a contact pressure of the entire blade appropriately, so that deformation of the front edge portion 1151*a* can be controlled further stably. Further, a settling of the entire cleaning blade due to long term storage can be controlled by adjusting the permanent elongation of the composition material of the second layer 5512 to be smaller than the first layer 5511, which is further preferable. Further, the dynamic follow-up performance of the entire cleaning blade may be improved by increasing the impact resilience of the composition material of the second layer 5512 that of the first layer 5511 or more. In such a case, preferably, the thickness of the first layer 5511 is 25% the entire thickness or less.

Figure 8:
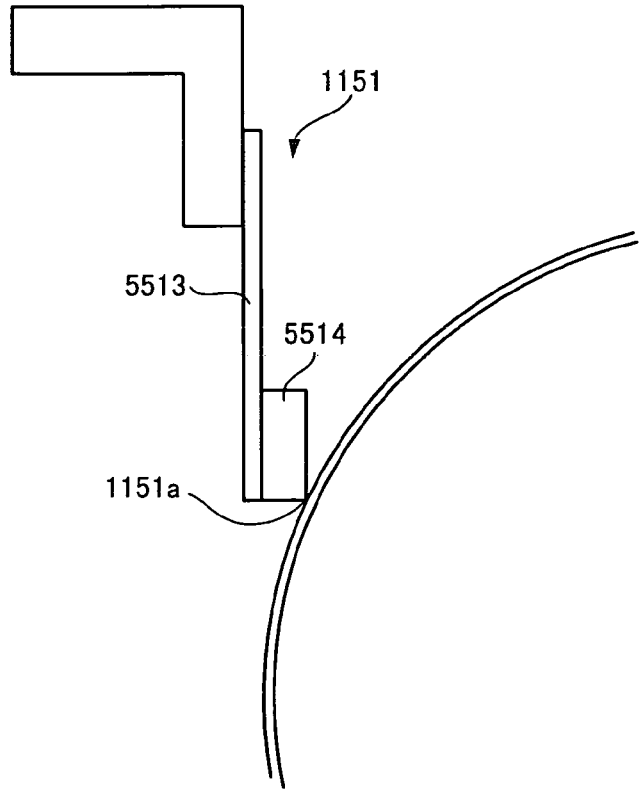
FIG. 8 is a diagram showing a cleaning blade in which a rubber elastic body having a single layer structure is backed by a leaf spring member.
Figure 9:
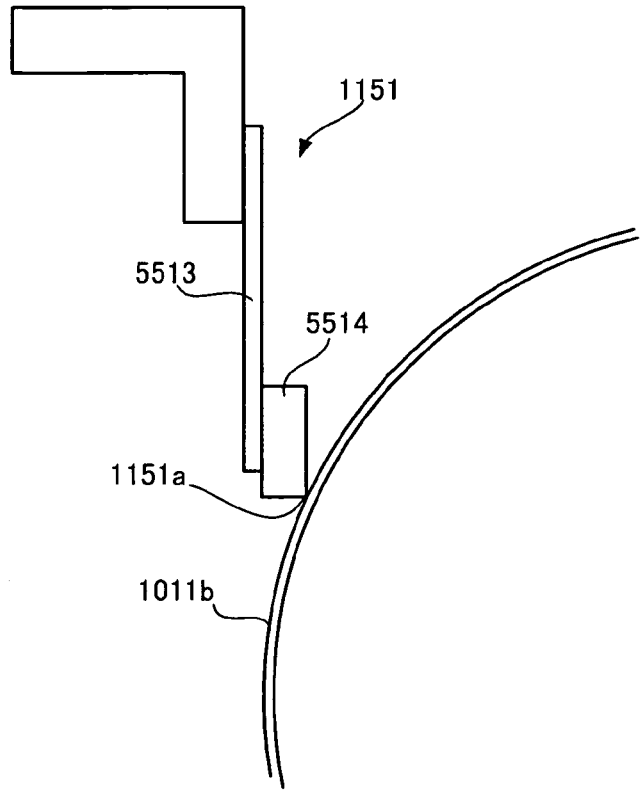
FIG. 9 is a diagram showing a cleaning blade in which a rubber elastic body having a single layer structure is backed by a leaf spring member up to halfway.

FIG. 8 is a diagram showing a cleaning blade in which single layer rubber elastic body is backed completely with a plate-like spring member. FIG. 9 is a diagram showing a cleaning blade in which the single layer rubber elastic body is backed with the plate-like spring member up to halfway.

A plate-like spring member 5513 is provided on the rear face on an opposite side to the photoreceptor drum 1011 of the cleaning blade 1151 shown in FIGS. 8 and 9. A metal thin plate or plastic thin plate may be preferably used as the material of this plate-like spring member 5513 although it is not restricted to any particular one. Although any metal material may be used as the metal thin plate material as long as it is a plastic metal plate, preferably, SUS base stainless plate, phosphor-bronze plate and the like are used. As polymer material for use for a plastic thin plate, preferably, thermo plastic resin such as polyethylene terephthalate, polystyrene, polyacrylate, polyethylene, polypropylene, polyallylate, styreneacrylate copolymer, reinforced plastic such as glass fiber reinforced plastic, carbon fiber reinforced plastic and thermo-setting polymer material, which is hardened by three-dimensional cross-link and whose rubber elasticity is small, and the like are used.

In the cleaning blade 1151 shown in FIG. 8, the front end of the single layer rubber elastic body 5514 meets the front end of the plate-like spring member 5513 and that rubber elastic body 5514 is backed completely with the plate-like spring member 5513. That is, the front end edge portion 1151*a* making firm contact with the photoreceptor surface 1011*b* is supported by the plate-like spring member 5513 from the rear side.

On the other hand, in the cleaning blade 1151 shown in FIG. 9, the front end of the single layer rubber elastic body 5514 projects further from the front end of the plate-like spring member 5513 and the rubber elastic body 5514 is backed by the plate-like spring member 5513 up to halfway. That is, the front edge portion 1151*a* making a firm contact with the photoreceptor surface 1011*b* is not supported from the rear side.

The plate-like spring member 5513 and the rubber elastic body 5514 are bonded to each other according to a well known bonding method (hot melt, double-sided adhesive tape, instant adhesive).

The single layer rubber elastic body 5514 shown in FIGS. 8 and 9 satisfy the condition indicated by the formula (1) and the condition indicated by the formula (2).

The cleaning blades 1151 shown in FIGS. 8 and 9 are capable of controlling the entire contact pressure with the plate-like spring member 5513 so that the contact pressure can be controlled stably without influences by buckling due to use environment and long period storage.

Figure 10:
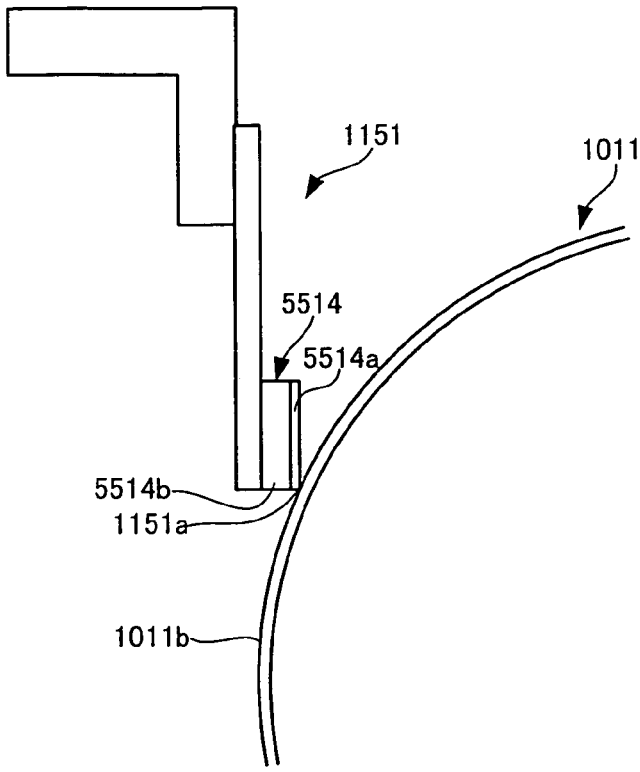
FIG. 10 is a diagram showing a cleaning blade in which a rubber elastic body having a laminated structure is backed completely by a leaf spring member.
Figure 11:
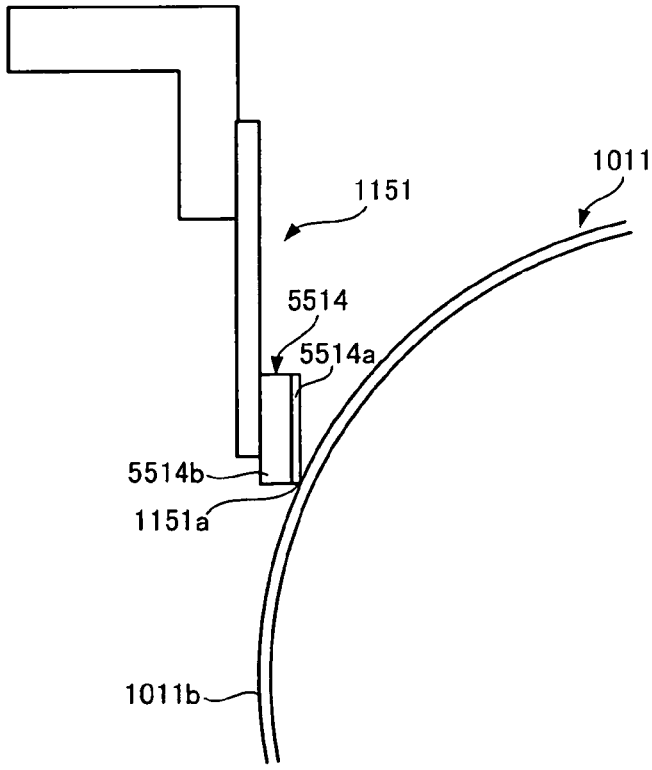
FIG. 11 is a diagram showing a cleaning blade in which a rubber elastic body having a laminated structure is backed by a leaf spring member up to halfway.

FIG. 10 is a diagram showing a cleaning blade in which the lamination structure rubber elastic body is backed completely with a plate-like spring member. FIG. 11 is a diagram showing a cleaning blade in which the lamination structure rubber elastic body is backed with the plate-like spring member up to halfway.

A point in which the cleaning blade 1151 is different from the cleaning blade 1151 shown in FIG. 8 and a point in which the cleaning blade 1151 shown in FIG. 11 is different from the cleaning blade 1151 shown in FIG. 11 exist in that the rubber elastic body 5514 is of lamination structure. That is, the rubber elastic body 5514 of the cleaning blade 1151 shown in FIGS. 10 and 11 is comprised of first layer 5514*a* and second layer 5514*b* laminated in the thickness direction and the first layer 5514*a* of the photoreceptor drum 1011 makes a firm contact with the photoreceptor surface 1011*b* and this is an elastic body layer which constitutes the front edge portion 1151*a* and satisfies both the condition indicated by the formula (1) and the condition indicated by the formula (2). On the other hand, the second layer 5514*b* on the opposite side is a layer constituted of elastic material having lower 100% modulus than the first layer 5514*a* and capable of absorbing vibration of the front edge portion 1151*a* while the contact pressure of the entire blade can be adjusted preferably, thereby controlling deformation of the front edge portion 1151*a* more stably.

An example of cleaning the photoreceptor drum 1011 has been described above. The cleaning unit of the present invention can be applied to the belt cleaner 1070 shown in FIG. 1. The discharge product adheres to the intermediate transfer belt 1030 by discharge by separation of the paper P generated at the secondary transfer. Thus, a cleaning unit in which the intermediate transfer belt 1030 is scraped mechanically with a cleaning blade which satisfies both the condition indicated by the above formula (1) and the condition indicated by the formula (2) and the discharge product is removed from the intermediate transfer belt 1030 with the fine fibers having residual toner component in the upstream of the cleaning blade is effective.

EXAMPLES

Hereinafter, examples and comparative examples of the present invention will be described specifically. The present invention is not restricted to any particular examples. In a following description, all parts mean weight parts unless specified otherwise.

[Manufacturing of Photoreceptor A]

30 weight parts of organic zirconium compound (acetyl acetone zirconium butyrate) and 3 weight parts of organic silane compound (γ-amino propyl trimethoxysilane) were added to 170 weight parts of n-butyl alcohol in which 4 weight parts of polyvinyl butyral resin (ESUREKKU BM-S, manufactured by SEKISUI KAGAKU CORP.) and mixed and agitated so as to obtain coating solution for formation of the foundation layer. An aluminum supporting body having an outside diameter of 84 mm whose surface was roughed by honing by impregnation was impregnated with this coating solution and dried by blowing wind at a room temperature for 5 minutes. Then, the supporting body was heated to 50° C. in 10 minutes, taken into a constant temperature/constant humidity bath at 50° C. and 85% RH (dew point: 47° C.) and subjected to hardening acceleration treatment with humidity for 20 minutes. After that, the foundation layer was formed by drying in a hot wind drier at 160° C. for 10 minutes.

As charge generating material, mixture of 15 weight parts of chloride gallium phthalogcyanine, 10 weight parts of vinyl chloride-vinyl acetate copolymer resin (VMCH, manufactured by NIPPON UNION CARBIDE CORP.) and 300 weight parts of n-butyl alcohol was dispersed with a sand mill for 4 hours. The foundation layer was impregnated with the obtained dispersion and dried so as to form charge generation layer having a thickness of 0.2 μm. Next, coating solution obtained by dissolving and mixing 40 parts of N,N'-bis (3-methyl phenyl)-N,N'-diphenyl bendizine, 60 parts of bis phenol Z polycarbonate resin (molecular weight: 40,000), 230 weight parts of tetrahydrofuran and 100 weight parts of monochloro benzene was applied onto the aforementioned charge generation layer by dipping and it was dried at 130° C. for 40 minutes so as to form charge transportation layer having a thickness of 23 μm.

Next, protective layer forming coating solution was obtained by dissolving two parts of chemical 1 shown below, two parts of RESI TOP PL4852 (manufactured by GUNEI KAGAKU CORP.) and 10 parts of isopropyl alcohol. The charge transportation layer was impregnated with this protective layer forming coating solution and dried by blowing wind at a room temperature for 30 minutes. After that, it was dried at 135° C. for 45 minutes so as to form protective layer having a thickness of 2 μm. The obtained photoreceptor was called photoreceptor A.

Compound 1

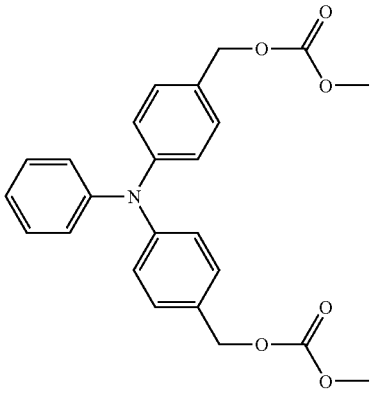

[chemical 6]

[Manufacturing of Cleaning Blade]

A cleaning blade to be disposed in the cleaning unit was manufactured with polyurethane rubber. Here, nine kinds of cleaning blades, A-I were manufactured by changing contact angle between the 100% modulus and water by changing material of polyol, molecular weight of polyol and material/mixture of isocyanate and cross-linker.

The lamination structure shown in FIG. 7 was adopted except cleaning blade H and a first layer which constitutes the front edge was formed with physical values shown in Table 1 below. In the cleaning blade of lamination structure, the thickness of the first layer was set to 0.3 mm, the thickness of the second layer was set to 1.7 mm and the entire thickness was set to 2.0 mm. The thickness of the cleaning blade having a single layer structure was set to 2.0 mm. Contact pressure to the photoreceptor was set to 35.28 mN/mm by adjusting the free length of the cleaning blade and the amount of biting into the photoreceptor drum.

condition indicated by the formula (2) is not satisfied except the cleaning blade G.

[Cleaning Assistant Member]

Three kinds of the cleaning assistant members, a pad-like cleaning assistant member, a roll-like cleaning assistant member and a pad-like cleaning assistant member whose fine fibers were subjected to conductivity treatment were prepared.

As the pad-like cleaning assistant member, a unwoven fabric (polyester/nylon, manufactured by NIPPON BAIRIN CORP., WP8085) having a fiber diameter (size) of 6 μm manufactured according to water entangling method as the fine fiber fabric was bonded to pad-like foamed urethane 3 mm high prepared as a holding member and the amount of biting into a photoreceptor drum was set to 1.5 mm, so that a pressure of the cleaning assistant member to the photoreceptor surface was set to 19.6 N/mm under a measuring environment at 25° C. Hereinafter, this pad-like cleaning assistant member is called cleaning assistant member A.

As the roll-like cleaning assistant member, fine fiber fabric was wound around a foamed urethane sponge roll 12 mm in diameter and the amount of biting into the photoreceptor drum was set to 1 mm, so that the pressure of the cleaning assistant member to the photoreceptor surface was set to 19.6mN/mm under a measuring environment at 25° C. This roll-like cleaning assistant member was rotated at a peripheral velocity ratio of 0.5 in the same direction in a contact range with the photoreceptor drum. Hereinafter, this roll-like cleaning assistant member is called cleaning assistant member B.

Further, as the pad-like cleaning assistant member whose fine fibers were subjected to conductivity treatment, the fine fiber member was coated entirely with conductive polymer (polypyrrole) thinly and conductive unwoven fabric having electric resistance of $1\times10^3\Omega$ was obtained. This conductive unwoven fabric was bonded to pad-like foamed urethane 3 mm high, 4 mm wide and the amount of biting into the

TABLE 1

| | 100% modulus (B) | contact angle | −2.5 × B + 102 | others |
|---|---|---|---|---|
| cleaning blade A | 6.6 MPa(67 kgf/cm$^2$) | 89.1° | 85.50 | 2-layer structure |
| cleaning blade B | 16.0 MPa(163 kgf/cm$^2$) | 89.3° | 62.00 | 2-layer structure |
| cleaning blade C | 10.3 MPa(105 kgf/cm$^2$)) | 80.1° | 76.25 | 2-layer structure |
| cleaning blade D | 10.5 MPa(107 kgf/cm$^2$) | 82.9° | 75.75 | 2-layer structure |
| cleaning blade E | 8.4 MPa(86 kgf/cm$^2$) | 89.7° | 81.00 | 2-layer structure |
| cleaning blade F | 5.1 MPa(52 kgf/cm$^2$) | 87.7° | 89.25 | 2-layer structure |
| cleaning blade G | 8.4 MPa(86 kgf/cm$^2$) | 78.3° | 81.00 | 2-layer structure |
| cleaning blade H | 3.6 MPa(37 kgf/cm$^2$) | 83.2° | 93.00 | single-layer structure |
| cleaning blade I | 2.9 MPa(30 kgf/cm$^2$) | 93.2° | 94.75 | 2-layer structure |

Cleaning blades up to the fifth of the nine kinds of the cleaning blades shown in Table 1 satisfy both the condition indicated by the formula (1) and the condition indicated by the formula (2). On the other hand, four cleaning blades F-I do not satisfy the condition indicated by the formula (1) or the photoreceptor drum was set to 1.5 mm so that a pressure of the cleaning assistant member to the photoreceptor was set to 19.6 mN/mm under a measuring environment of 25° C. Hereinafter, the cleaning assistant member subjected to the conductivity treatment is called cleaning assistant member C. A voltage of 200 V was applied to the cleaning assistant member C synchronously with a rotation of the photoreceptor drum and a discharge cycle of applying a voltage of −200 V in the interval of a single rotation of the photoreceptor drum per 500 sheets was set up. This cleaning assistant member was reciprocated at a velocity of 2 reciprocation per a single rotation of the photoreceptor drum with a moving width of 4 mm along the extension direction of the rotation axis of the photoreceptor drum.

Example 1

As a test machine, a reconstructed FUJI XEROX Co., Ltd. Docu-Center Color 500 was used. That is, the photoreceptor A in which the protective layer was formed on the surface thereof was incorporated as the photoreceptor. A cleaning unit equipped with the cleaning blade A and cleaning assistant member A was incorporated. Durability test was carried out about 100,000 pieces under low temperature/low humidity (10° C., 20% RH) and high temperature/high humidity (28° C., 80%) using product developing agent of the Docu-Center Color 500 as developing agent so as to evaluate abrasion of the photoreceptor and flaws on the photoreceptor (photoreceptor roughness). Further, generation of filming was evaluated under low temperature/low humidity and generation of image flow was evaluated under high temperature/high humidity. These results are shown in Table 2 together with comprehensive evaluation.

TABLE 2

| | cleaning unit | | result evaluation | | | | |
|---|---|---|---|---|---|---|---|
| | auxiliary member | blade | cleaning performance | edge damage | image flow | filming | total evaluation |
| example 1 | A | A | g | g | Vg | Vg | g |
| example 2 | A | B | Vg | Vg | Vg | Vg | g |
| example 3 | A | C | g | g | Vg | Vg | g |
| example 4 | A | D | Vg | Vg | Vg | Vg | g |
| example 5 | A | E | Vg | Vg | Vg | Vg | g |
| example 6 | B | A | Vg | Vg | Vg | Vg | g |
| example 7 | B | B | Vg | Vg | Vg | Vg | g |
| example 8 | C | A | Vg | Vg | Vg | Vg | g |
| comparative example 1 | none | A | g | g | p | p | p |
| comparative example 2 | none | C | g | g | p | p | p |
| comparative example 3 | A | F | p | p | Vg | Vg | p |
| comparative example 4 | A | G | p | p | Vg | Vg | p |
| comparative example 5 | A | H | p | Vp | g | g | p |
| comparative example 6 | A | I | p | p | Vg | g | p |

Details of each evaluation are shown below.

[Cleaning Performance]

The cleaning performance was evaluated by investigating whether or not there is any improperly cleaned image in printed images running under low temperature/low humidity and cleaning two pieces of images having 100% image density not transferred yet and of size A3 periodically. The evaluation standard is as follows.

Very good (Vg): no problem about cleaning performance in not transferred image and printed images Good (g): no problem about cleaning performance in printed image and generation of cleaning failure in not transferred image.

Poor (p): generation of cleaning failure in printed image

[Edge Damage]

About the blade edge damage, sensory assessment was carried out by observing a damage condition of the front edge of the cleaning blade with a laser microscope (VK8500 manufactured by KEIENSU Co., Ltd.).

The evaluation standard is as follows.

Very good (Vg): small edge abrasion

Good (g): medium edge abrasion

Poor (p): large edge abrasion

Very poor (Vp): large edge abrasion with conceivable edge chipping

[Image Flow]

After left for 12 hours each time when 20,000 sheets of paper were printed under high temperature/high humidity (28° C., 80% RH), only part of the photoreceptor surface was wiped with water to remove water soluble discharge product. After that, a half tone image was printed and a difference in density (ΔSAD) of portions corresponding to a portion of the photoreceptor surface wiped with water and a portion thereof not wiped with water was measured with a reflection type density measuring machine (X-rite) and its measurement result was evaluated according to a following standard. The smaller the value of the ΔSAD, the less likely the image flow is generated. In the meantime, the image flow of the half tone image was evaluated with a half tone image based on a ten-thousand line screen containing 300 lines and with image density of 30% in order to improve the detection accuracy for the image flow.

Very good (Vg): ΔSAD is 0.15 or less.

Good (g): ΔSAD is 0.15 or less than 0.4.

Poor (p): ΔSAD is 0.4 or more.

[Filming]

Visual sensory assessment was carried out by observing to see whether or not any substance adheres to the photoreceptor drum after the durability test. A half tone image with image density of 30% was collected and sensory assessment was carried out to see whether or not there was any influence on its image quality. The evaluation standard is as follows.

Very good (Vg): no adhering substance on photoreceptor or an image

Good (g): although substance adheres to photoreceptor, no substance exist on an image.

Poor (p): adhering substance on photoreceptor and an image.

Example 2-5

The same test and evaluation as the example 1 were executed using the same image forming apparatus as the example 1 except the cleaning blade was changed as shown in Table 2. Its result is shown in Table 2.

Example 6-8

The same test and evaluation as the example 1 were executed using the same image forming apparatus as the example 1 or 2 except the cleaning blade was changed as shown in Table 2. Its result is shown in Table 2.

Comparative Example 1

The same test and evaluation as the example 1 were executed using the same image forming apparatus as the example 1 except the cleaning assistant member was removed from the cleaning unit. Its result is shown in Table 2.

Comparative Example 2

The same test and evaluation as the example 1 were executed using the same image forming apparatus as the example 3 except the cleaning assistant member was removed from the cleaning unit. Its result is shown in Table 2.

Comparative Examples 3-6

The same test and evaluation as the example 1 were executed using the same image forming apparatus as the example 1 except that the cleaning blade was changed as shown in Table 2. Its result is shown in Table 2.

In the comparative examples 1, 2 in which the cleaning assistant member for capturing residual toner component was removed, the evaluation about the cleaning performance and edge damage was excellent because the residual toner component was supplied to the cleaning blade and functioned as lubricant. However, it is considered that removal of the discharge product was insufficient because the cleaning assistant member was removed and consequently, left discharge product absorbed humidity so as to induce image flow. It is considered that the discharge product was removed by the cleaning assistant member in the comparative examples 3-6. That is, it is considered that the residual toner component supplied to the cleaning blade became short because the residual toner component was captured by the cleaning assistant member so that abrasion and chipping occurred in the cleaning blades F-I, which were conventional cleaning blades, thereby lowering evaluations about the cleaning performance and edge damage. Contrary to this, no image flow or filming occurs in any example and it is considered that the discharge product was removed sufficiently. Further, evaluation results about the cleaning performance and edge damage are excellent, so that it can be said that sufficient cleaning was carried out with abrasion of the cleaning blade and generation of chipping suppressed.

Next, an embodiment of a second cleaning unit and second image forming apparatus of the present invention will be described.

Figure 12:
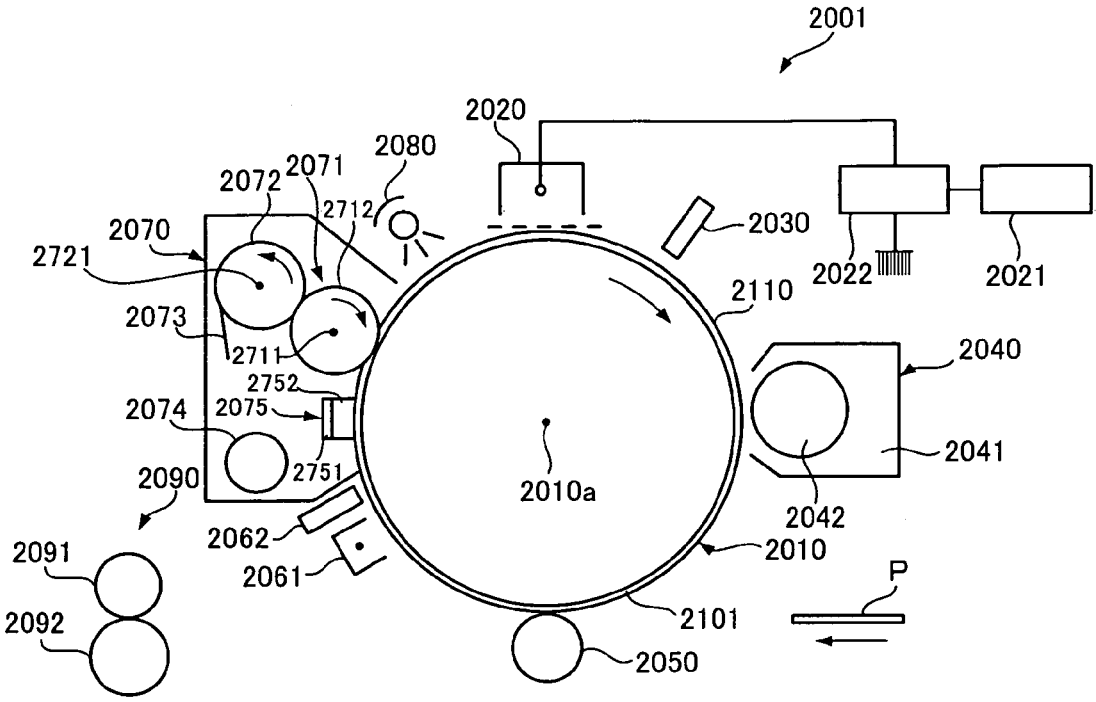
FIG. 12 is a diagram showing the schematic structure of an image forming apparatus according to a third embodiment of the present invention.

FIG. 12 is a diagram showing the schematic structure of an image forming apparatus according to a third embodiment of the present invention.

An image forming apparatus 2001 shown in FIG. 12 includes a drum-like photoreceptor 2010 which rotates in a clockwise direction around a rotation axis 2010*a* and has a charger 2020, an exposure device 2030, a developer 2040, a transfer roll 2050, a before-cleaning charger 2061, a before-cleaning neutralization unit 2062, a cleaning unit 2070 and a neutralization lamp 2080 around the photoreceptor 2010.

The photoreceptor 2010 shown in FIG. 12 is constituted by laying a foundation layer, photoreceptor layer containing charge generating layer and charge transportation layer and protective layer 2101 on a cylindrical conductive supporting body. The protective layer 2101 is an uppermost layer of this photoreceptor 2010 and in FIG. 12, this protective layer 2101 is represented schematically. The uppermost layer (surface 2110 of the photoreceptor 2010) is moved cyclically around the rotation axis when the photoreceptor 2010 rotates around the rotation axis 2010*a*. A further description of the photoreceptor 2010 is omitted here and the detail thereof will be described later.

The charger 2020 is a non-contact charging type corotron charger. This charger 2020 is applied with charging bias from a charger high-voltage power supply 2022 under a control of a charger control portion 2021. As the charger, it is permissible to adopt a well known charging method such as a contact type charging roll. The exposure device 2030 irradiates laser beam based on image information to a surface 2110 of the photoreceptor 2010. The developer 2040 includes a developing powder accommodating body 2041 accommodating developing agent containing toner particle and abrasive particle and lubricating particle which are finer than the toner particle and a developing roll 2042 which rotates opposing the surface of the photoreceptor 2010 with toner particles carried in the developing powder accommodating body 2041. The toner particle is charged with a predetermined polarity within the developer 2040 and is moved electrostatically to the surface 2110 of the photoreceptor 2010.

When an image is formed in the image forming apparatus 2001 shown in FIG. 12, first, toner image forming cycle for forming a toner image on the photoreceptor surface 2110 is executed. According to this toner image forming cycle, after the surface 2110 of the photoreceptor 2010 is charged equally by the charger 2020, laser beam is irradiated based on image information by the exposure device 2030 so as to form an electrostatic latent image on the surface 2110 of the photoreceptor 2010. This electrostatic latent image is developed by the developer 2040 so that a toner image is formed on the surface 2110 of the photoreceptor 2010 and then, the toner image formation cycle is ended.

Referring to FIG. 12, a recording paper P is carried from the right to the left in the same Figure. The carried recording paper is fed into between the photoreceptor 2010 and the transfer roll 2050. In the image forming apparatus 2001 shown in FIG. 12, a region sandwiched by the photoreceptor 2010 and the transfer roll 2050 serves as a transfer area. The transfer roll 2050 is supplied with transfer bias having an opposite polarity to a charging polarity of toner particle and a toner image formed on the photoreceptor surface 2110 by the toner image forming cycle is transferred to the recording paper P from the surface 2110 of the photoreceptor 2010. In the image forming apparatus 2001 of this embodiment, the surface of the recording paper P corresponds to a predetermined transfer object surface according to the present invention. Although the image forming apparatus 2001 shown in FIG. 1 adopts a direct transfer method using the transfer roll 2050, it is permissible to use a transfer corotron instead of the transfer roll 2050. Further, it is also permissible to adopt transfer belt method in which the recording paper P is carried by attacting eletctrostatically and a toner image is transferred to the photoreceptor. Additionally, intermediate transfer method using an intermediate transfer body such as intermediate transfer belt and intermediate transfer drum may be used.

The image forming apparatus shown in FIG. 12 includes a fixing device 2090 in the downstream of the transfer region in the direction of paper transportation. This fixing device 2090 has a fixing roll 2091 provided with heating mechanism and a pressure roll 2092 provided opposing the fixing roll 2091. The recording paper P after passing the transfer region is carried in between the fixing roll 2091 and the pressure roll 2092 which oppose each other. Toner constituting the toner image on the recording paper P is melted by the heating mechanism of the fixing roll 2091 and fixed on the recording paper P by receiving a pressure from the pressure roll 2092, so that an image composed of fixed toner image is formed.

On the other hand, residual toner not transferred to the recording paper P in the transfer region and additive particles which adhere to that residual toner exerting polishing effect are left on the surface 2110 after passing the transfer region of the photoreceptor 2010. Further, discharge product represented by $O_3$ or $NO_x$ adheres to the photoreceptor surface 2110 accompanying discharge phenomenon on the charger 2020 and this discharge product is left on the surface 2110 after passing the transfer region of the photoreceptor 2010. If a large amount of the discharge product is left on the photoreceptor surface 2110, the left discharge product is ion-bonded with water in the environment so that electric resistance of the photoreceptor 2010 drops, thereby inducing phenomenon such as so-called void image or image flow.

The cleaning unit 2070 shown in FIG. 12 is a unit for removing these residual matters and disposed in the downstream of the transfer region in the rotation direction of the photoreceptor (cyclic moving direction of the photoreceptor surface) and in the upstream of the charger 2020 in the rotation direction of the photoreceptor. This cleaning unit 2070 corresponds to an embodiment of the cleaning unit of the present invention. The before-cleaning charger 2061 and the before-cleaning neutralization unit 2062 are disposed before the cleaning unit 2070. Because residual toners having different polarities exist on the surface 2110 after passing the transfer region of the photoreceptor 2010, these residual toners having different polarities are adjusted to one polarity by the before-cleaning charger 2061 and the residual potential level on the photoreceptor surface is dropped by the before-cleaning neutralization unit 2062 so that the residual toner becomes easy to remove by the cleaning unit 2070.

The cleaning unit 2070 shown in FIG. 12 has a cleaning brush 2071, a collection roll 2072, a scraper member 2073, a waste toner carrying auger 2074 and a cleaning assistant member 2075. The cleaning brush 2071 has conductive feathers 2712 extending radiantly from the center axis 2711 extending in parallel to the rotation axis 2010*a* of the photoreceptor 2010. This cleaning brush 2071 rotates around the center axis 2711 with the front ends of the feathers 2712 biting into the photoreceptor surface 2110 and the peripheral face of the collection roll 2072. The cleaning brush 2071 is supplied with collection bias for attracting residual toner left on the photoreceptor surface 2110 and the residual toner is attracted by the feathers 2712 of the cleaning brush 2071 by an action of this collection bias and scraped by the feathers 2712. That is, the cleaning brush 2071 aims at removing residual toner left on the surface 2110 after passing the transfer region of the photoreceptor from the surface 2110 and corresponds to an example of the cleaning section according to the present invention. Further, the additive particles which are released from toner and left on the photoreceptor surface 2110 to exert the polishing effect are removed from the surface 2110 by the cleaning brush 2071. The cleaning brush 2071 suffers from a small deterioration of its cleaning performance with a time passage and is more advantageous in a high speed machine than using a plate-like cleaning blade. Further, because the cleaning brush 2071 shown in FIG. 12 is a cleaning type using positively electric field, it is advantageous for cleaning of spherical toner difficult to remove with a cleaning blade which scrapes mechanically without using electric effect. Residual toner and additive particle (hereinafter generally referred to as residual toner component) moved to the feathers 2712 of the cleaning brush 2071 are held by the feathers 2712 by an action of collection bias. The collection roll 2072 rotates around a center axis 2721 extending in parallel to the rotation shaft 2010*a* of the photoreceptor 2010 so as to collect residual toner held by the feathers 2712 of the cleaning brush 2071.. The scraper member 2073 scrapes residual toner component collected by the collection roll 2072 from the collection roll 2072. The residual toner component scraped by the scraper member 2073 is carried out of the cleaning unit 2070 by the waste toner carrying auger 2074.

The cleaning assistant member 2075 is disposed in the upstream more than that of the cleaning brush 2071 in the rotation direction of the photoreceptor. This cleaning assistant member 2075 is so constructed that multiple fine fibers 2752 are held by a holding member 2751 extending along the extension direction of the rotation axis 2010*a* of the photoreceptor 2010 and corresponds to an example of the fiber body according to the present invention. Each of the multiple fine fibers 2752 has a size of 10 μm or less and is in contact with the photoreceptor surface 2110. A surface of the cleaning assistant member 2075 which is in contact with the photoreceptor surface 2110 is in porous state by the multiple fine fibers 2752. The width of the cleaning assistant member 2075 (length in the rotation direction of the photoreceptor) is 1.5 mm or more and the fine fibers 2752 make contact with the photoreceptor surface with a width of 1.5 mm or more in the rotation direction of the photoreceptor. Because the cleaning assistant member 2075 is disposed in the upstream of the cleaning brush 2071 which removes residual toner, when the photoreceptor 2010 rotates, residual toner component is carried to the cleaning assistant member 2075. The residual toner component is caught and held by the fine fibers 2752 of the cleaning assistant member 2075. Adhering substance such as discharge product adhering to the photoreceptor surface 2110 and surface deteriorated layer of the photoreceptor 2010 accompanying discharge are scraped by the residual toner component held by the fine fibers 2752 from the photoreceptor surface 2110. The scraped discharge product and the like adhere to the residual toner component captured by the fine fibers 2752. Although in a cleaning blade of a conventional general cleaner, the residual toner component is likely to leave the contact portion easily thereby not improving polishing effect because its contact with the photoreceptor surface is a linear contact, because this cleaning assistant member 2075 makes contact with the photoreceptor surface 2110 over 1.5 mm in the rotation direction of the photoreceptor and further the face in contact with the photoreceptor surface 2110 of the cleaning assistant member 2075 is formed in porous state by the multiple fine fibers 2752, the captured residual toner component is held by that surface stably thereby exerting a sufficient polishing effect. Although the residual toner component is held by the cleaning assistant member 2075 stably, if new residual toner component is carried to the cleaning assistant member 2075, the residual toner component held by the cleaning assistant member 2075 is replaced with residual toner component carried newly and existing on the photoreceptor surface 2110 and part of the residual toner component held by the cleaning assistant member 2075 is returned to the photoreceptor surface 2110. The residual toner component returned to the photoreceptor surface 2110 moves to the cleaning brush 2071 located in the downstream when the photoreceptor 2010 rotates and is removed from the photoreceptor surface 2110 by the cleaning brush 2071. That is, the residual toner component captured by the cleaning assistant member 2075 with fine residues is finally removed from the photoreceptor surface 2110 by the cleaning brush 2071. Because according to this embodiment, the residual toner component captured by the fine fibers 2752 of the cleaning assistant member 2075 is replaced, the scraped substance is blocked from being saturated by the cleaning assistant member 2075.

Although not shown in FIG. 12, a cleaning unit 2060 of this embodiment includes a reciprocating mechanism 2076, a control portion 2077 and an environment detection sensor 2078.

Figure 13:
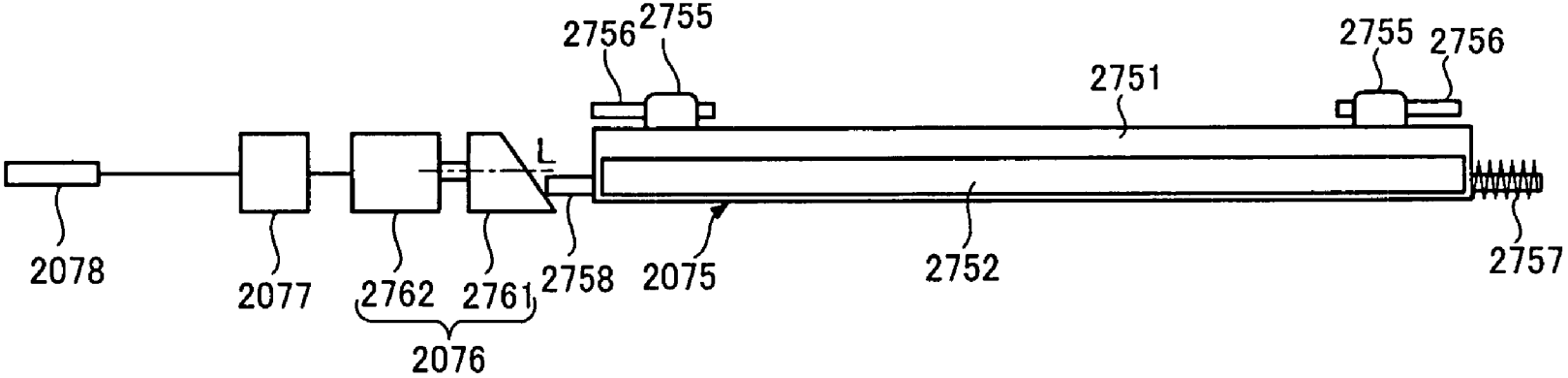
FIG. 13 is a diagram showing the reciprocating mechanism and control portion provided on the cleaning unit of the third embodiment.

FIG. 13 is a diagram showing the reciprocating mechanism and control portion possessed by the cleaning unit of this embodiment.

FIG. 13 shows the cleaning assistant member 2075 such that its extension direction is in the right and left direction of this Figure. Both sides in the length direction (right and left direction of FIG. 13) of the holding member 2751 of the cleaning assistant member 2075 shown in FIG. 13 are fixed to guides 2755 and a guide pin 2756 is inserted through each of the guides 2755. The cleaning assistant member 2075 is capable of reciprocating freely in the length direction of the cleaning assistant member 2075, that is, in the extension direction of the rotation axis 2010*a* of the photoreceptor 2010 (not shown) under a guide by the guide pins 2756. Although the length in the length direction of the cleaning assistant member 2075 shown in FIG. 13 is smaller than the length of an image formation maximum area of the photoreceptor surface 2110 (length in the extension direction of the rotation axis 2010*a* of the photoreceptor), that image formation maximum area is covered in the extension direction of the rotation axis 2010*a* of the photoreceptor when the cleaning assistant member 2075 reciprocates. The length in the length direction of the cleaning assistant member 2075 may agree with the length of the image formation maximum area of the photoreceptor surface 2110. A compression spring 2757 is disposed at an end (right end in FIG. 13) of the holding member 2751 so that the holding member 2751 is urged toward the other end (left end in FIG. 13). A projection pin 2758 is provided at the other end of the holding member 2751.

The reciprocating mechanism 2076 is shown on the left side of FIG. 2. This reciprocating mechanism 2076 reciprocates the cleaning assistant member 2075 and includes an inclined cam 2761 and a drive motor 2762 for rotating that inclined cam 2761. The projecting end of the projection pin 2758 provided on the holding member 2751 makes contact with a position eccentric from the rotation axis L of the inclined cam 2761 on a cam face of the inclined cam 2761 by an urging force of the compression spring 2757. Thus, when the inclined cam 2761 is rotated by the drive motor 2762, the cleaning assistant member 2075 is reciprocated in the right and left direction of FIG. 2. FIG. 13 shows a cleaning assistant member 2075 in a condition in which it is moved rightmost by the cam face of the inclined cam 2761 and when the inclined cam 2761 is rotated from this condition, the cleaning assistant member 2075 is moved leftward and after that, it returns to the condition shown in FIG. 13. As a result of such a reciprocation motion, the cleaning assistant member 2075 and the photoreceptor surface 2110 reciprocates relatively in the extension direction of the rotation axis 2010*a* of the photoreceptor drum 2010 so that the photoreceptor surface 2110 is rubbed swingingly by the cleaning assistant member 2075. This rubbing with swinging intensifies the scraping performance of the cleaning assistant member 2075 without pressing the cleaning assistant member 2075 against the photoreceptor surface 2110 strongly, so that fine residues are removed sufficiently. Further, the scraping performance by the cleaning assistant member 2075 is prevented from being unequal in the extension direction of the rotation axis 2010*a* of the photoreceptor drum 2010. Therefore, according to this embodiment, the fine residues are removed from the photoreceptor surface 2110 equally and sufficiently in the extension direction of the rotation axis 2010*a* of the photoreceptor drum 2010 for a long term.

A move distance (amplitude of reciprocation) of the cleaning assistant member 2075 by the reciprocating mechanism 2076 may be in a range of 2 mm-10 mm. If the move distance is 2 mm or less, no effect is found and if it is over 10 mm, the effect remains the same and an increase of the size of the cleaning unit 2070 is induced. The speed of reciprocation of the cleaning assistant member 2075 by the reciprocating mechanism 2076 may be in a range of 0.5 reciprocation to 20 reciprocations and more preferably, in a range of 1 reciprocation to 10 reciprocations. If the speed is smaller than 0.5 reciprocation, no sufficient effect is found and if it exceeds 20 reciprocations, even the cleaning assistant member 2075 which holds residual toner component stably in the fine fibers 2752 becomes incapable of holding the residual toner component due to vibration from the rubbing motion or deterioration of the fine fibers 2752 is induced. Further, if it is non-integer times in a range of 0.5 reciprocation to 20 reciprocations with respect to a single rotation of the photoreceptor drum 2010 and the rubbing with the photoreceptor is made non-synchronous/at random, uniformity of polishing of the photoreceptor drum 2010 can be improved. It is permissible to use a direct actuating motor instead of a combination of the inclined cam 2761 and the drive motor 2762. Although the cleaning assistant member 2075 is reciprocated by the reciprocating mechanism 2076 because of ease of control, it is permissible to reciprocate the photoreceptor 2010 in the extension direction of the rotation axis 2010*a* with the cleaning assistant member 2075 kept at a predetermined position or reciprocate both the cleaning assistant member 2075 and the photoreceptor 2010 in the extension direction with a deflection in their timings.

If the cleaning assistant member 2075 executes its reciprocation, transmission of vibration to the photoreceptor 2010 is unavoidable and if the reciprocation is executed during an execution of the toner image forming cycle, there is a fear that when laser beam is irradiated by the exposure unit 2030, the position of a spot of laser beam is deflected by vibration by the reciprocation so that distortion may occurs in electrostatic latent image. Thus, the reciprocating mechanism 2076 shown in FIG. 13 executes this reciprocation while the toner image forming cycle is not executed. The period in which the toner image forming cycle is not executed includes a rise-up time after the image forming apparatus is powered on, a last cycle time of image forming job, inter-image between formation of images, following cycle time after image forming job, stop of rotation of the photoreceptor 2010 and a lapse of a predetermined time after the power is turned off. The reciprocation may be executed at the rise-up time after the image forming apparatus is powered on, the last cycle time of image forming job or when the rotation of the photoreceptor is stopped after the last cycle because an influence of the image forming speed is small.

The environment detecting sensor 2078 shown in FIG. 13 detects humidity and temperature within the image forming apparatus. The control portion 2077 shown in FIG. 13 stops the charging action of the charger 2020 shown in FIG. 12 while the cleaning assistant member 2075 is reciprocating. Because the charger 2020 is a generation source of the discharge product, residual percentage of discharge product on the surface 2110 passing the cleaning brush 2071 of the photoreceptor 2010 is dropped further when the control portion 2077 stops the charging action of the charger 2020. Further, the control portion 2077 controls the speed and amplitude of the reciprocation of the cleaning assistant member 2075 based on a detection result of the environment detection sensor 2078. That is, the control portion 2077 controls the rotation speed, direction and angle of the drive motor 2762. The scratch performance of the cleaning assistant member 2075 is adjusted by this control portion 2077 so that wearing and flaw which may be generated in the photoreceptor surface 2110 by excessive scratch and deterioration of fine fibers of the cleaning assistant member 2075 are suppressed. That is, an excessive scratch is prevented when the control portion 2077 reduces the reciprocation speed or amplitude of the reciprocation. On the contrary, when a high scratch performance is needed, the control portion 2077 rises the reciprocation speed or increases the amplitude of the reciprocation. Image flow originated from discharge product is likely to be generated under high humidity condition and a high scratch performance under a high humidity condition is needed most. Electrostatic adhesion contributes to holding of the residual toner component by the fine fibers 2712 and because the electrostatic adhesion drops under high temperature/high humidity condition, the scratch performance of the cleaning assistant member 2075 is inclined to drop. A first predetermined value which indicates that the image forming apparatus 2001 is under the high temperature/high humidity condition is set in the control portion 2077 and the control portion 2077 determines whether or not a detection result of the environment detection sensor 2078 exceeds this first predetermined value. If the detection result exceeds the first predetermined value, the rotation speed is raised by continuing a normal rotation of the drive motor 2762. Consequently, the speed of the reciprocation of the cleaning assistant member 2075 is intensified so that its amplitude reaches its maximum.

On the other hand, the electrostatic adhesion increases under low temperature/low humidity and further the elastic modulus of the holding member 2751 rises so that the scratch performance of the cleaning assistant member 2075 is excessively intensified. A second predetermined value is set in the control portion 2077 to indicate that the inside of the image forming apparatus 2001 is under the low temperature/low humidity and the control portion 2077 determines whether or not a detection result of the environment detection sensor 2078 is below this second predetermined value. If the detection result is below the second predetermined value, the rotation of the rotation axis is inverted before the rotation axis of the drive motor 2762 rotates by a single turn to reduce the rotation speed. That is, by rotating the drive motor 2762 in the normal/reverse directions with the rotation angle of the rotation axis thereof suppressed to less than 360°, only part of the cam face of the inclined cam 2761 is used thereby reducing the amplitude of the reciprocation of the cleaning assistant member 2075. Further, by reducing the rotation speed of the drive motor 2762, the speed of the reciprocation of the cleaning assistant member 2075 is retarded.

By executing the above-described control with the control portion 2077, a high image quality can be maintained for a long term and the service lives of both the photoreceptor 2010 and the cleaning assistant member 2075 can be extended even if the image forming apparatus 2001 of this embodiment is used under any environment.

Although here the environment detection sensor 2078 detects both the humidity and temperature within the image forming apparatus and the control portion 2077 executes control based on both the humidity and temperature which are detection results of the environment detection sensor 2078, the environment detection sensor 2078 may detect only any one of the humidity and temperature within the image forming apparatus and the control portion 2077 may execute control based on any one parameter detected by that environment detection sensor 2078. The control portion 2077 may calculate an absolute amount of water in the image forming apparatus using a detection result of the environment detection sensor 2078 and execute the control based on that absolute amount of water. Further, the control portion 2077 may have tables for both temperature and humidity and control the speed and amplitude of reciprocation by combining preliminarily determined conditions.

The size of fiber constituting the fine fiber 2712 of the cleaning assistant member 2075 may be 1 μm or 10 μm or less and more preferably, 2 μm or 8 μm or less. If the size of the fiber exceeds 10 μm, uniform holding performance of the residual toner component drops and separation from the fine fibers or burying into the fibers of the residual toner components are likely to occur at the time of rubbing with swing, thereby reducing refresh performance of the photoreceptor due to the rubbing with swing. On the contrary, if it is thinner than 1 μm, the fibers are likely to be damaged due to stress by rubbing with swing. Further, if the contact width of the cleaning assistant member 2075 with the photoreceptor surface 2110 increases too much, the residual toner component becomes likely to be removed from the fine fibers because of mechanical stimulus at the time of the rubbing with swing. Thus, the contact width is preferred to be 10 mm or less from viewpoints of increased size of the image forming apparatus although there is no any special limitation in the upper limit of the contact width. As material of the fine fiber 2712, for example, polyester base fiber, nylon base fiber, polyamide base fiber, polyolefin base fiber, acrylic base fiber or composite fiber using resin of each synthetic fiber, semi-synthetic fiber such as acetate base fiber, regenerated fiber such as rayon and the like may be used. As a method for processing these fine fibers into a sheet-like form, a method of constituting secondary material by knitting the fibers and a method of creating cloth directly from fibers are available and in the latter method, fibers are bonded to each other or entangled with each other mechanically into the sheet-like form and this is called unwoven cloth. Although any method may be used, the unwoven cloth is more preferable in the viewpoint that the strength of the sheet and density of the fine fibers are high thereby providing an excellent flexibility and toner can be held excellently between the fibers.

The holding member 2751 may be used as a backup material for the fine fibers 2712 and the fine fibers 2712 may be bonded to the surface of the holding member 2751 such that the surface is pressed to the photoreceptor surface 2110 at a predetermined pressure. As the holding member 2751, foamed urethane, urethane rubber, silicone rubber and other elastic body may be used. The shape of the back-up material of the fine fiber 2712 is not limited to any particular one but may be of any shape as long as it has a width of 1.5 mm or more in the cyclic move direction of the photoreceptor surface. The pressure by which the holding member 2751 presses the fine fibers 2752 to the photoreceptor surface 2110 may be in a range of 4.9 to 58.8 mN/mm. A more preferable range is 9.8 to 39.2 mN/mm. If the pressing pressure is lower than 4.9 mN/mm, no sufficient rubbing function can be exerted and if it is higher than 58.8 mN/mm, the fine fibers 2752 and the photoreceptor 2010 are deteriorated because the rubbing with the photoreceptor drum 2010 is too strong, and further, filming or the like is induced.

Subsequently, the photoreceptor which can be used for the photoreceptor drum shown in FIG. 12 will be described in detail.

Figure 14:
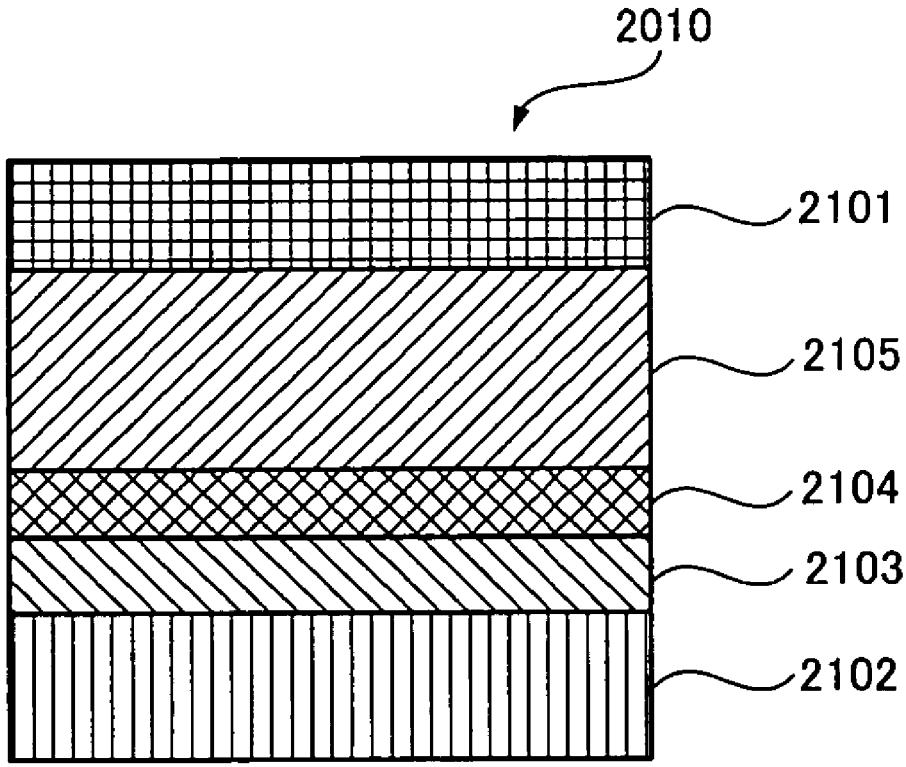
FIG. 14 is a schematic diagram showing the sectional structure of a photoreceptor shown in FIG. 12.

FIG. 14 is a schematic diagram showing the sectional view of the photoreceptor drum shown in FIG. 12.

FIG. 14 shows foundation layer 2103 formed on the surface of conductive supporting body 2102, charge generating layer 2104 formed on the surface of the foundation layer 2103, charge transportation layer 2105 formed on the surface of the charge generating layer 2104 and protective layer 2101.

The conductive supporting body 2102, the foundation layer 2103, the charge generating layer 2104, the charge transportation layer 2105 and the protective layer 2101 of the photoreceptor 2010 shown in FIG. 14 correspond to the conductive supporting body 1112, the foundation layer 1113, the charge generating layer 1114, the charge transportation layer 1115 and the protective layer 1111 of the photoreceptor 1011 (see FIG. 5). Thus, the detailed description of the protective layer 2101 is omitted because it duplicates.

Subsequently, the schematic structure of the image forming apparatus of the fourth embodiment will be described. Like reference numerals are attached to components having the same designation as the image forming apparatus shown in FIG. 12 and a duplicated description is omitted.

Figure 15:
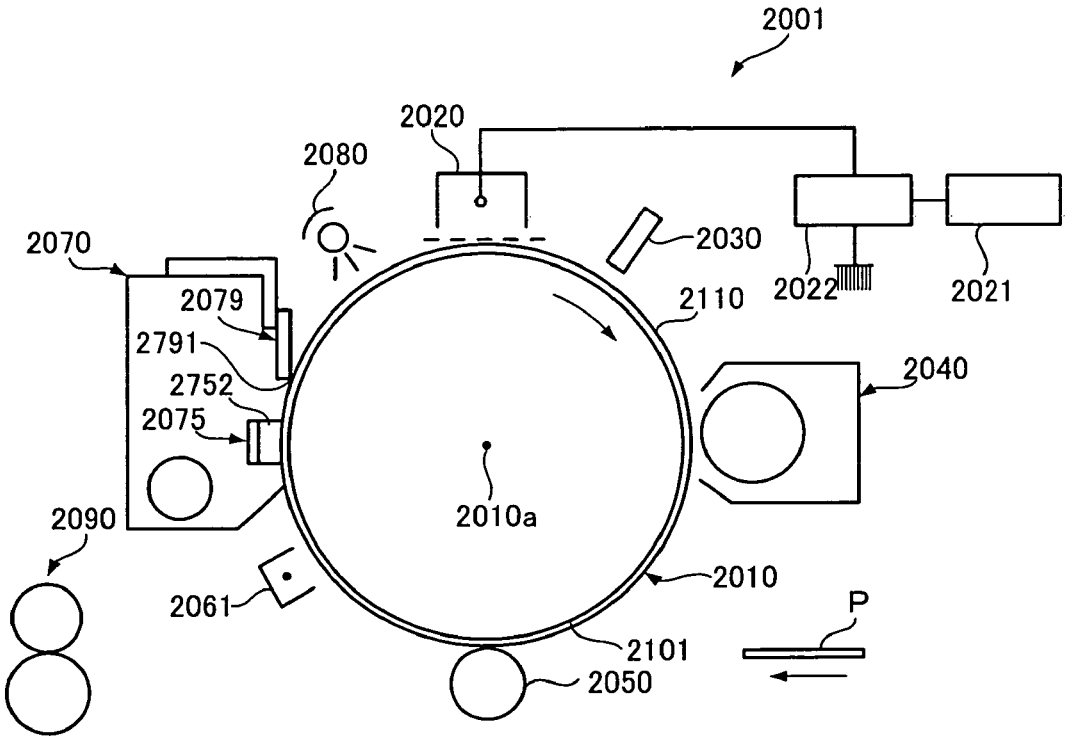
FIG. 15 is a diagram showing the schematic structure of an image forming apparatus according to a fourth embodiment of the present invention.

FIG. 15 is a diagram showing the schematic structure of the image forming apparatus of the fourth embodiment.

If including the image forming apparatus shown in FIG. 12 with the image forming apparatus shown in FIG. 15, the structure of the cleaning unit 2070 is different. That is, although in the cleaning unit of the image forming apparatus shown in FIG. 12, the cleaning brush 2071 is disposed in the downstream of the cleaning auxiliary member 2075, a plate-like cleaning blade 2079 is disposed instead of the cleaning brush 2071 in the cleaning unit 2070 of the image forming apparatus shown in FIG. 15. The cleaning blade 2079 is extended in the extension direction of the rotation axis 2010*a* of the photoreceptor 2010 with a front edge portion 2791 kept in contact with the surface 2110 of the photoreceptor 2010. This cleaning blade 2079 scrapes residual toner left on the surface 2110 of the photoreceptor 2010 and additive agent particles (residual toner component) separating from the toner mechanically without using electric effect when the photoreceptor 2010 rotates. Thus, the cleaning unit 2070 shown in FIG. 15 is not a cleaning unit using electric field positively. Thus, the before-cleaning neutralization unit 2062 shown in FIG. 12 which is disposed in front of the cleaning unit 2070 is omitted from the image forming apparatus 2001 shown in FIG. 15.

In the image forming apparatus shown in FIG. 15, the same cleaning assistant member 2075 as the cleaning assistant member shown in FIG. 12 and the same reciprocating mechanism as the reciprocating mechanism shown in FIG. 13 (not shown in FIG. 15) are disposed and the cleaning blade 2079 corresponds to an example of the cleaning section according to the present invention. Because the fine fibers 2752 is disposed in the upstream of the cleaning blade 2079 which finally removes the residual toner component left on the photoreceptor surface 2110 after transfer such that it is kept in a firm contact with the photoreceptor surface 2110, residual toner component before removal is supplied to/held by the finer fibers 2752 and by rubbing the photoreceptor surface 2110 with the held residual toner component by swing, fine residues such as discharge product and filming substance and surface deteriorated layer of the photoreceptor 2010 accompanying discharge can be removed uniformly. Particularly by reciprocating the cleaning assistant member 2075 even if unevenness occurs in holding of the residual toner component in the fine fibers 2752, the uniformity of removal performance can be improved by the dispersion effect at a rubbing place of the fine fibers 2752 of the photoreceptor surface 2110 (rubbing with plural portions of the fine fibers) and an effect that the residual toner component held by the fine fibers 2752 is rubbed by swing so that it is equalized.

In the meantime, as a cleaning means for removing residual toner component such as cleaning brush and cleaning blade, a well known cleaning means such as a magnetic brush can be used.

Although an example of cleaning the photoreceptor 2010 has been described above, the cleaning unit of the present invention can be applied to a cleaning unit for an intermediate transfer body. Discharge product adheres to the intermediate transfer body by discharge of peeling of paper generated upon the secondary transfer. Thus, the cleaning unit which removes discharge product from the intermediate transfer body by reciprocating the fine fibers holding residual toner component left without secondary transfer and the intermediate transfer surface relatively is effective.

EXAMPLES

Although the present invention will be described specifically based on examples and comparative examples below, the present invention is not restricted to the following embodiments. In the meantime, a "part" means a "weight part" unless specified otherwise.

[Manufacturing of Photoreceptor B]

30 weight part of organic zirconium compound (acetylacetonezirnoniumbuthylate) and 3 weight part of organic silane compound (γ-aminopropyltrimethoxy silane) were added to 170 weight part of n-butyl alcohol in which 4 weight part of polyvinyl butyral resin (ESUREKKU BM manufactured by SEKISUI KAGAKU CORP.) was dissolved and mixed by agitation so as to obtain coating solution for foundation layer formation. This coating solution was applied to an aluminum supporting body having an outside diameter of 84 mm whose surface was roughed by honing processing by dipping and dried for 5 minutes under a room temperature by blowing. After that, the supporting body was heated up to 50 ° C. in ten minutes, taken into a constant temperature/constant humidity bath of 50° C. and 85% RH (dew point: 47° C.) and subjected to hardening acceleration treatment by wetting for 20 minutes. After that, it was dried at 170° C. in a hot wind drier for 10 minutes so as to form the foundation layer.

As the charge generating material, a mixture of 15 weight parts of chloride gallium phthalocynanine, 10 weight parts of vinyl chloride-vinyl acetate copolymer resin (VMCH, manufactured by NIPPON UNION CARBIDE CORP.) and 300 weight parts of n-butyl alcohol was dispersed with a sand mill for 4 hours. The obtained dispersion solution was applied to the foundation layer by dipping and dried so as to form charge generation layer 0.3 μm in thickness. Next, coating solution obtained by dissolving and mixing 40 parts of N,N'-bis (3-methyl phenyl)-N,N'-diphenyl benzidine and 60 weigh parts of bisphenol Z polycarbonate resin (molecular weight: 40,000) in 230 weight parts of tetrahydrofuran and 100 weight parts of monochlorobenzene sufficiently was applied to the charge generation layer by dipping and dried at 130° C. for 40 minutes so as to form charge transportation layer 25 μm in thickness. The obtained photoreceptor was used as photoreceptor B. The surface of the photoreceptor B is constituted of the charge transportation layer.

[Manufacturing of Photoreceptor C]

Protective layer formation coating solution was obtained by dissolving two parts of the aforementioned compound 1, two parts of REJITOP PL4852 (manufactured by GUNEI KAGAKU CORP.) and 10 parts of isopropyl alcohol. This protective layer formation coating solution was applied to the charge transportation layer of the photoreceptor manufactured in the same way as the photoreceptor B by dipping and dried by blowing at a room temperature for 30 minutes. After that, it was dried at 140° C. for 45 minutes so as to form protective layer 4 μm in thickness. The obtained photoreceptor was used as photoreceptor C. That is, the surface of the photoreceptor C is constituted of protective layer.

Example 9

As a test machine, a FUJI XEROX Co., Ltd. DocuCenter 1010 reconstructed to an image forming apparatus as shown in FIG. 12 was used. That is, the photoreceptor B whose surface was constituted of charge transportation layer was incorporated in the photoreceptor. As a cleaning unit, a cleaning unit shown in FIG. 12 including cleaning brush, collection roll, scraper member, cleaning assistant member and reciprocating mechanism was used. Its detail is shown below.

(1) Cleaning Brush

Brush material: conductive nylon, fiber size: 2 denier (approximately 17 μm), electric resistance: 1×108Ω, fiber length: 3 mm, fiber density: 120,000 /inch$^2$, amount of biting into photoreceptor: approximately 0.75 mm, peripheral speed: 60 mm/s, rotation direction: opposite direction to rotation direction of photoreceptor, brush application bias: +250 V (2) Collection Roll Material: phenol resin in which conductive carbon is dispersed, electric resistance: $1\times10^8\Omega$, bending elastic modulus (JIS K7203): 100 MPa, abrasion amount (JIS K6902): 2 mg, Rockwell International hardness (JIS K7202, M scale): 120, amount of biting into cleaning brush: 1.0 mm, peripheral velocity: 70 mm/s, rotation direction: same direction as rotation direction of cleaning brush, application bias: +640 V (3) Scraper Member Material: SUS304, thickness: 80 μm, amount of biting into collection roll: 1.3 mm, free length: 8.0 mm (4) Cleaning Assistant Member Unwoven fabric (polyester/nylon, manufactured by HIPPON BAIRINWP8085) having a fiber diameter (size) of 6 μm manufactured according to water flow entangling method as fine fiber fabric was bonded to pad-like foamed urethane 3 mm high prepared as a holding member and the amount of biting into the photoreceptor was set to 1.5 mm. The pressure of the cleaning assistant member to the photoreceptor surface was set to 19.6 mN/mm under a measuring environment at 25° C. The contact width of the cleaning assistant member in the rotation direction of the photoreceptor was set to 5 mm.

(5) Reciprocating Mechanism

A reciprocating mechanism including an inclined cam and a rotation motor as shown in FIG. 13 was replaced with a direct actuating motor so as to enable the speed and amplitude of the reciprocation to be controlled freely from outside. The cleaning assistant member was allowed to always reciprocate when the toner image formation cycle is not executed as well as when the toner image formation cycle is being executed. The amplitude of the reciprocation is 5 mm and the speed was set to a speed that allowed the cleaning assistant member to reciprocate 2.9 times while the photoreceptor rotated a single turn. The specification of the image forming apparatus used here is shown in Table 3.

TABLE 3

| | fine fiber fabric fiber diameter | fine fiber fabric contact width | reciprocation condition | photoreceptor |
|---|---|---|---|---|
| example 9 | 6 μm | 5 mm | fix at amplitude 5 mm, 2.9 reciprocations/single turn of photoreceptor | photoreceptor B |
| example 10 | 6 μm | 5 mm | fix at amplitude 5 mm, 2.9 reciprocations/single turn of photoreceptor | photoreceptor C |
| example 11 | 6 μm | 4 mm | amplitude 5 mm, 2.9 reciprocations/single turn of photoreceptor (toner image formation cycle)<br>amplitude 5 mm, 10 reciprocations/single turn of photoreceptor<br>(toner image non-formation cycle→post cycle) | photoreceptor C |
| example 12 | 6 μm | 4 mm | amplitude 5 mm, 2.9 reciprocations/single turn of photoreceptor (toner image formation cycle)<br>amplitude 10 mm, 2.9 reciprocations/single turn of photoreceptor<br>(toner image non-formation cycle→post cycle) | photoreceptor C |
| example 13 | 6 μm | 5 mm | amplitude 5 mm, 2.9 reciprocations/single turn of photoreceptor (toner image formation cycle)<br>amplitude 10 mm, 10 reciprocations/single turn of photoreceptor<br>(toner image non-formation cycle→early in the morning) | photoreceptor C |
| example 14 | 6 μm | 5 mm | amplitude 5 mm, 1.5 reciprocations/single turn of photoreceptor<br>(low temperature low humidity condition)<br>amplitude 5 mm, 2.9 reciprocations/single turn of photoreceptor<br>(high temperature high humidity condition) | photoreceptor B |
| example 15 | 6 μm | 5 mm | amplitude 5 mm, 1.5 reciprocations/single turn of photoreceptor<br>(low temperature low humidity condition)<br>amplitude 7 mm, 2.9 reciprocations/single turn of photoreceptor<br>(high temperature high humidity condition) | photoreceptor C |
| example 16 | 6 μm | 1.4 mm | amplitude 5 mm, 1.5 reciprocations/single turn of photoreceptor<br>(low temperature low humidity condition)<br>amplitude 7 mm, 2.9 reciprocations/single turn of photoreceptor<br>(high temperature high humidity condition) | photoreceptor C |

TABLE 3-continued

| | fine fiber fabric fiber diameter | fine fiber fabric contact width | reciprocation condition | photoreceptor |
|---|---|---|---|---|
| example 17 | 3 μm | 4 mm | amplitude 5 mm, 1.5 reciprocations/single turn of photoreceptor (low temperature low humidity condition) amplitude 7 mm, 2.9 reciprocations/single turn of photoreceptor (high temperature high humidity condition) | photoreceptor C |
| example 18 | 11 μm | 4 mm | amplitude 5 mm, 1.5 reciprocations/single turn of photoreceptor (low temperature low humidity condition) amplitude 7 mm, 2.9 reciprocations/single turn of photoreceptor (high temperature high humidity condition) | photoreceptor C |
| example 19 | 2 μm | 5 mm | amplitude 5 mm, 1.5 reciprocations/single turn of photoreceptor (low temperature low humidity condition) amplitude 7 mm, 2.9 reciprocations/single turn of photoreceptor (high temperature high humidity condition) | photoreceptor C |
| comparative example 7 | none | none | no reciprocation | photoreceptor B |
| comparative example 8 | none | none | no reciprocation | photoreceptor C |
| comparative example 9 | 20 μm | 4 mm | no reciprocation | photoreceptor C |
| comparative example 10 | 6 μm | 1 mm | no reciprocation | photoreceptor C |

Durability test was carried out with 100,000 pieces under low temperature/low humidity (10° C., 20% RH) and high temperature/high humidity (28° C., 80% RH) using the developing agent product of Docu-Center Color 500 as developing agent in the above-described image forming apparatus so as to evaluate abrasion and flaws on the photoreceptor (photoreceptor roughness). Further, generation of filming under low temperature/low humidity was evaluated and image flow under high temperature/high humidity was evaluated. These results are shown in Table 4 with synthetic evaluation.

The detail of each evaluation is as follows.

[Amount of Abrasion of Photoreceptor]

The abrasion of the photoreceptor was evaluated according to a difference obtained by measuring the thickness of the photoreceptor before and after a test with an eddy current type film thickness gauge under each test environment. Table 4 shows the amount of abrasion per 1000 turns of the photoreceptor.

TABLE 4

| | low temperature low humidity condition | | | high temperature high humidity condition | | | |
|---|---|---|---|---|---|---|---|
| | photoreceptor abrasion amount (nm/1000 turns) | Photoconductor roughness | filming | photoreceptor abrasion amount (nm/1000 turns) | Photoconductor roughness | image flow | total evaluation |
| example 9 | 17.8 | g | Vg | 12.5 | Vg | Vg | g |
| example 10 | 4.0 | Vg | Vg | 2.0 | Vg | g | g |
| example 11 | 4.2 | Vg | Vg | 1.9 | Vg | Vg | g |
| example 12 | 4.1 | Vg | Vg | 2.1 | Vg | Vg | g |
| example 13 | 3.9 | Vg | Vg | 2.1 | Vg | Vg | g |
| example 14 | 10.2 | Vg | Vg | 12.3 | Vg | Vg | g |
| example 15 | 2.6 | Vg | Vg | 2.4 | Vg | Vg | g |
| example 16 | 2.4 | Vg | g | 2.3 | Vg | g | g |
| example 17 | 2.2 | Vg | Vg | 2.1 | Vg | Vg | g |
| example 18 | 1.9 | Vg | g | 1.7 | Vg | g | g |
| example 19 | 3.9 | Vg | Vg | 2.0 | Vg | Vg | g |
| comparative example 7 | 7.1 | p | p | 5.0 | p | p | p |
| comparative example 8 | 0.8 | Vg | p | 0.5 | Vg | Vp | p |
| comparative example 9 | 1.2 | Vg | p | 0.9 | Vg | Vp | p |
| comparative example 10 | 0.7 | Vg | g | 0.8 | Vg | Vp | p |

[Flaw on Photoreceptor]

Flaw on photoreceptor was evaluated by measuring average roughness (Rz) of 10 points using a surface roughness gauge (Surfcom1400A manufactured by TOKYO SEIMITSU Co., Ltd.). The smaller the value of Rz, the fewer the flaws on the photoreceptor.

The standard for evaluation is as follows.

Very good (Vg): Rz is less than 1.5 μm

Good (g): Rz is 1.5 μm or more to 2.5 μm or less (level having no problem in quality)

Poor (p): Rz is 2.5 μm or more (white streak generated on image)

[Filming]

Visual sensory assessment was carried out by observing to see whether or not any substance adheres to the photoreceptor after the durability test under low temperature/low humidity (10° C., 20% RH). A half tone image with image density of 30% was collected and sensory assessment was carried out to see whether or not there was any influence on its image quality. The evaluation standard is as follows.

Very good (Vg): no adhering substance on photoreceptor or an image

Good (g): although substance adheres to photoreceptor, no substance exist on an image.

Poor (p): adhering substance on photoreceptor and an image.

[Image Flow]

After left for 12 hours each time when 20,000 sheets of paper were printed under high temperature/high humidity (28° C., 80% RH), only part of the photoreceptor surface was wiped with water to remove water soluble discharge product. After that, a half tone image was printed and a difference in density (ΔSAD) of portions corresponding to a portion of the photoreceptor surface wiped with water and a portion thereof not wiped with water was measured with a reflection type density measuring machine (X-rite) and its measurement result was evaluated according to a following standard. The smaller the value of the ΔSAD, the less likely the image flow is generated. In the meantime, the image flow of the half tone image was evaluated with a half tone image based on a ten-thousand line screen containing 300 lines and with image density of 30% in order to improve the detection accuracy for the image flow.

Very good (Vg): ΔSAD is 0.15 or less.

Good (g): ΔSAD is 0.15 or less than 0.3.

Poor (p): ΔSAD is 0.3 or less than 0.4.

Very poor (Vp): ΔSAD is 0.4 or more.

Example 10

The same test and evaluation as the example 9 were executed using the same image forming apparatus (see Table 3) as the example 9 except the photoreceptor was replaced with a photoreceptor C whose surface was constituted of the protective layer.

Example 11

The same test and evaluation as the example 9 were executed using the same image forming apparatus (see Table 3) as the example 2 except that the contact width of the cleaning assistant member in the rotation direction of the photoreceptor was changed to 4 mm, the cleaning assistant member was reciprocated at such a speed which makes the same cleaning assistant member to execute 2.9 reciprocations while the photoreceptor made a single turn with the amplitude of the reciprocation as 5 mm during execution of the toner image formation cycle and while the amplitude was set equal to that during the execution of the toner image formation cycle in post cycle for every 500 sheets of paper, the speed was accelerated to such a state in which the cleaning assistant member makes 10 reciprocations while the photoreceptor makes a single turn so that it continued to reciprocate until the photoreceptor made 30 turns. Its result is shown in Table 4.

Example 12

The same test and evaluation as the example 9 were executed using the same image forming apparatus as the example 11 except that the cleaning member was reciprocated until the photoreceptor made 30 turns, with amplitude extended to 10 mm although the speed was set equal to that during execution of the toner image formation cycle in post cycle for every 500 sheets of paper. Its result is shown in Table 4.

Example 13

The same test and evaluation as the example 9 were executed using the same image forming apparatus as the example 12 except that the contact with of the cleaning assistant member in the rotation direction of the photoreceptor was changed to 5 mm, and the cleaning assistant member was reciprocated until the photoreceptor made 200 turns with an amplitude width of its reciprocation set to 10 mm and the speed set to such one which allows the cleaning assistant member to make 10 reciprocations while the photoreceptor makes a single turn only in the morning (at the time of rise-up after the image forming apparatus is powered on) after it was run under the same condition as the example 10 and left, instead of during the execution of the post cycle. Its result is shown in Table 4.

Example 14

The same test and evaluation as the example 9 were executed using the same image forming apparatus (see Table 3) as the example 9 except that the cleaning assistant member was reciprocated with the amplitude of the reciprocation dropped to 5 mm and its speed dropped to a speed which allowed the cleaning assistant member to make 1.5 reciprocations while the photoreceptor makes a single turn under low temperature/low humidity based on a detection result of an environment detecting sensor and further the cleaning assistant member was always reciprocated with the amplitude of the reciprocation equal to that under low temperature/low humidity and the speed raised to a speed which allowed the cleaning assistant member to make 2.9 reciprocaitons while the photoreceptor makes a single turn under high temperature/high humid. Its result is shown in Table 4.

Example 15

The same test and evaluation as the example 9 were executed using the same image forming apparatus (see Table 3) as the example 14 except that the photoreceptor was replaced with a photoreceptor C whose surface was constituted of the protective layer and the cleaning assistant member was always reciprocated with the amplitude of the reciprocation extended to 7 mm under high temperature/high humidity environment. Its result is shown in Table 4.

Example 16

The same test and evaluation as the example 9 were executed using the same image forming apparatus (see Table 3) as the example 15 except that the contact width of the cleaning assistant member in the rotation direction of the photoreceptor was changed to 1.4 mm. Its result is shown in Table 4.

Example 17

The same test and evaluation as the example 9 were executed using the same image forming apparatus (see Table 3) as the example 16 except that the cleaning assistant member was replaced with one using unwoven fabric having a fiber diameter of 3 μm and the contact width of the cleaning assistant member in the rotation direction of the photoreceptor was changed to 4 mm. Its result is shown in Table 4.

Example 18

The same test and evaluation as the example 9 were executed using the same image forming apparatus (see Table 3) as the example 17 except that the cleaning assistant member was replaced with one using unwoven fabric having a fiber diameter of 11 μm. Its result is shown in Table 4.

Example 19

The same test and evaluation as the example 9 were executed using the same image forming apparatus (see Table 3) as the example 15 except that the cleaning assistant member was replaced ultra fine fiber fabric, TORACY (manufactured by Toray Industries. Inc) having a fiber diameter of 2 μm. Its result is shown in Table 4.

Comparative Example 7

The same test and evaluation as the example 9 were executed using the same image forming apparatus (see Table 3) as the example 9 except that the cleaning assistant member and reciprocating mechanism were removed from the cleaning unit. Its result is shown in Table 4.

Comparative Example 8

The same test and evaluation as the example 9 were executed using the same image forming apparatus (see Table 3) as the comparative example 7 except that the cleaning assistant member was replaced with a photoreceptor C whose surface was constituted of the protective layer. Its result is shown in Table 4.

Comparative Example 9

The same test and evaluation as the example 9 were executed using the same image forming apparatus (see Table 3) as the example 11 except that the cleaning assistant member was replaced with one using unwoven fabric (cellulose fiber, 8830CR manufactured by Japan Vilene Company. Ltd) and the reciprocating mechanism was removed from the cleaning unit. Its result is shown in Table 4.

Comparative Example 10

The same test and evaluation as the example 9 were executed using the same image forming apparatus (see Table 3) as the example 10 except that the contact width of the cleaning assistant member in the rotation direction of the photoreceptor was changed to 1 mm and the reciprocating mechanism was removed from the cleaning unit. Its result is shown in Table 4.

In all the comparative examples, the reciprocating mechanism was removed from the cleaning unit, so that the rubbing with swing of the cleaning assistant member was canceled. As a result, filming occurred except in the comparative example 10 under a low temperature/low humidity environment and image flow occurred in all the comparative examples under a high temperature/high humidity environment. Particularly, even in the comparative examples 9, 10 provided with the cleaning assistant member, the image flow occurred under high temperature/high humidity environment. It can be considered that this image flow occurred because the removal of the discharge product was insufficient and then left discharge product absorbed moisture. Contrary to this, in all the examples, the rubbing with swing of the cleaning assistant member was carried out by the reciprocating mechanism. In each example, generations of filming under the low temperature/low humidity environment and the image flow under the high temperature/high humidity are suppressed. Therefore, it can be said that the removal of the discharge product was insufficient only if the cleaning assistant member was just disposed and fine residues such as discharge product and additives cannot be removed sufficiently in long periods until the cleaning assistant member is reciprocated so as to execute the rubbing with swing.

If analyzing the respective examples in detail, abrasion and flaws of the photoreceptor are suppressed in the examples using the photoreceptor C provided with the protective body as compared with the examples 9 and 14 using the photoreceptor B provided with no protective layer. Thus, it is preferable to use a photoreceptor having the protective layer. As compared with the example 10 which always executed rubbing with swing under the same reciprocating condition, the examples 11-13 containing control cycle such as post cycle after intensifying the scraping capacity by increasing the amplitude or speed succeeded have suppressed generation of image flow under a high temperature/high humidity environment. From this result, it can be said that the discharge product can be removed sufficiently in long periods by introducing a control cycle in which the scraping capacity is intensified by increasing the amplitude or speed. Further, generations of filming and image flow are suppressed in the example 15 in which the contact width was set to 1.5 mm or more as compared with the example 16 in which the contact width of the cleaning assistant member in the rotation direction of the photoreceptor was set to 1.4 mm and it is preferable that the contact width is set to 1.5 mm or more. Further, generations of filming and image flow are suppressed in the example 17 in which the fiber diameter was set to 10 μm or less as compared with the example 18 in which the fiber diameter (size) of the cleaning assistant member was set to 11 μm and it is preferable that the fiber diameter (size) is set to 10 μm or less.

Next, the embodiment of the third cleaning unit and the third image forming apparatus of the present invention will be described.

Figure 16:
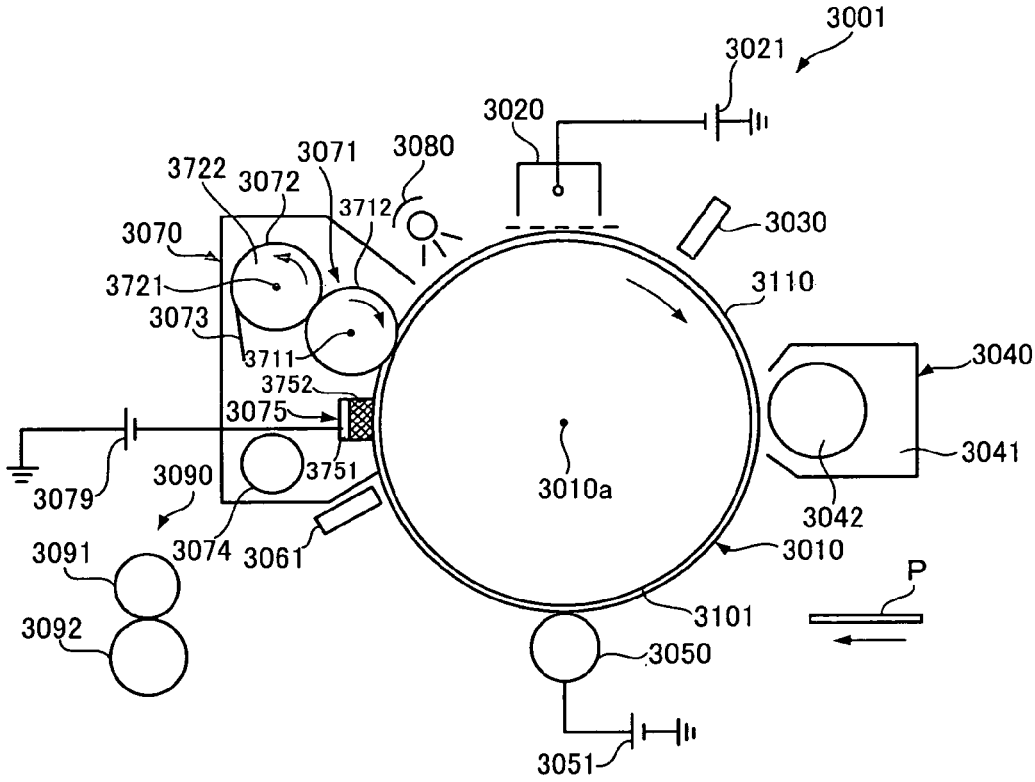
FIG. 16 is a diagram showing the schematic structure of an image forming apparatus according to a fifth embodiment of the present invention.

FIG. 16 is a diagram showing the schematic structure of an image forming apparatus according to a fifth embodiment of the present invention.

An image forming apparatus 3001 shown in FIG. 16 includes a drum-like photoreceptor 3010 which rotates in a clockwise direction around a rotation axis 3010*a* and has a charger 3020, an exposure device 3030, a developer 3040, a transfer roll 3050, a before-cleaning exposure 3061, a cleaning unit 3070 and a neutralization lamp 3080.

The photoreceptor 3010 shown in FIG. 16 is constituted by laying a foundation layer, photoreceptor layer containing charge generating layer and charge transportation layer and protective layer 3101 on a cylindrical conductive supporting body. The protective layer 3101 is an uppermost layer of this photoreceptor 3010 and in FIG. 16, this protective layer 3101 is represented schematically. The uppermost layer (surface 3110 of the photoreceptor 3010) is moved cyclically around the rotation axis 3010*a* when the photoreceptor 3010 rotates around the rotation axis 3010*a*. A further description of the photoreceptor 3010 is omitted here and the detail thereof will be described later.

The charger 3020 is a non-contact charging type corotron charger. This charger 3020 is applied with charging bias from a charger power supply 3021. The exposure device 3030 irradiates laser beam based on image information to a surface 3110 of the photoreceptor 3010. The f developer 3040 includes a developing powder accommodating body 3041 accommodating developing agent containing toner particles and additive particles which are finer than the toner particle and a developing roll 3042 which rotates opposing the surface of the photoreceptor 3010 with toner particles carried in the developing powder accommodating body 3041. The toner particle in the developing agent accommodated in the developing agent accommodating body 3041 is negatively charged toner particle and the toner particle is charged negatively within the developer 3040 and is moved electrostatically to the surface 3110 of the photoreceptor 3010.

When an image is formed in the image forming apparatus shown in FIG. 16, first, toner image forming cycle for forming a toner image on the photoreceptor surface 3110 is executed. According to this toner image forming cycle, after the surface 3110 of the photoreceptor 3010 is charged equally by the charger 3020, laser beam is irradiated based on image information by the exposure device 3030 so as to form an electrostatic latent image on the surface 3110 of the photoreceptor 3010. This electrostatic latent image is developed by the developer 3040 so that a toner image is formed on the surface 3110 of the photoreceptor 3010 and then, the toner image formation cycle is ended.

Referring to FIG. 16, a recording paper P is carried from the right to the left in the same Figure. The carried recording paper is fed into between the photoreceptor 3010 and the transfer roll 3050. In the image forming apparatus 3001 shown in FIG. 16, a region sandwiched by the photoreceptor 3010 and the transfer roll 3050 serves as a transfer area. The transfer roll 3050 is supplied with transfer bias having an opposite polarity to a charging polarity of toner particle and a toner image formed on the photoreceptor surface 3110 by the toner image forming cycle is transferred to the recording paper P from the surface 3110 of the photoreceptor 3010. In the image forming apparatus 3001 of this embodiment, the surface of the recording paper P corresponds to a predetermined transfer object surface according to the present invention. Although the image forming apparatus 3001 shown in FIG. 16 adopts a direct transfer method using the transfer roll 3050, it is permissible to use a transfer corotron instead of the transfer roll 3050. Further, it is also permissible to adopt transfer belt method in which the recording paper P is carried by attacting eletctrostatically and a toner image is transferred to the photoreceptor. Additionally, intermediate transfer method using an intermediate transfer body such as intermediate transfer belt and intermediate transfer drum may be used.

The image forming apparatus 3001 shown in FIG. 16 includes a fixing device 3090 in the downstream of the transfer region in the direction of paper transportation. This fixing device 3090 has a fixing roll 3091 provided with heating mechanism and a pressure roll 3092 provided opposing the fixing roll 3091. The recording paper P after passing the transfer region is carried in between the fixing roll 3091 and the pressure roll 3092 which oppose each other. Toner constituting the toner image on the recording paper P is melted by the heating mechanism of the fixing roll 3091 and fixed on the recording paper P by receiving a pressure from the pressure roll 3092, so that an image composed of fixed toner image is formed.

On the other hand, residual toner not transferred to the recording paper P in the transfer region of the photoreceptor 3010 and additive particles which adhere to that residual toner are left on the surface 3110 after passing the transfer region. Further, discharge product represented by $O_3$ or $NO_x$ adheres to the photoreceptor surface 3110 accompanying discharge phenomenon on the charger 3020 and this discharge product is left on the surface 3110 after passing the transfer region of the photoreceptor 3010. If a large amount of the discharge product is left on the photoreceptor surface 3110, the left discharge product is ion-bonded with water in the environment so that electric resistance of the photoreceptor 3010 drops, thereby inducing phenomenon such as so-called void image or image flow.

The cleaning unit 3070 shown in FIG. 16 is a unit for removing these residual matters and disposed in the downstream of the transfer region in the rotation direction of the photoreceptor (cyclic moving direction of the photoreceptor surface) and in the upstream of the charger 3021 in the rotation direction of the photoreceptor. This cleaning unit 3070 corresponds to an embodiment of the cleaning unit of the present invention. The before-cleaning exposure 3061 is disposed before the cleaning unit 3070. This before-cleaning exposure 3061 drops the residual potential level on the photoreceptor surface so as to allow the residual toner particles to be removed easily by the cleaning unit 3070.

The cleaning unit 3070 shown in FIG. 16 has a cleaning brush 3071, a collection roll 3072, a scraper member 3073, a waste toner carrying auger 3074, a cleaning assistant member 3075 and a before-charging bias power supply 3079. The cleaning brush 3071 has feathers (brush fiber) 3712 extending radiantly from the center axis 3711 extending in parallel to the rotation axis 3010*a* of the photoreceptor 3010. As the fiber for use as this feather 3712, resin fiber such as nylon, acrylic, polyolefin, polyester and the like can be mentioned and such marketed products as BELTRON (manufactured by Kanebo, Ltd), SA-7 (manufactured by Toray Industries. Inc), UU nylon (manufactured by UNICHIKA, Ltd) and the like may be used. The size of such feather is preferably, 30 denier or less, more preferably 20 denier or less and further preferably 0.5-10 denier. The density of the feather is preferably 20,000/6.45 $cm^2$ or more and more preferably, 60,000/6.45 $cm^2$ or more.

The feather 3712 of the cleaning brush 3071 is conductive. As a method of providing this feather 3712 with conductivity, a method of mixing fiber with conductive powder or ion conductive material, a method of forming a conductive layer inside or outside the fiber and the like are available. The resistance value of the fiber provided with conductivity is preferred to be $10^2$-$10^{11}$ Ω·cm per fiber unit body.

The cleaning brush 3071 rotates around the center axis 3711 with the front ends of the feathers 3712 biting into both the photoreceptor surface 3110 and the peripheral face of the collection roll 3072 (the amount of biting into the photoreceptor surface 3110 is preferably 0.3-2.0 mm and more preferably 0.5-1.8 mm) so as to rub the photoreceptor surface 3110 with the feathers 3712. The feathers 3712 of the cleaning brush 3071 are supplied with cleaning bias having an opposite polarity to the charging polarity of toner, that is, cleaning bias having positive polarity so that the residual toner is attracted by the feathers 3712 of the cleaning brush 3071 by an action of this cleaning bias and scraped by the feathers 3712. The cleaning bias is preferred to be applied such that a difference in potential between the feathers 3712 of the cleaning brush 3071 and the photoreceptor surface 3110 is 100 V or more. The cleaning brush 3071 suffers from less deterioration of cleaning performance by aging and is more effective in particularly a high-speed machine than the plate-like cleaning blade. Because the cleaning brush 3071 shown in FIG. 1 is of cleaning type using electric field positively, it is more advantageous for cleaning spherical toners difficult to remove with the cleaning blade which scrapes mechanically without using electric action. The residual toner particle moved to the feathers 3712 of the cleaning brush 3071 is held by the feathers 3712 by an action of the cleaning bias.

The collection roll 3072 rotates around the center axis 3721 extending in parallel to the rotation axis 3010*a* of the photoreceptor 3010. The roll body 3722 which is produced by curing thermoplastic resin is disposed around the center axis 3721. As thermoplastic resin for use in the roll body 3722, phenol resin, urea resin, melamine resin, unsaturated polyester, epoxy resin, polyimide resin and the like can be mentioned. Of those, preferably, phenol resin has a high dimensional accuracy and easy to mold. Additionally, it is excellent in surface smoothness of its molded product and cheap. The bending modulus of the roll body 3722 is preferred to be 3700 kPa or more. If the bending modulus is less than 3700 kPa, distortion occurs in the collection roll 3072 so that a contact position between the cleaning brush 3071 and the scraper member 3073 and the amount of biting cannot be held at each predetermined value. If it is intended to hold stiffness by increasing the thickness of the roll body 3722 with material whose bending modulus is less than 3700 kPa, mold shrinkage increases so that the dimensional accuracy becomes insufficient. Further, the weight increases and molding time increases, thereby causing problems, for example, necessity of post process, leading to increase in cost. In the meantime, the bending modulus mentioned here refers to a value which is measured based on JIS K7203.

Because the collection roll 3072 is kept in contact with the cleaning brush 3071 and the scraper member 3073, the outer peripheral surface of the collection roll 3072 is worn by a rotation of the collection roll 3072. This abrasion amount is preferred to be 20 mg or less when it is measured based on JIS K6902. As a result, the biting amount and contact pressure between the cleaning brush 3071 and the scraper member 3073 can be set to a large value and stable cleaning can be continued in a long period. If the abrasion amount exceeds 20 mg, the collection roll 3072 may be required to be replaced frequently.

The Rockwell hardness (M scale) of the roll body 3722 is preferred to be 100 or higher. If the Rockwell hardness is 100 or higher, molding with a high dimensional accuracy is possible and a roll body very resistant to slaving can be obtained. The Rockwell hardness mentioned here is a value measured based on JIS K7202.

The collection roll 3072 is supplied with collection bias and the collection roll 3072 collects residual toner particle held by the feather 3712 of the cleaning brush 3071 electrostatically by an action of collection bias. To apply the collection bias, it is necessary to apply a voltage larger than the cleaning bias and it is preferable to apply the voltage so that a difference in potential between the feather 3712 of the cleaning brush 3071 and the collection roll 3072 is 100 V or more and more preferably so that it is 200 V or more, and further preferably so that it is 400 V or more.

As a method for adjusting electric resistance of the collection roll 3072, method of filling with inorganic filler and/or organic filler and the like can be mentioned. Filling the roll body 3722 with inorganic filler or organic filler provides an advantage that the stiffness of the collection roll 3072 increases. As the inorganic filler, metal powder and metal fiber of tin, iron, copper, aluminum and glass fiber and the like can be mentioned. As the organic filler, metal oxides such as carbon black, carbon powder, graphite, magnetic powder, zinc oxide, tin oxide, titan oxide, metal sulfide such as copper sulfide, zinc sulfide, so-called hard ferrite such as strontium, barium, rare earth, ferrite such as magnetite, copper, zinc, nickel and manganese, those metals whose surface is subjected to conductivity treatment as required, solid solution of metal oxide obtained by selecting oxides including different metallic elements such as copper, iron, manganese, nickel, zinc, cobalt, barium, aluminum, tin, lithium, magnesium, silicone, phosphor, hydroxide, carbonate or metal compound and baking at a high temperature, composite metal oxide and polyaniline can be mentioned.

Resistance when a voltage of 500 V is applied to the collection roll 3072 is preferably $1\times10^5$ to $1\times10^{10}$ Ω·cm and more preferably $1\times10^6$ to $1\times10^8$ Ω·cm. If the resistance is less than $1\times10^5$Ω, pouring of charge into the collection roll 3072 occurs so that the polarity of residual toner particles scraped by the cleaning brush 3071 is inverted and it may be sometimes difficult to attract the residual toner particles from the cleaning brush 3071 electrically. On the other hand, if the resistance of the collection roll 3072 exceeds $1\times10^{10}$ Ω·cm, phenomenon that charge is accumulated on the collection roll 3072 is likely to occur and in this case, it may be sometimes difficult to attract the residual toner particles electrically from the cleaning brush 3071.

The scraper member 3073 scrapes the residual toner component collected by the collection roll 3072 from the collection roll 3072. This scraper member 3073 is composed of a metal thin plate and disposed such that an edge portion thereof is in contact with the outer peripheral surface of the collection roll 3072. As a specific material of the scraper member 3073, stainless or phosphor bronze is preferable from viewpoints of high durability and low cost. The thickness of the scraper member is preferably 0.02 to 2 mm and more preferably 0.05 to 1 mm. In the meantime, a rubber blade maybe used for the scraper member 3073 instead of a metal thin plate.

The residual toner component scraped by the scraper member 3073 is carried out of the cleaning unit 3070 by the waste toner carrying auger 3074.

The cleaning assistant member 3075 is disposed in the upstream of the cleaning brush 3071 in the rotation direction of the photoreceptor. In this cleaning assistant member 3075, multiple fine fibers 3752 are held by the holding member 3751 extending in the extension direction of the rotation axis 3010*a* of the photoreceptor 3010. More specifically, the cleaning assistant member 3075 shown in FIG. 16 is produced by pasting a fiber fabric composed of multiple fine fibers 3752 on the holding member 3751 and corresponds to an example of the fiber body according to the present invention. Each of the multiple fine fibers 3752 has a size of 10 μm or less and is conductive and in contact with the photoreceptor surface 3110. A surface of the cleaning assistant member 3075 which is in contact with the photoreceptor surface 3110 is in porous state by the multiple fine fibers 3752. The width of the cleaning assistant member 3075 (length in the rotation direction of the photoreceptor) is 1.5 mm or more and the fine fibers 3752 make contact with the photoreceptor surface with a width of 1.5 mm or more in the rotation direction of the photoreceptor.

Because the cleaning assistant member 3075 is disposed in the upstream of the cleaning brush 3071 which removes residual toner, when the photoreceptor 3010 rotates, residual toner particle is carried to the cleaning assistant member 3075. The residual toner particle is caught and held by the fine fibers 3752 of the cleaning assistant member 3075. Here, because the size of fiber of the fine fiber 3752 is 10 μm or less, the surface of the cleaning assistant member 3075 in contact with the photoreceptor surface 3110 is in porous face so that the photoreceptor surface 3110 is rubbed by this porous face. As a result, the residual toner particles are held stably by the multiple fibers having a size of 10 μm or less. Adhering substance such as discharge product adhering to the photoreceptor surface 3110, additive particles and surface deteriorated layer of the photoreceptor 3010 accompanying discharge are scraped by the residual toner particle held by the fine fibers 3752 from the photoreceptor surface 3110. The scraped discharge product and the like adhere to the residual toner component captured by the fine fibers 3752. Although in a cleaning blade of a conventional general cleaner, the residual toner component is likely to leave the contact portion (i.e. the front end edge protion) easily because its contact with the photoreceptor surface is a linear contact thereby not improving polishing effect, this cleaning assistant member 3075 makes contact with the photoreceptor surface 3110 over 1.5 mm in the rotation direction of the photoreceptor and thus, this cleaning assistant member 3075 exerts a sufficient polishing effect.

The charging bias power supply 3079 applies before-charging bias having the same polarity as the charging polarity of toner, that is, before-charging bias having negative polarity which is an opposite polarity of the cleaning bias to the fine fibers 3752 of the cleaning assistant member 3075. Thus, the before-charging bias having negative polarity is applied to the fine fibers 3752 holding the residual toner particles so that charge is applied to the residual toner particles held by the fine fibers 3752.

Although the residual toner component is held by the cleaning assistant member 3075 stably, if new residual toner component is carried to the cleaning assistant member 3075, the residual toner component held by the cleaning assistant member 3075 is replaced with residual toner component carried newly and existing on the photoreceptor surface 3110 and part of the residual toner component held by the cleaning assistant member 3075 is returned to the photoreceptor surface 3110. Thus, the residual toner particles returned to the photoreceptor surface 3110 is easy to attract electrostatically by the feathers 3712 of the cleaning brush 3071. Some residual toner particles pass the cleaning assistant member 3075 without being captured by the fine fibers 3752 of the cleaning assistant member 3075 and charge is applied to the residual toner particles passing the cleaning assistant member 75, so that the residual toner particles passing the cleaning assistant member 3075 are in a state easy to attract by the feathers 3712 of the cleaning brush 3071.

Therefore, the cleaning unit 3070 shown in FIG. 16 is capable of maintaining cleaning performance of the residual toner particles in long periods while removing the discharge product sufficiently.

Because charge of the residual toner particles arriving at the cleaning brush 3071 is not controlled unless the before-charging bias is applied to the fine fibers 3752 of the cleaning assistant member 3075 as mentioned in this embodiment, if the residual toner particles having an opposite polarity to the cleaning bias pass the cleaning brush 3071 or low charged toner is accumulated on the cleaning brush 3071, cleaning maintainability worsens as a result of long term running.

The before-charging bias is preferred to be 50 V or 600 V or less in terms of its absolute value. More preferably, it is 100 V or 400 V or less. Because if the before-charging bias is too high, charge of the residual toner particles returned from the cleaning assistant member 3075 or passing the cleaning assistant member 3075 becomes too high, so that the transfer performance of the residual toner particles from the cleaning brush 3071 to the collection roll 3072 worsens thereby producing such a problem that the residual toner particles are accumulated on the cleaning brush 3071.

In the meantime, although the residual toner particles are replaced in the cleaning assistant member 3075, it is permissible to clean a contact surface of the cleaning assistant member 3075 with the photoreceptor surface by setting a periodic discharge mode and applying a bias having an opposite polarity to the before-charging bias to the fine fibers 3752 of the cleaning assistant member 3075 in order to accelerate the replacement. When this discharge mode is executed, it is permissible to apply a bias having an opposite polarity to the cleaning bias to the cleaning brush 3071 and allow the cleaning brush 3071 to attract the residual toner particles discharged from the cleaning assistant member 3075 positively.

Although not shown in FIG. 16, the cleaning unit 3070 of this embodiment includes a reciprocating mechanism 3076.

Figure 17:
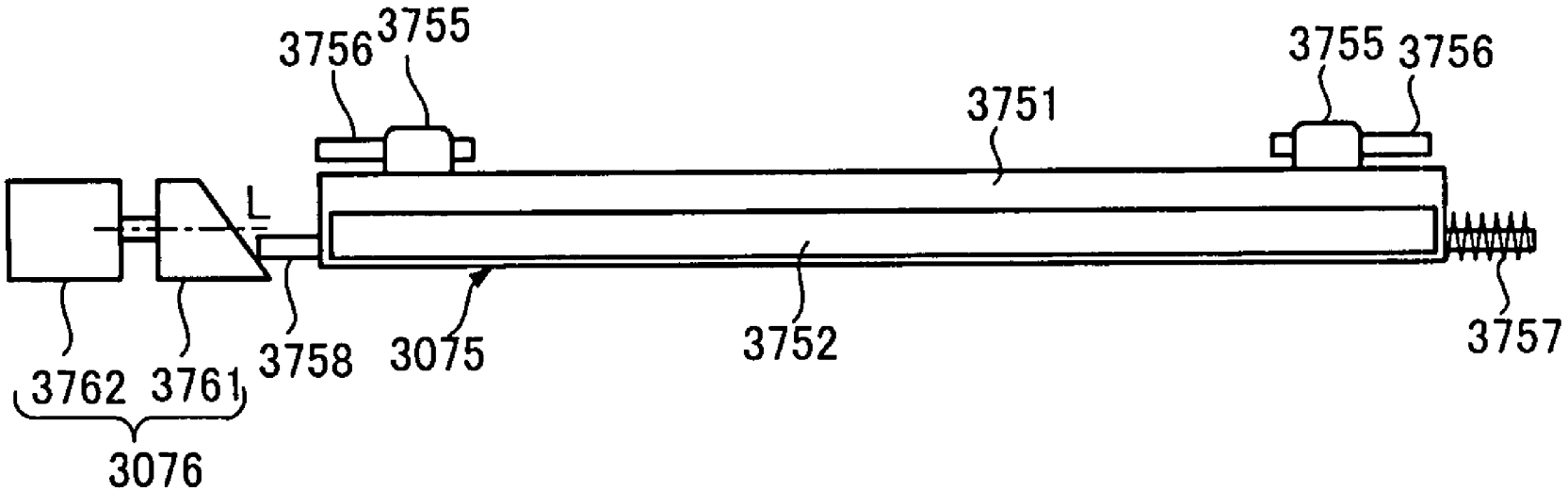
FIG. 17 is a diagram showing the reciprocating mechanism equipped on the cleaning unit of the fifth embodiment.

FIG. 17 is a diagram showing the reciprocating mechanism possessed by the cleaning unit of this embodiment.

FIG. 17 shows the cleaning assistant member 3075 such that its extension direction is in the right and left direction of this Figure. Both sides in the length direction (right and left direction of FIG. 17) of the holding member 3751 of the cleaning assistant member 3075 shown in FIG. 17 are fixed to guides 3755 and a guide pin 3756 is inserted through each of the guides 3755. The cleaning assistant member 3075 is capable of reciprocating freely in the length direction of the cleaning assistant member 3075, that is, in the extension direction of the rotation axis 3010*a* of the photoreceptor 3010 (not shown) under a guide by the guide pins 3756. Although the length in the length direction of the cleaning assistant member 3075 shown in FIG. 17 is smaller than the length of an image formation maximum area of the photoreceptor surface 2110 (length in the extension direction of the rotation axis 3010*a* of the photoreceptor), that image formation maximum area is covered in the extension direction of the rotation axis 3010*a* of the photoreceptor when the cleaning assistant member 3075 reciprocates. The length in the length direction of the cleaning assistant member 3075 may agree with the length of the image formation maximum area of the photoreceptor surface 3110. A compression spring 3757 is disposed at an end (right end in FIG. 17) of the holding member 3751 so that the holding member 3751 is urged toward the other end (left end in FIG. 17). A projection pin 3758 is provided at the other end of the holding member 3751.

The reciprocating mechanism 3076 is shown on the left side of FIG. 17. This reciprocating mechanism 3076 reciprocates the cleaning assistant member 3075 and includes an inclined cam 3761 and a drive motor 3762 for rotating that inclined cam 3761. The projecting end of the projection pin 3758 provided on the holding member 3751 makes contact with a position eccentric from the rotation axis L of the inclined cam 3761 on a cam face of the inclined cam 3761 by an urging force of the compression spring 3757. Thus, when the inclined cam 3761 is rotated by the drive motor 3762, the cleaning assistant member 3075 is reciprocated in the right and left direction of FIG. 17. FIG. 17 shows a cleaning assistant member 3075 in a condition in which it is moved rightmost by the cam face of the inclined cam 3761 and when the inclined cam 3761 is rotated from this condition, the cleaning assistant member 3075 is moved leftward and after that, it returns to the condition shown in FIG. 17. As a result of such a reciprocation motion, the cleaning assistant member 3075 and the photoreceptor surface 3110 reciprocates relatively in the extension direction of the rotation axis 3010*a* of the photoreceptor 3010 so that the photoreceptor surface 3110 is rubbed swingingly by the cleaning assistant member 3075. This rubbing with swinging intensifies the scraping performance of the cleaning assistant member 3075 without pressing the cleaning assistant member 3075 against the photoreceptor surface 3110 strongly, so that fine residues are removed sufficiently. Further, the scraping performance by the cleaning assistant member 3075 is prevented from being unequal in the extension direction of the rotation axis 3010*a* of the photoreceptor drum 3010. Therefore, according to this embodiment, the fine residues are removed from the photoreceptor surface 3110 equally and sufficiently in the extension direction of the rotation axis 3010*a* of the photoreceptor drum 3010 for a long term.

A move distance (amplitude of reciprocation) of the cleaning assistant member 3075 by the reciprocating mechanism 3076 may be in a range of 2 mm to 10 mm. If the move distance is less than 2 mm, no effect is found and if it is over 10 mm, the effect remains the same and an increase of the size of the cleaning unit 3070 is induced. The speed of reciprocation of the cleaning assistant member 3070 by the reciprocating mechanism 3076 may be in a range of 0.5 reciprocation to 20 reciprocations and more preferably, in a range of 1 reciprocation to 10 reciprocations. If the speed is smaller than 0.5 reciprocation, no sufficient effect is found and if it exceeds 20 reciprocations, even the cleaning assistant member 3075 which holds residual toner component stably in the fine fibers 3752 becomes incapable of holding the residual toner component due to vibration from the rubbing motion or deterioration of the fine fibers is induced. Further, if it is non-integer times in a range of 0.5 reciprocation to 20 reciprocations with respect to a single rotation of the photoreceptor drum 3010, uniformity of polishing of the photoreceptor drum 3010 can be improved. It is permissible to use a direct actuating motor instead of a combination of the inclined cam 3761 and the drive motor 3762. Although the cleaning assistant member 3075 is reciprocated by the reciprocating mechanism 3076 because of ease of control, it is permissible to reciprocate the photoreceptor 3010 in the extension direction of the rotation axis 3010*a* with the cleaning assistant member 3075 kept at a predetermined position or reciprocate both the cleaning assistant member 3075 and the photoreceptor 3010 in the extension direction with a deflection in their timings.

If the cleaning assistant member 3075 executes its reciprocation, transmission of vibration to the photoreceptor 3010 is unavoidable and if the reciprocation is executed during an execution of the toner image forming cycle, there is a fear that when laser beam is irradiated by the exposure unit 3030, the position of a spot of laser beam is deflected by vibration by the reciprocation so that distortion may occurs in electrostatic latent image. Thus, the reciprocating mechanism 3076 shown in FIG. 17 executes this reciprocation while the toner image forming cycle is not executed. The period in which the toner image forming cycle is not executed includes a rise-up time after the image forming apparatus is powered on, a last cycle time of image forming job, inter-image between formation of images, following cycle time after image forming job, stop of rotation of the photoreceptor 3010 and a lapse of a predetermined time after the power is turned off. The reciprocation may be executed at the rise-up time after the image forming apparatus is powered on, the last cycle time of image forming job or when the rotation of the photoreceptor is stopped after the last cycle because an influence of the image forming speed is small.

The size of fiber constituting the fine fiber 3752 of the cleaning assistant member 3075 may be 2 μm or 10 μm or less and more preferably, 4 μm or 8 μm or less. If the size of the fiber exceeds 10 μm, uniform holding performance of the residual toner component drops and separation from the fine fibers or burying into the fibers of the residual toner components are likely to occur at the time of rubbing with swing, thereby reducing refresh performance of the photoreceptor due to the rubbing with swing. On the contrary, if it is 2 μm or less, the fibers are likely to be damaged due to stress by rubbing with swing.

Further, if the contact width of the cleaning assistant member 3075 with the photoreceptor surface 3110 increases too much, the residual toner component becomes likely to be removed from the fine fibers because of mechanical stimulus at the time of the rubbing with swing. Thus, the contact width is preferred to be 10 mm or less from viewpoints of increased size of the image forming apparatus although there is no any special limitation in the upper limit of the contact width.

As material of the fine fiber 3752, for example, polyester base fiber, nylon base fiber, polyamide base fiber, polyolefin base fiber, acrylic base fiber or composite fiber using resin of each synthetic fiber, semi-synthetic fiber such as acetate base fiber, regenerated fiber such as rayon and the like may be used. As a method for processing these fine fibers into a sheet-like form, a method of constituting secondary material by knitting the fibers and a method of creating cloth directly from fibers are available and in the latter method, fibers are bonded to each other or entangled with each other mechanically into the sheet-like form and this is called unwoven cloth. Although any method may be used, the unwoven cloth is more preferable in the viewpoint that the strength of the sheet and density of the fine fibers are high thereby providing an excellent flexibility and toner can be held excellently between the fibers.

The holding member 3751 may be used as a backup material for the fine fibers 3752 and the fine fibers 3752 may be bonded to the surface of the holding member 3751 such that the surface is pressed to the photoreceptor surface 3110 at a predetermined pressure. More specifically, a fabric composed of multiple fine fibers 3752 of the cleaning assistant member 3075 is pressed at a predetermined pressure by holding member 3751 having elasticity on the photoreceptor surface 3110. As the holding member 3751, foamed urethane, urethane rubber, silicone rubber and other elastic body may be used. The pressure by which the holding member 3751 presses the fine fibers 3752 to the photoreceptor surface 3110 maybe in a range of 4.9 to 58.8 mN/mm. A more preferable range is 9.8 to 39.2 mN/mm. If the pressing pressure is lower than 4.9 mN/mm, no sufficient rubbing function can be exerted and if it is higher than 58.8 mN/mm, the fine fibers 3752 and the photoreceptor 3010 are deteriorated because the rubbing with the photoreceptor drum 3010 is too strong, and further, filming or the like is induced.

Further, the fine fibers 3752 are conductive and as a method for providing the fibers with conductivity, there are a method of dispersing conductive fine particles such as carbon black on synthetic fibers, a method of mixing conductive fine particles at the time of producing unwoven fabric from fibers, and a method of impregnating fibers with conductive polymer so as to coat equally to provide with conductivity. As a conductive processing agent, acetylene, benzene, aniline, phenylacetylene, pyrrole, furan, chiophene, indole, and polymer of derivative of these monomers are available. The electric resistance of the conductive fiber fabric composed of fine fibers subjected to conductivity treatment may be $10^8$ Ω·cm or less and more preferably be $10^5$ Ω·cm or less. If the electric resistance is higher than $10^8$ Ω·cm, high electric field needs to be applied to invert the polarity of the residual toner particles and when accumulation of the residual toner particles on a contact surface of the fine fibers 3752 with the photoreceptor surface 3110 is accelerated, the charge adjustment function of the toner cannot be exerted. By blending the fine conductive fibers with fine insulating fibers, the electric resistance may be adjusted.

Here, some modifications of the cleaning assistant member 3075 will be explained. In a following description, components having the same designation as those of the components of the image forming apparatus shown in FIG. 16 will be described with the same reference numerals as those used up to now and a duplicated description is omitted.

Figure 18:
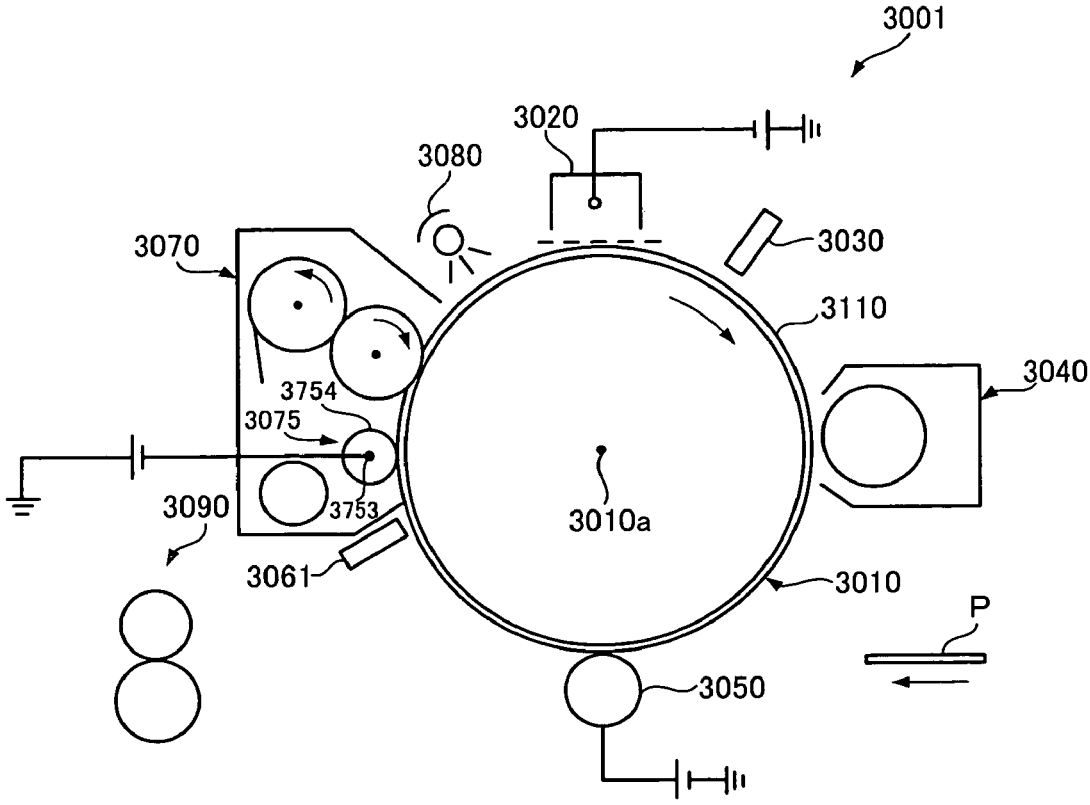
FIG. 18 is a diagram showing the schematic structure of an image forming apparatus having a roll-like cleaning assistant member.

FIG. 18 is a diagram showing the schematic structure of an image forming apparatus having the roll-like cleaning assistant member.

The cleaning assistant member 3075 shown in FIG. 18 is a roll which rotates around a center axis 3753 extending in parallel to the rotation axis 3010*a* of the photoreceptor 3010. The outer peripheral surface of this roll-like cleaning assistant member 3075 is formed of conductive fiber fabric 3754 composed of fine fibers of 10 μm or less in diameter. Forming the cleaning assistant member 3075 into such a roll accelerates there placement of toner without accumulation of excessive amount of residual toner on the surface and secures long-period maintainability without setting a periodic discharge cycle. In the meantime, the rotation direction of the roll-like cleaning assistant member 3075 may be in the same direction as or an opposite direction to the rotation direction of the photoreceptor 3010 in a contact area with the photoreceptor surface 3110.

Figure 19:
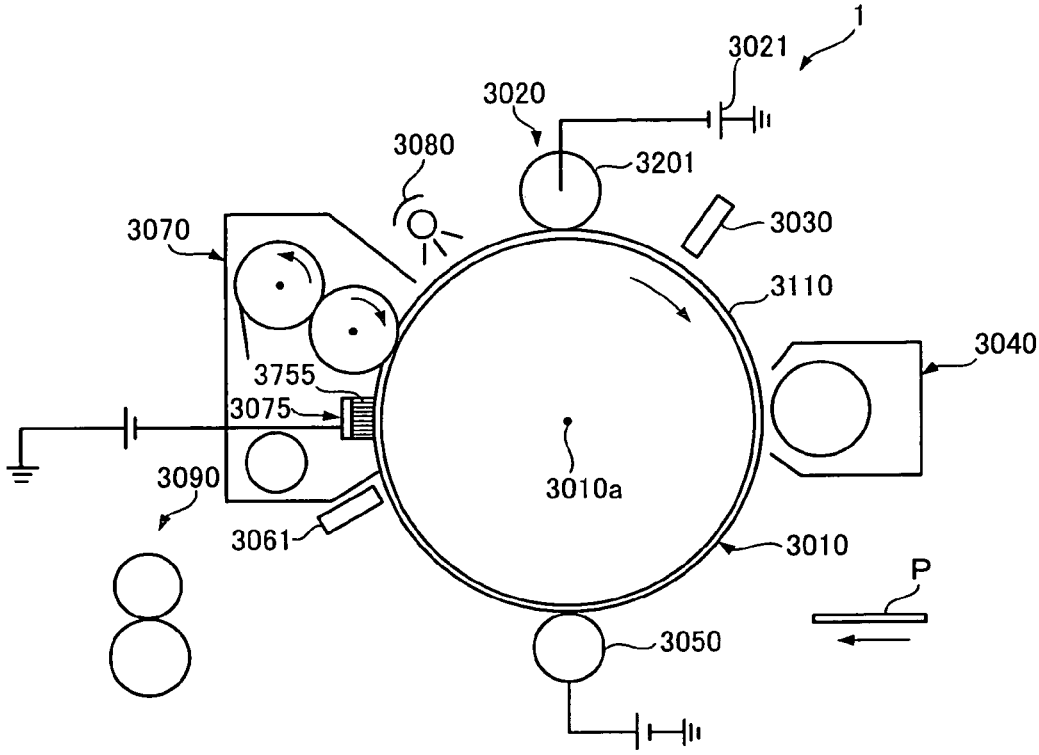
FIG. 19 is a diagram showing the schematic structure of an image forming apparatus having a cleaning assistant member in which multiple fibers each having a size of 10 μm or less are bound up.

FIG. 19 is a diagram showing the schematic structure of the image forming apparatus having the cleaning assistant member in which multiple fibers 10 μm or less in diameter are bound together.

The image forming apparatus 3001 shown in FIG. 19 includes a charger 3020 adopting the contact type charging method. That is, the charger 3020 shown in FIG. 19 includes a charging roll 3201 which rotates with a state in contact with the surface 3110 of the photoreceptor 3010 and a charger power supply 3021 for applying that charging roll with charging bias. The charging roll 3201 is a semi-conductive type which rotates with a state in contact with the photoreceptor 3010 and charges the photoreceptor 3010 by generating discharge in a fine gap in the vicinity of the photoreceptor 3010.

The cleaning assistant member 3075 shown in FIG. 19 is a fixed brush (fiber bundle) 3755 comprised of a bundle of multiple fibers 10 μm or less in diameter. The density of the fibers in this fixed brush may be 200,000 pieces/6.45 $cm^2$ or more, more preferably 400,000 pieces/6.45 $cm^2$ or more and further preferably 800,000 pieces/6.45 $cm^2$ or more. If the density of the fiber bundle is coarser than 200,000 pieces/6.45 $cm^2$, the residual toner particles cannot be held equally so that the scraping performance drops thereby all discharge product not being removed. Further, the charge adjustment capacity of the residual toner particles also drops. The length of the fiber of the fixed brush 3755 may be 1-5 mm and more preferably 1.5-3 mm. If the length of the fiber is larger than 5 mm, the elastic modulus of the fiber bundle decreases so that the rubbing capacity drops and if it is less than 1 mm, the holding capacity of toner drops and the rubbing capacity also drops. Further, the amount of biting of the fixed brush 3755 into the photoreceptor 3010 may be 0.3 mm or 1.5 mm or less and more preferably 0.5 mm or 1 mm or less. If the amount of biting is smaller than 0.3 mm, contact with the photoreceptor 3010 becomes unstable and if the amount of biting is larger than 1.5 mm, the rubbing with the photoreceptor 3010 is so strong that deterioration of the photoreceptor 3010 is induced. The electric resistance of the fixed brush 3755 may be $10^8$ Ω·cm or less like the aforementioned conductive fiber fabric and more preferably $10^5$ Ω·cm or less.

The fixed brush may be a bundle of multiple fibers each less than 8.5 μm (about 1 denier) in diameter.

Subsequently, the photoreceptor which can be used as the photoreceptor shown in FIG. 16 will be described in detail.

Figure 20:
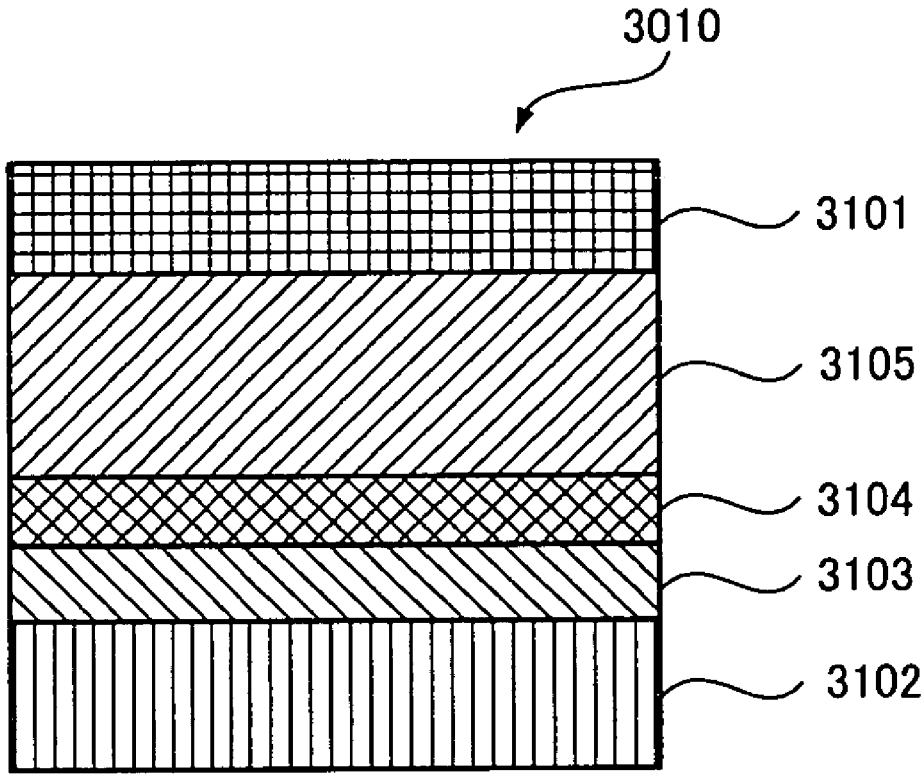
FIG. 20 is a schematic diagram showing the sectional structure of a photoreceptor shown in FIG. 16.

FIG. 20 is a schematic diagram showing the sectional structure of the photoreceptor shown in FIG. 16.

FIG. 20 shows foundation layer 3103 formed on the surface of the cylindrical conductive supporting body 3102, the charge generating layer 3104 formed on the surface of the foundation layer 3103, the charge transportation layer 3105 formed on the surface of the charge generating layer 3104 and the protective layer 3101. Although the photoreceptor 3010 maybe constituted of three layers, that is, the foundation layer 3103, photo-sensitive layer including the charge generating layer 3104 and the charge transportation layer 3105 and the protective layer 3101, it does not need to be of three layers but a single layer structure may be accepted. Further, the photo-sensitive layer may be of a single layer. To provide with durability against flaws in the photoreceptor surface, the protective layer having a high strength may be provided and material constituting this protective layer 3101 may contain resin having a structure unit having charge transportation capacity and cross-link structure.

The conductive supporting body 3102, the foundation layer 3103, the charge generating layer 3104, the charge transportation layer 3105 and the protective layer 3101 of the photoreceptor 3010 correspond to the conductive supporting body 1112, the foundation layer 1113, the charge generating layer 1114, the charge transportation layer 1115 and the protective layer 1111 of the photoreceptor 1011 (see FIG. 5) of the first embodiment described above. Further, the description of the protective layer 1111 shown in FIG. 5 can be applied here. Then, a duplicated description of the protective layer 3101 is omitted.

EXAMPLES

Hereinafter, examples and comparative examples of the present invention will be described specifically. The present invention is not restricted to any particular examples. In a following description, all parts mean weight parts unless specified otherwise.

[Manufacturing of Developing Agent]

<Manufacturing of Toner Mother Particle>

(Adjustment of Resin Fine Particle Dispersion Solution)

A solution of mixed 370 parts of styrene, 30 parts of n-butyl acrylate, 8 parts of acrylic acid, 24 parts of dodecanethiol, 4 parts of carbon tetrabromide was emulsion polymerized with 6parts of nonionic surface-active agent (NONIPOLE: manufactured by SANYO KASEI Co., Ltd.) and 10 parts of anionic surface-active agent (NEOGEN SC: manufactured by DAIICHI KOGYO Co., Ltd.) in ion exchange water in a flask and mixed slowly for 10 minutes and then, 50 parts of ion exchange water in which 4 parts of ammonium persulfate was dissolved was thrown therein to. After substitution with nitrogen, content was heated up to 70° C. in an oil bath by agitating in the flask and the emulsion-polymerization was continued for 5 hours. As a result, resin fine particle dispersion solution in which resin particles of 150 nm, Tg=58° C. and Mw=11500 in weight average molecular weight were dispersed was obtained. The solid density of this dispersion solution was 40 weight %.

(Adjustment of Coloring Agent Dispersion Solution (1))

60 parts of carbon black (MOGAL: manufactured by CABOT), 6 parts of anionic surface-active agent (NONIPOLE 400: manufactured by SANYO KASEI Co., Ltd.) and 240 parts of ion exchange water were mixed and dissolved and agitated with a homogenizer (ULTRA TARAX T50: manufactured by IKA CORP.) for 10 minutes. After that, by dispersing with an artemizer, coloring agent dispersion solution (1) in which coloring agent (carbon black) particles each having an average particle diameter of 250 nm were dispersed was prepared.

(Adjustment of Coloring Agent Dispersion Solution (2))

60 parts of cyan pigment (C.I. Pigment Blue15: 3, manufactured by DAINICHISEIKA CORP.), 5 parts of anionic surface-active agent (NONIPOLE400: manufactured by SANYO KASEI Co., Ltd.), and 240 parts of ion exchange water were mixed, dissolved and agitated with a homogenizer (ULTRA TARAX T50: manufactured by IKA CORP.) for 10 minutes. After that, by dispersing with an artemizer, coloring agent dispersion solution (2) in which coloring agent (cyan pigment) particles each having an average particle diameter of 250 nm were dispersed was prepared.

(Adjustment of Coloring Agent Dispersion Solution (3))

60 parts of magenta pigment (C.I. Pigment Red122: manufactured by DAINICHISEIKA CORP.), 5 parts of anionic surface-active agent (NONIPOLE400: manufactured by SANYO KASEI Co., Ltd.), and 240 parts of ion exchange water were mixed, dissolved and agitated with a homogenizer (ULTRA TARAX T50: manufactured by IKA CORP.) for 10 minutes. After that, by dispersing with an artemizer, coloring agent dispersion solution (3) in which coloring agent (magenta pigment) particles each having an average particle diameter of 250 nm were dispersed was prepared.

(Adjustment of Coloring Agent Dispersion Solution (4))

90parts of yellow pigment (C.I. Pigment Yellow 180, manufactured by DAINICHISEIKA CORP.), 5 parts of anionic surface-active agent (NONIPOLE400: manufactured by SANYO KASEI Co., Ltd.), and 240 parts of ion exchange water were mixed, dissolved and agitated with a homogenizer (ULTRA TARAX T50: manufactured by IKA CORP.) for 10 minutes. After that, by dispersing with an artemizer, coloring agent dispersion solution (4) in which coloring agent (yellow pigment) particles each having an average particle diameter of 250 nm were dispersed was prepared.

(Mold Release Agent Dispersion Solution)

100parts of paraffin wax (HNP0190: manufactured by NIPPON SEIRYO, melting point 85° C.), 5 parts of cationic surface-agent (SANIZOLE: manufactured by KAO) and 240 parts of ion exchange water were dispersed in a round type stainless flask with a homogenizer (ULTRA TARAX T50: manufactured by IKA CORP.) for 10 minutes and subjected to dispersion treatment with a pressure discharge type homogenizer so as to prepare mold release agent dispersion solution in which mold release agent particles each having an average diameter of 550 nm were dispersed.

(Adjustment of Toner Mother Particle K)

234 parts of the aforementioned resin particle dispersion solution, 30 parts of the aforementioned coloring agent dispersion solution, 40 parts of the aforementioned mold release agent dispersion solution, 0.5 parts of polyaluminum hydroxid (manufactured by ASADA, Psho2S) and 600 parts of ion exchange water were mixed in a round type stainless steel flask with a homogenizer (ULTRA TARAX T50: manufactured by IKA CORP.) and dispersed and after that, heated up to 40° C. by agitating in the flask in a heating oil bath. After it was held at 40° C. for 30 minutes, it was recognized that agglomerated particles whose volume average particle diameter D50 was 4.5 μm was generated. Further, the temperature of the heating oil bath was raised and kept at 56° C. for an hour, and consequently, the volume average particle diameter D50 turnes to 5.3 μm. After that, resin particle dispersion solution of 26 weight parts was added to dispersion solution containing the agglomerated particles and the temperature of the heating oil bath was raised up to 50° C. and kept for 30 minutes. 1N sodium hydrate was added to the dispersion solution containing this agglomerated particles so as to adjust the pH of the system and the stainless flask was closed completely. It was heated up to 90° C. by continuing agitation with a magnetic seal and held for 2 hours. After it was cooled, the toner mother particles were separated by filtration and washed four times with ion exchange water. After freeze dehydration, toner mother particles K1 were obtained. The volume average diameter D50 of the toner mother particle K1 was 5.4 μm and its average shape coefficient SF was 133.

(Adjustment of Toner Mother Particle C)

Toner mother particle C was adjusted in the same way as adjustment of the toner mother particle K except the aforementioned coloring agent particle dispersion solution (2) was used instead of the coloring agent particle dispersion solution (1). The volume average diameter D50 of the obtained toner mother particle C was 6.0 μm and its average shape coefficient SF was 128.

(Adjustment of Toner Mother Particle M)

Toner mother particle M was adjusted in the same way as adjustment of the toner mother particle K except the aforementioned coloring agent particle dispersion solution (3) was used instead of the coloring agent particle dispersion solution (1). The volume average diameter D50 of the obtained toner mother particle M was 5.6 μm and its average shape coefficient SF was 130.

(Adjustment of Toner Mother Particle Y)

Toner mother particle Y was adjusted in the same way as adjustment of the toner mother particle K except the aforementioned coloring agent particle dispersion solution (4) was used instead of the coloring agent particle dispersion solution (1). The volume average diameter D50 of the obtained toner mother particle Y was 5.7 μm and its average shape coefficient SF was 130.

<Addition of Additive Particles>

1 part of metatitanic acid (average primary particle diameter 40 nm, i-butyl trimethoxysilane treatment) and 1.6 parts of silica (average primary particle diameter 12 nm, dimethyl dimetoxy silane treatment, vapor-phase oxidation method) were added to toner mother particles K, C, M, Y and blended at a peripheral velocity of 30 m/s for 15 minutes with a 5L Henschel mixer and large particles were removed with a sieve having 45 μm mesh so as to obtain four color toner.

<Manufacturing of Carrier>

100 parts of ferrite particles (average particle diameter: 50 μm), 14 parts of toluene, 2 parts of styrene/methacrylat copolymer (component ratio: 90/10), 0.2 parts of carbon black (R330: manufactured by CABOT) were used.

First, the above-mentioned components were agitated except ferrite particles with a stirrer for 10 minutes so as to adjust coating solution and next, this coating solution and ferrite particles were taken into a vacuum degassing type kneader and agitated at 60° C. for 30 minutes. Then, it was depressurized while heating and degassed and dried to obtain carrier. This carrier had a volume resistivity value of $10^{11}$ Ωcm when an electric field of 1000V/cm was applied.

<Adjustment of Developing Agent>

6 parts of each of four color toners and 100 parts of carrier were agitated at 40 rpm with a V-blender for 20 minutes and filtered with a sieve having 212 μm mesh so as to obtain developing agent containing each color toner.

[Manufacturing of Photoreceptor D]

30 weight parts of organic zirconium compound (acetylacetonezirnoniumbuthylate) and 3 weight parts of organic silane compound (γ-aminopropyltrimethoxy silane) were added to 170 weight parts of n-butyl alcohol in which 4 weight parts of polyvinyl butyral resin (ESUREKKU BM manufactured by SEKISUI KAGAKU CORP.) was dissolved and mixed by agitation so as to obtain coating solution for foundation layer formation. This coating solution was applied to an aluminum supporting body whose surface was roughed by honing processing by dipping and dried for 5 minutes under a room temperature by blowing. After that, the supporting body was heated up to 50 ° C. in ten minutes, taken into a constant temperature/constant humidity bath of 50° C. and 85% RH (dew point: 47° C.) and subjected to hardening acceleration treatment by wetting for 20 minutes. After that, it was dried at 170° C. in a hot wind drier for 10 minutes so as to form the foundation layer.

As the charge generating material, a mixture of 15 weight parts of chloride gallium phthalocynanine, 10 weight parts of vinyl chloride-vinyl acetate copolymer resin (VMCH, manufactured by NIPPON UNION CARBIDE CORP.) and 300 weight parts of n-butyl alcohol was dispersed with a sand mill for 4 hours. The obtained dispersion solution was applied to the foundation layer by dipping and dried so as to form charge generation layer 0.3 μm in thickness. Next, coating solution obtained by dissolving and mixing 40 parts of N,N'-bis (3-methyl phenyl)-N,N'-diphenyl benzidine and 60 weigh parts of bisphenol Z polycarbonate resin (molecular weight: 40,000) in 235 weight parts of tetrahydrofuran and 100 weight parts of monochlorobenzene sufficiently was applied to the charge generation layer by dipping so as to form charge transportation layer 20 μm in thickness. The obtained photoreceptor was used as photoreceptor D. The surface of the photoreceptor D is constituted of the charge transportation layer.

[Manufacturing of Photoreceptor E]

40 parts of N,N'-bis (3-methyl phenyl)-N,N'-diphenyl benzidine and 60 weigh parts of bisphenol Z polycarbonate resin (molecular weight: 40,000) were dissolved and mixed in 280 weight parts of tetrahydrofuran and 120 weight parts of toluene sufficiently and 10 weight parts of tetraethylene fluoride resin was added thereto and mixed further. At this time, the room temperature was set to 25° C. and solution temperature in mixing process was kept at 25° C. After that, tetraethylene fluoride particle dispersion solution was created by dispersing with a sand grinder using glass beads. At this time, water at 24° C. was poured to a vessel of the sand grinder so as to keep the temperature of the dispersion solution at 50° C. The obtained coating solution was applied to a substance in which the charge transportation layer was formed under the same condition as the photoreceptor 1 and dried at 120° C. for 40 minutes so as to form the charge transportation layer 24 μm in thickness. The obtained photoreceptor was named photoreceptor E. The surface of the photoreceptor E is constituted of the charge transportation layer containing fluorine resin.

[Manufacturing of Photoreceptor F]

Composition materials mentioned below were dissolved in 5 parts of isopropyl alcohol, 3 parts of tetrahydrofuran, and 0.3 parts of distilled water and 0.5 parts of ion exchange resin (UMBERLIST 15E) was added and agitated at a room temperature so as to execute hydrolysis.

Composition Materials

Following compounds 2:2 parts

Methyltrimethox ysilane: 2 parts

Tetramethoxy silane: 2 parts

Colloidal silica: 0.3 parts

Fluoride grapht polymer (ZX007C manufactured by Fujikasei Co., Ltd.): 0.5 parts

Compound 2

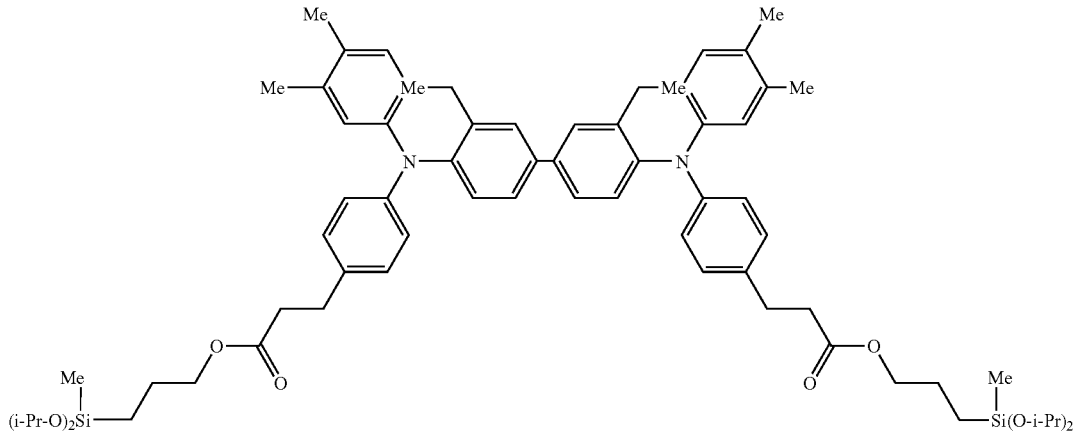

[Chemical 7]

0.1 parts of aluminum trisacetylacetonato (Al(aqaq) 3) and 0.4 parts of 3,5-di-t-butyl-4-hydroxytoluene (BHT) were added to a solution obtained by separating ion exchange resin from hydrolyzed solution and this coating solution was applied to the charge transportation layer of the photoreceptor A according to the ring type impregnation coating method and dried at a room temperature for 30 minutes. It was heated at 150° C. for an hour so that it hardened to form protective layer about 2.5 μm in thickness. The obtained photoreceptor was named photoreceptor F. The surface of the photoreceptor F is constituted of protective layer containing siloxane base resin having a structure unit having charge transportation capacity and cross-link structure.

[Manufacturing of Photoreceptor G]

Protective layer formation coating solution was obtained by dissolving two parts of the aforementioned compound 1, two parts of REJITOP PL4852 (manufactured by GUNEI KAGAKU CORP.) and 10 parts of isopropyl alcohol. This protective layer formation coating solution was applied to the charge transportation layer manufactured in the same way as the photoreceptor A by dipping except that the thickness of the charge transportation layer was 22 μm and dried by blowing at a room temperature for 30 minutes. After that, it was dried at 140° C. for 60 minutes so as to form protective layer 3 μm in thickness. The obtained photoreceptor was used as photoreceptor G. That is, the surface of the photoreceptor G is constituted of protective layer.

Example 20

As a test machine, a reconstructed FUJI XEROX Co., Ltd. DocuCenter 500 was used. That is, the photoreceptor D whose surface was constituted of charge transportation layer was incorporated in the photoreceptor. As a cleaning unit, a cleaning unit shown in FIG. 16 including cleaning brush 3071, collection roll 3072, scraper member 3073, cleaning assistant member and before-charging bias power supply was used. Its detail is shown below.

(1) Cleaning Brush

Brush material: conductive nylon, fiber size: 2 denier (approximately 17 μm), electric resistance: $1\times10^8\Omega$, fiber length: 3 mm, fiber density: 120,000/6.45 $cm^2$, amount of biting into photoreceptor: approximately 0.75 mm, peripheral speed: 60 mm/s, rotation direction: opposite direction to the rotation direction of the photoreceptor in a contact area with the photoreceptor surface, cleaning bias: +200 V (opposite polarity to the charge polarity of toner)

(2) Collection Roll

Material: phenol resin in which conductive carbon is dispersed, electric resistance: $1\times10^8\Omega$, bending elastic modulus (JIS K7203): 100 MPa, abrasion amount (JIS K6902): 2 mg, Rockwell International hardness (JIS K7202, M scale): 120, amount of biting into cleaning brush: 1.0 mm, peripheral velocity: 70 mm/s, rotation direction: same direction as rotation direction of cleaning brush in a contact area with the cleaning brush, collection bias: +600 V (3) Scraper Member Material: SUS304, thickness: 80 μm, amount of biting into collection roll: 1.3 mm, free length: 8.0 mm (4) Cleaning Assistant Member Holding member having bonded conductive fiber fabric was used. That is, as the conductive fiber fabric, unwoven fabric (product name: WP8085/Japan Vilene Co., Ltd.) (material: polyester/nylon, fiber size: 6 μm) was coated entirely and thinly with conductive polymer (polypyrrole) and conductive unwoven fabric having electric resistance of $1\times10^3\Omega$ was bonded to rectangular column foamed urethane 5 mm in width and 3 mm in height. The amount of biting into the photoreceptor surface of the cleaning assistant member was set to 1.5 mm and the pressure to the photoreceptor surface was set to 19.6 mN/mm under a measuring environment at 25° C.

This cleaning assistant member was reciprocated at an interval of 2 reciprocations per a single turn of the photoreceptor with a move width of 10 mm in the extension direction of the rotation axis of the photoreceptor by the reciprocating mechanism shown in FIG. 17.

(5) Before Charging Bias Power Supply

Fine fibers of the cleaning assistant member was applied with before-charging bias of −250 V (same polarity as the charging polarity of toner). Characteristic specifications of an image forming apparatus for use are shown in Table 5.

TABLE 5

| | cleaning auxiliary member | fiber size | amount of biting(mm) | before charge bias | photoreceptor | charger |
|---|---|---|---|---|---|---|
| example 20 | rectangular column holding member + conductive fiber fabric | 6 μm | 1.5 | −250 V | D | non-contact |
| example 21 | rectangular column holding member + conductive fiber fabric | 6 μm | 1.5 | −250 V | E | non-contact |
| example 22 | rectangular column holding member + conductive fiber fabric | 6 μm | 1.5 | −250 V | F | non-contact |
| example 23 | rectangular column holding member + conductive fiber fabric | 6 μm | 1.5 | −250 V | G | non-contact |
| example 24 | rectangular column holding member + conductive fiber fabric | 6 μm | 2.0 | −250 V | G | non-contact |
| example 25 | rectangular column holding member + conductive fiber fabric | 1.7 μm | 1.5 | −250 V | G | non-contact |
| example 26 | roll-like holding member + conductive fiber fabric | 6 μm | 1.0 | −250 V | G | non-contact |
| example 27 | ultra fine nylon fiber | 4.25 μm | 0.75 | −450 V | G | non-contact |
| example 28 | rectangular column holding member + conductive fiber fabric | 6 μm | 1.5 | −250 V | D | contact |
| comparative example 11 | nylon fiber | 17 μm | 0.75 | −450 V | D | non-contact |
| comparative example 12 | nylon fiber | 17 μm | 0.75 | −450 V | F | non-contact |
| comparative example 13 | rectangular column holding member + conductive fiber fabric | 6 μm | 1.5 | — | F | non-contact |
| comparative example 14 | none | — | — | — | F | non-contact |

Each of the above-mentioned color developing agents was incorporated in the developing agent accommodating body of each color developing agent of the image forming apparatus and durability test was carried out on 200,000 pieces each, totaling 400,000 pieces under high temperature/high humidity (28° C., 80% RH) and low temperature/low humidity (10° C., 20% RH) so as to evaluate its cleaning performance and image defocus. Further, flaws and abrasion on the photoreceptor were evaluated. Table 6 shows these results and total evaluation.

The detail of each evaluation is as follows.

[Cleaning Performance]

The cleaning performance of the residual toner particles was evaluated. After the durability test was carried out for 400,000 sheets of paper totally, three pieces of solid images of A3 size were fed under low temperature/low humidity condition and after that, a half tone image (image density 30%)

TABLE 6

| | toner cleaning performance | defocused image | photoreceptor flaw | photoreceptor abrasion (nm/1000 turns) | total evaluation |
|---|---|---|---|---|---|
| example 20 | Vg | Vg | g | 6.0 | g |
| example 21 | Vg | Vg | g | 5.0 | g |
| example 22 | Vg | g | Vg | 1.5 | g |
| example 23 | Vg | Vg | Vg | 1.8 | g |
| example 24 | Vg | Vg | Vg | 1.9 | g |
| example 25 | Vg | Vg | Vg | 2.1 | g |
| example 26 | Vg | Vg | Vg | 2.8 | g |
| example 27 | g | g | Vg | 1.4 | g |
| example 28 | g | Vg | g | 8.5 | g |
| comparative example 11 | g | p | p | 5.5 | p |
| comparative example 12 | g | p | g | 0.8 | p |
| comparative example 13 | p | g | g | 0.5 | p |
| comparative example 14 | g | p | g | 0.5 | p |

was fed and then, streak-like cleaning failure which appeared on the half tone image was observed. The determination standard is as follows.

Very good (Vg): no occurrence of cleaning failure

Good (g): Although a slight streak-like cleaning failure was observed in a first half tone image after three sheets of paper of solid image of A3 size, no cleaning failure streak was found on a second half tone image.

Poor (p): a clear streak-like cleaning failure was observed on a fist paper of half tone image after three sheets of paper of solid image of A3 size and a streak existed in a second half tone image.

[Image Defocus]

After a half tone image (image density: 30%) was printed on 100,000 sheets of paper under high temperature/high humidity environment (28° C., 80% RH), only part of the photoreceptor body surface was wiped to remove water soluble discharge product. After that, a difference in density (ΔSAD) in image portion between a wiped portion and not-wiped portion of the photoreceptor surface was measured with a reflection type density measuring machine (X-rite) and it was evaluated based on a following determination standard. It comes that the smaller the value of ΔSAD, the less image defocus is generated.

Very good (Vg): ΔSAD is 0.15 or less.

Good (g): ΔSAD is above 0.15 or less than 0.4.

Poor (p): ΔSAD is 0.4 or more.

[Flaw on Photoreceptor]

Flaw on photoreceptor was evaluated by measuring average roughness (Rz) of 10 points using a surface roughness gauge (Surfcom1400A manufactured by TOKYO SEIMITSU Co., Ltd.). The smaller the value of Rz, the fewer the flaws on the photoreceptor. The standard for evaluation is as follows.

Very good (Vg): Rz is 1.5 μm or less

Good (g): Rz is above 1.5 μm to less than 2.5 μm (level having no problem in quality)

Poor (p): Rz is 2.5 μm or more (white streak generated on image)

[Amount of Abrasion of Photoreceptor]

As for the abrasion of the photoreceptor, thicknesses of the photoreceptor before and after a test were measured with an eddy current type film thickness gauge. Values in Table 2 indicate the amount of abrasion per 1000 turns of the photoreceptor.

Example 21

The same test and evaluation as the example 19 were carried out using an image forming apparatus (see Table 5) having the same specification as the image forming apparatus used in the example 19 except that the photoreceptor was replaced with a photoreceptor E whose surface is constituted of a charge transportation layer containing fluorine base resin. Its result is shown in Table 6.

Example 22

The same test and evaluation as the example 19 were carried out using an image forming apparatus (see Table 5) having the same specification as the image forming apparatus used in the example 19 except that the photoreceptor was replaced with a photoreceptor F whose surface is constituted of a protective layer containing siloxane base resin. Its result is shown in Table 6.

Example 23

The same test and evaluation as the example 19 were carried out using an image forming apparatus (see Table 5) having the same specification as the image forming apparatus used in the example 19 except that the photoreceptor was replaced with a photoreceptor G whose surface is constituted of a protective layer containing phenol base resin. Its result is shown in Table 6.

Example 24

The same test and evaluation as the example 20 were carried out using an image forming apparatus (see Table 5) having the same specification as the image forming apparatus used in the example 23 except that the setting condition of the cleaning assistant member disposed in the cleaning unit was changed as follows. Its result is shown in Table 6.

In this example 24, as the setting condition of the cleaning assistant member, the amount of biting into the photoreceptor surface of the cleaning assistant member was set to 2.0 mm and the pressure to the photoreceptor surface was changed to 29.4 mN/mm under a measuring environment of 25° C. and further, the cleaning assistant member was reciprocated at an interval of a reciprocation per a turn of the photoreceptor with a move width of 5 mm in the extension direction of the rotation axis of the photoreceptor.

Example 25

The same test and evaluation as the example 20 were carried out using an image forming apparatus (see Table 5) having the same specification as the image forming apparatus used in the example 23 except that unwoven fabric (product name: TORACY, ECSENU, manufactured by Toray Industries. Inc) (material: polyester/polyurethane, fiber size: 0.2 denier (about 1.7 μm) as base of fiber fabric of the cleaning assistant member disposed in the cleaning unit. Its result is shown in Table 6.

Example 26

The same test and evaluation as the example 20 were carried out using an image forming apparatus (see Table 5) having the same specification as the image forming apparatus used in the example 23 except that the cleaning assistant member disposed in the cleaning unit was replaced with a roll-like cleaning assistant member shown in FIG. 18. Its result is shown in Table 6.

In this example 26, conductive unwoven fabric used for the cleaning assistant member of the example 20 was wound around a foamed urethane sponge roll having a diameter of 12 mm as a roll-like cleaning assistant member. The amount of biting into the photoreceptor surface of this roll-like cleaning assistant member was set to 1.0 mm and the pressure to the photoreceptor surface was set to 24.5 mN/mm under a measuring environment at 25° C. The reciprocating mechanism shown in FIG. 17 was removed so as to cancel the reciprocating motion of the roll-like cleaning assistant member. This roll-like cleaning assistant member was rotated at a peripheral velocity ratio of 0.6 to the photoreceptor in the same direction as a rotation direction of the photoreceptor in a contact area with the photoreceptor surface.

Example 27

The same test and evaluation as the example 20 were carried out using an image forming apparatus (see Table 5) having the same specification as the image forming apparatus used in the example 23 except that the cleaning assistant member disposed in the cleaning unit was replaced with before-charging bias power supply. Its result is shown in Table 6.

In this example 27, ultra fine nylon fibers (GX4: manufactured by TOEI SANGYO CO., Ltd.) (material: nylon fiber, fiber size: 0.5 denier (about 4.25 μm, fiber length 2.5 mm, electric resistance: $1\times10^8\Omega$, fiber density: 800,000/6.45 $cm^2$) was used and this ultra fine nylon fibers were brought into contact with the photoreceptor surface such that they bit into the photoreceptor by 0.75 mm over 5 mm in the rotation direction of the photoreceptor. Further, this cleaning assistant member was reciprocated at an interval of two reciprocations per a turn of the photoreceptor with a move width of 5 mm in the extension direction of the rotation axis of the photoreceptor.

In the example 27, −450 V before-charging bias (same polarity as the charging polarity of toner) was applied to the fine fibers of the cleaning assistant member as the before-charging bias power supply.

Example 28

The same test and evaluation as the example 20 were carried out using an image forming apparatus (see Table 5) having the same specification as the image forming apparatus used in the example 20 except that the charger was changed from a non-contact charging type corotoron charger to a contact type charging type charger having a charging roll. Its result is shown in Table 6.

In this example 28, conductive rubber roll (manufactured by Tokai Rubber Industries. Ltd.) having a diameter of 14 mm was used as the charging roll of the charger and AC electric field was controlled so that an applied voltage of the charging roll was −660 V in terms of DC component and a current between the photoreceptor and charging roll was 1.7 mA.

Comparative Example 11

The same test and evaluation as the example 20 were carried out using an image forming apparatus (see Table 5) having the same specification as the image forming apparatus used in the example 20 except that the cleaning assistant member and before-charging bias power supply disposed in the cleaning unit were replaced with those shown below. Its result is shown in Table 6.

In this comparative example 11, fine nylon fibers (UUN2d, manufactured by TOEI SANGYO CO., Ltd.) (material: nylon fiber, fiber size: 2 denier (about 17 μm), fiber length 2.5 mm, electric resistance: $1\times10^8\Omega$, fiber density: 120,000/6.45 $cm^2$) was used and this ultra fine nylon fibers were brought into contact with the photoreceptor surface such that they bit into the photoreceptor by 0.75 mm over 5 mm in the rotation direction of the photoreceptor. Further, this cleaning assistant member was reciprocated at an interval of two reciprocations per a turn of the photoreceptor with a move width of 5 mm in the extension direction of the rotation axis of the photoreceptor.

In the example 11, −450 V before-charging bias (same polarity as the charging polarity of toner) was applied to the fibers of the cleaning assistant member as the before-charging bias power supply.

Comparative Example 12

The same test and evaluation as the example 20 were carried out using an image forming apparatus (see Table 5) having the same specification as the image forming apparatus used in the comparative example 11 except that the photoreceptor was replaced with a photoreceptor F whose surface was constituted of a protective layer containing siloxane base resin. Its result is shown in Table 6.

Comparative Example 13

The same test and evaluation as the example 20 were carried out using an image forming apparatus (see Table 5) having the same specification as the image forming apparatus used in the example 22 except that the before-charging bias power supply was removed from the cleaning unit and the fine fibers were brought into contact with the photoreceptor surface with no before-charging bias applied to the fine fibers of the cleaning assistant member. Its result is shown in Table 6.

Comparative Example 14

The same test and evaluation as the example 20 were carried out using an image forming apparatus (see Table 5) having the same specification as the image forming apparatus used in the example 22 except that the cleaning assistant member was removed from the cleaning unit and a before-cleaning charger which adjusts the polarities of residual toner particles to the same polarity was disposed. Its result is shown in Table 6.

The comparative example 14 excluding the cleaning assistant member and the comparative examples 11, 12 using a cleaning assistant member whose fiber size was as large as 17 μm generated image defocus (image flow). It is considered that the image defocus in these comparative examples was generated because removal of discharge product was insufficient and remaining discharge product absorbed moisture. Contrary to this, all the examples used a cleaning assistant member whose fiber size was 10 μm or less. In each example, generation of image defocus is suppressed. From this, it can be said that disposing the cleaning assistant member whose fiber size was 10 μm or less led to sufficient removal of the discharge product.

Although in the comparative example 13 in which no before-charging bias was applied to the fine fibers while the cleaning assistant member whose fiber size was 10 μm or less was used, generation of image defocus was suppressed, the cleaning performance of the residual toner particles is inferior. Contrary to this, the cleaning performance of the residual toner particles is excellent in the comparative examples 11, 12 in which the before-charging bias is applied as well as any example in which the before-charging bias is applied. This indicates that application of the before-charging bias allows the cleaning performance of the residual toner particles to be maintained in long periods.

As a result of analyzing results of the respective examples, abrasion and flaws in the photoreceptor are suppressed in the examples using the photoreceptors F, or G provided with the protective layer as compared with the examples 20, 21, 28 using the photoreceptors D, E provided with no protective layer. From this, it can be said that it is preferable to use a photoreceptor having the protective layer. Further, it is evident that the cleaning assistant member may be of column type or roll type if comparing results of the examples 23-25 with results of the example 26.

What is claimed is:

1. A cleaning unit that removes residues left on the surface of a photoreceptor after a toner image is transferred to an image transferring object's surface, the photoreceptor carrying the toner image to a predetermined transfer area by moving the surface of the photoreceptor cyclically while carrying the toner image intended to be transferred to the image transferring object's surface in the predetermined transfer area, comprising:

a cleaning blade that keeps a front end thereof made of rubber material in contact with the surface with a pressure so as to scrape residual toner left on the surface after the toner image is transferred to the image transferring object's surface; and a fiber body having multiple fibers in contact with the surface after the toner image is transferred to the image transferring object's surface in the upstream in the cyclic moving direction of the surface of the photoreceptor with respect to the cleaning blade, wherein the cleaning blade satisfies $$A \geqq -2.5 \times B + 102: \quad \text{formula (1)}$$

$$6.3 \leqq B \leqq 19.6: \quad \text{formula (2)}$$

where in the above formula (1), A designates a contact angle (°) with pure water under 23° C., 55% RH and B designates 100% modulus (MPa) at 23° C.

2. The cleaning unit according to claim 1 wherein the fibers each have a size of 10 μm or less.

3. A cleaning unit that removes residues left on the surface of a photoreceptor after a toner image is transferred to an image transferring object's surface, the photoreceptor carrying the toner image to a predetermined transfer area by moving the surface of the photoreceptor around a center axis while carrying the toner image intended to be transferred to the image transferring object's surface in the predetermined transfer area, comprising:

a cleaning section that removes residual toner left on the surface after a toner image is transferred to the image transferring object's surface from the surface of the photoreceptor;

a fiber body having multiple fibers in contact with the surface after the toner image is transferred to the image transferring object's surface in the upstream in the cyclic moving direction of the photoreceptor surface with respect to the cleaning section; and a reciprocating mechanism that reciprocates the fiber body and the photoreceptor surface relatively in an extension direction of the center axis.

4. The cleaning unit according to claim 3, wherein each of the fibers has a size of 10 μm or less and a width of 1.5 mm or more in the cyclic moving direction of the photoreceptor surface.

5. A cleaning unit that removes residues left on the surface of a photoreceptor after a toner image is transferred to an image transferring object's surface, the photoreceptor carrying the toner image to a transfer area for transferring the toner image to the image transferring object's surface by moving the surface of the photoreceptor cyclically while carrying the toner image composed of toner having a predetermined charging polarity, comprising:

a cleaning brush that has feathers extending radiantly from a rotation axis parallel to the center axis and supplied with a voltage having an opposite polarity to the charging polarity of the toner and rubs the surface after the toner image is transferred to the image transferring object's face with the feathers when rotating around the rotation axis;

a fiber body that has multiple fibers having a size of 10 μm or less in contact with the surface after the toner image is transferred to the image transferring object's surface, located in the upstream in the cyclic moving direction of the photoreceptor surface with respect to the cleaning brush; and a voltage applying section that applies a voltage having the same polarity as the charging polarity of the toner to the multiple fibers.

6. An image forming apparatus that forms an electrostatic latent image on the surface of a photoreceptor by charging the surface of the photoreceptor moving cyclically in a predetermined direction around a center axis and irradiating the surface of the photoreceptor after charged with exposure light so as to obtain a toner image on the surface of the photoreceptor by developing the electrostatic latent image with toner and forms an image composed of the toner image on a recording medium by transferring the toner image to a predetermined image transferring object's surface and finally fixing the transferred toner image to the recording medium, comprising:

a cleaning blade that keeps a front end thereof made of rubber material in contact with the surface with a pressure so as to scrape residual toner left on the surface after the toner image is transferred to the image transferring object's surface;

a fiber body having multiple fibers in contact with the surface after the toner image is transferred to the image transferring object's surface of the photoreceptor in the upstream in the cyclic moving direction of the surface of the photoreceptor with respect to the cleaning blade, wherein, the cleaning blade satisfies $$A \geqq -2.5 \times B + 102: \quad \text{formula (1)}$$

$$6.3 \leqq B \leqq 19.6: \quad \text{formula (2)}$$

where in the above formula (1), A designates a contact angle (°) with pure water under 23° C., 55% RH and B designates 100% modulus (MPa) at 23° C.

7. The image forming apparatus according to claim 6 wherein the fibers each have a size of 10 μm or less.

8. An image forming apparatus that forms an electrostatic latent image on the surface of a photoreceptor by charging the surface of the photoreceptor moving cyclically in a predetermined direction around a center axis with a charger and irradiating the surface of the photoreceptor after charged with exposure light so as to form a toner image on the surface of the photoreceptor, forms an image composed of the toner image on a recording medium based on toner image formation cycle of forming the toner image on the surface of the photoreceptor by developing the electrostatic latent image with toner by transferring the toner image formed on the surface of the photoreceptor to a predetermined image transferring object's surface and finally fixing to the recording medium, comprising:

a cleaning section that removes residual toner left on the surface after a toner image is transferred to the image transferring object's surface from the surface of the photoreceptor;

a fiber body having multiple fibers in contact with the surface after the toner image is transferred to the image transferring object's surface in the upstream in the cyclic moving direction of the photoreceptor surface with respect to the cleaning section; and a reciprocating mechanism that reciprocates the fiber body and the photoreceptor surface relatively in an extension direction of the center axis.

9. The image forming apparatus according to claim 8, wherein the fiber body has multiple fibers each having a size of 10 μm or less and a width of 1.5 mm or more in the cyclic moving direction of the photoreceptor surface.

10. The image forming apparatus according to claim 8 comprising:

an environment detection sensor that detects humidity and/or temperature in the image forming apparatus; and a control portion that determines whether any of an absolute water quantity in the image forming apparatus calculated by using a detection result of the environment detection sensor, a temperature based on the detection result of the environment detection sensor and a humidity based on the detection result of the environment detection sensor is over a predetermined value and if determined to be over the value, increase the speed of a relative reciprocation between the fiber body and the photoreceptor by the reciprocating mechanism, or increases the amplitude or increases the speed and amplitude.

11. An image forming apparatus that forms an electrostatic latent image on a photoreceptor surface by charging the surface of the photoreceptor rotating in a predetermined direction around the center axis and irradiating the surface of the photoreceptor after charged with exposure light so as to obtain a toner image on the surface of the photoreceptor by developing the electrostatic latent image with toner having a predetermined charging polarity and forms an image composed of the toner image on a recording medium by transferring the toner image to a predetermined image transferring object's surface and finally fixing the transferred toner image to the recording medium, comprising:

a cleaning brush that has feathers extending radiantly from a rotation axis parallel to the center axis and supplied with a voltage having an opposite polarity to the charging polarity of the toner and rubs the surface after the toner image is transferred to the image transferring object's surface with the feathers when rotating around the rotation axis;

a fiber body having multiple fibers having a size of 10 μm or less in contact with the surface after the toner image is transferred to the image transferring object surface, of the photoreceptor, located in the upstream in the rotation direction of the photoreceptor with respect to the cleaning brush; and a voltage applying section that applies a voltage having the same polarity as the charging polarity of the toner to the multiple fibers.

12. The image forming apparatus according to claim 11, wherein the photoreceptor includes a protective layer that includes resin containing a structure unit having charge transportation capacity and cross-link structure.

* * * * *